US007665225B2

(12) United States Patent
Goldberg et al.

(10) Patent No.: US 7,665,225 B2
(45) Date of Patent: Feb. 23, 2010

(54) HEAT PUMP CLOTHES DRYER

(76) Inventors: Michael Goldberg, 176 Stanley Dr., Glastonbury, CT (US) 06033; James C. Truman, 56 Crane Hill Rd., Storrs, CT (US) 06268; Alexander B. Kniffin, 70 Forest St., East Hartford, CT (US) 06118

( * ) Notice: Subject to any disclaimer, the term of this patent is extended or adjusted under 35 U.S.C. 154(b) by 188 days.

(21) Appl. No.: 11/402,421

(22) Filed: Apr. 11, 2006

(65) Prior Publication Data

US 2006/0179676 A1 Aug. 17, 2006

Related U.S. Application Data

(63) Continuation of application No. 10/949,139, filed on Sep. 23, 2004, now Pat. No. 7,055,262.

(60) Provisional application No. 60/507,466, filed on Sep. 29, 2003.

(51) Int. Cl.
*F26B 21/06* (2006.01)
*F26B 21/0694* (2006.01)

(52) U.S. Cl. ..... 34/73; 34/76; 34/77; 34/78

(58) Field of Classification Search ..... 62/175; 34/72, 73, 76, 77, 260, 261, 318, 322, 528, 34/108, 59, 599, 602, 139, 601, 127; 68/12.09, 68/15, 18 C; 285/121.3; 165/10
See application file for complete search history.

(56) References Cited

U.S. PATENT DOCUMENTS 183,721 A * 10/1876 Stewart ..... 34/281
468,573 A * 2/1892 Whirlpool ..... 72/134
2,330,420 A * 9/1943 Haberstump ..... 68/142
2,640,460 A * 6/1953 Siegel ..... 119/455
3,722,106 A * 3/1973 Takeyama et al. ..... 34/82
3,922,798 A * 12/1975 McMillan ..... 34/73
4,603,489 A * 8/1986 Goldberg ..... 34/77
4,621,438 A * 11/1986 Lanciaux ..... 34/77
5,050,313 A * 9/1991 Wakaeya et al. ..... 34/454
5,220,954 A * 6/1993 Longardner et al. ..... 165/10
5,548,908 A * 8/1996 Torborg et al. ..... 34/601
5,555,645 A * 9/1996 Joslin ..... 34/499
5,586,396 A * 12/1996 Kanai ..... 34/59
5,833,446 A * 11/1998 Smith et al. ..... 418/201.1
6,460,358 B1 * 10/2002 Hebert ..... 62/225
6,619,063 B1 * 9/2003 Brumett ..... 62/264
6,619,066 B1 * 9/2003 Kaneo ..... 62/324.2

FOREIGN PATENT DOCUMENTS

JP 05031298 A * 2/1993

* cited by examiner

*Primary Examiner*—Kenneth B Rinehart

(57) ABSTRACT

A drying apparatus for drying articles such as clothing is provided. The drying apparatus includes a chamber for containing articles to be dried and a system for supplying heated dry air at a first temperature to the chamber. The air supplying system comprises an air flow pathway having an evaporator for removing moisture from air exiting the chamber and for decreasing the temperature of the air to below dew point temperature. The air supply system further has a condenser for increasing the temperature of the air exiting the evaporator to the first temperature. The drying apparatus further has a heat pump system having a refrigerant loop which includes a compressor, the condenser, a TEV valve, and the evaporator.

20 Claims, 39 Drawing Sheets

HEAT PUMP CLOTHES DRYER

CROSS-REFERENCE TO RELATED APPLICATION

This application is a continuation application of U.S. patent application Ser. No. 10/949,139, filed Sep. 23, 2004 now U.S. Pat. No. 7,055,262, entitled HEAT PUMP CLOTHES DRYER, By Michael Goldberg et al., which claims the benefit of U.S. Provisional Patent Application 60/507,466, filed Sep. 29, 2003 and entitled "HEAT PUMP CLOTHES DRYER", the disclosure of which is incorporated by reference herein as if set forth at length.

BACKGROUND OF THE INVENTION

The present invention relates to a dryer for drying clothes and other things made from fabric and to a washer for washing same.

Ordinary dryers are a study in simplicity. As shown in FIG. 30, they draw room air, pass it over a heater, and blow it through a rotating drum containing laundry to be dried. The air passes through the drum once, and is then vented out of the building. Some of the air extracts moisture from the fabric, and some of it bypasses the laundry, and escapes without doing any work. This is the simplest, least expensive, and the most fallacious way to build a dryer.

SUMMARY OF THE INVENTION

Accordingly, it is an object of the present invention to provide a dryer which has improved performance and efficiency.

The foregoing object is attained by the present invention.

In accordance with the present invention, a drying apparatus broadly comprises a chamber for containing articles to be dried, means for supplying heated dry air at a first temperature to the chamber, which air supplying means comprises an air flow pathway having means for removing moisture from air exiting the chamber and for decreasing the temperature of the air to below dew point temperature and means for increasing the temperature of the air exiting the moisture removing means to the first temperature, and a heat pump system. The heat pump system comprises means for passing a refrigerant in a liquid state through the temperature increasing means, means for controlling refrigerant mass flow and for converting the refrigerant from the liquid state to a liquid/vapor state, and means for passing the refrigerant in the liquid/vapor state through the moisture removing means to convert the refrigerant into a vapor state.

In a second aspect of the present invention, a washing apparatus is provided. The washing apparatus broadly comprises a washing chamber, means for supplying heated water to the washing chamber, which heated water supplying means comprises a first heat storage device having a heat exchanger device and an inlet means for receiving water, means for draining heated water from the washing chamber and passing heat from the heated water to a drain side heat storage device, and a heat pump system for transferring heat from the drain side heat storage device to the first heat storage device.

In yet another aspect of the present invention, a drying chamber for use in a drying system is provided. The drying chamber comprises a stationary drum and a plurality of rotating vanes for tumbling the article to be dried.

Other details of the heat pump clothes dryer of the present invention, as well as other objects and advantages attended thereto, are set forth in the following detailed description and the accompanying drawings wherein like reference numerals depict like elements.

DETAILED DESCRIPTION OF THE PREFERRED EMBODIMENT(S)

Heat Pump Dryer

Inside the drum, the basic heat pump dryer functions in the same way as a conventional dryer. Heated dry air enters the drum, extracts moisture from the clothes, and then leaves the drum, cooler and wetter. The fundamental difference is in the way the heat pump dryer provides the heated dry air.

Instead of continually heating room air and then venting it, the heat pump dryer dries and warms the air from the drum exhaust, and returns it to the drum. Useful heat is recovered and reused instead of being vented out of the building.

This is accomplished by connecting the drum exhaust back to the drum intake, through dehumidifier means. The heat pump dryer uses a closed air loop, with dehumidifier means in the flow path. The dehumidifier means removes entrained moisture from wet air exiting the drum, reheats the air, and returns it to the drum. The drum is a rotating drum which may be rotated by any suitable means known in the art.

Figure 1:
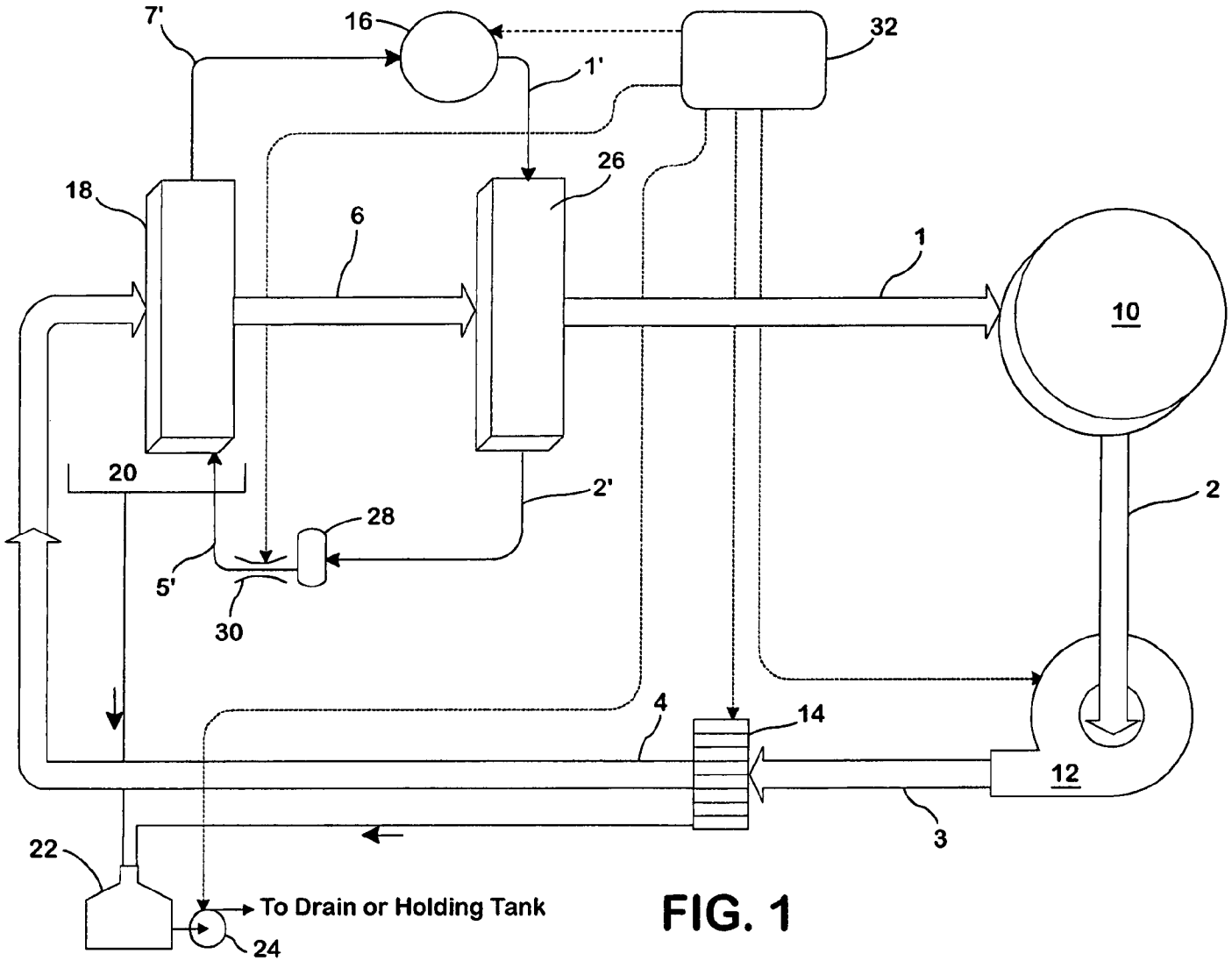
FIG. 1 is a schematic illustration of a dryer in accordance with the present invention.

With reference to FIG. 1, heated dry air enters rotating drum, 10, at Point 1, and extracts moisture from the tumbling fabric. Air then leaves the drum, 10, laden with extracted moisture at Point 2, and enters the main blower, 12, which circulates drying air through the drying air loop. Air leaves the main blower, 12, at Point 3, and passes through the wet air heatsink, (heatsink), 14.

The heatsink, 14, as taught in U.S. Pat. No. 4,603,489, which is incorporated by reference herein, removes heat substantially equal to the power consumption of the heat pump compressor, 16. In the preferred embodiment, heatsink, 14, is a simple air to air heat exchanger that conducts heat from the drying air to the ambient air surrounding the dryer. The drying air does not communicate with the ambient air, only heat is passed. Heatsink, 14, is preferably cooled with fan or blower driven ambient room air. In an alternate embodiment, the heatsink, 14, may be a liquid cooled type.

As the dryer is a closed loop design, continuous removal of heat substantially equal to power consumption is necessary to control operating temperature. The heatsink, 14, removes heat after it has performed useful work in the drum, a desirable feature. Alternate approaches, as taught in prior art, remove heat from the drying air before it enters the drum, cooling the air entering the drum, and materially compromising performance.

Drying air exits the heatsink, 14, at point 4, and enters the evaporator, 18, which cools the air below its dew point. The moisture previously extracted from the fabric condenses out of the drying air, is collected by drip tray, 20, and drains into collection tank, 22. In the preferred embodiment, an automatic pump, 24, pumps water from the collection tank, 22, to an external drain connection. Pump, 24, may be controlled by any suitable method, such as a float switch or electronic level sensor in collection tank, 22. In an alternate embodiment, collection tank, 22, may be removable for manual emptying.

The evaporator, 18, extracts sufficient sensible heat to pull the temperature of the air below its dew point, as well as heat of condensing of the water removed from the fabric. The required evaporator cooling capacity is thus equal to the sum of the sensible heat and the heat of condensing.

Drying air exits the evaporator, 18, at point 6, cool and effectively saturated (Nominal RH=85%~90%), and enters the condenser, 26. The condenser 26, reheats the air to its original temperature at Point 1. The air then exits the condenser, 26, and reenters the drum, 10, at point 1, completing the cycle. The heating capacity of the condenser, 26, is equal to the evaporator, 18, cooling capacity plus the power consumption of the heat pump compressor, 16.

The additional heat, equal to the power consumption of compressor, 16, that is added to the drying air by the condenser, 26, does useful work in the drum, 10, incrementally increasing the moisture extraction rate. This heat is then removed by the heatsink, 14, maintaining system heat balance.

Heat Pump

Referring again to FIG. 1, the system heat pump operates as a dehumidifier, as follows: Refrigerant exits the compressor, 16, as high pressure vapor, and passes to condenser 26, at point 1', where heat of condensation (of the refrigerant) is transferred away to the drying air. The refrigerant condenses, and exits the condenser, 26, at point 2', as high pressure liquid, and passes through receiver, 28, to thermal expansion valve (TEV), 30, which reduces the refrigerant pressure. The refrigerant exits the TEV, 30, at point 5', as a low pressure, low quality liquid/vapor mixture, (high liquid content) and enters the evaporator.

The evaporator, 18, extracts heat of vaporization of the refrigerant from the drying air, and boils the refrigerant to the vapor state. Slightly superheated vapor exits the evaporator, 18, at point 7', and reenters the compressor, 16, completing the cycle.

The TEV, 30, controls the refrigerant mass flow by proportionally opening and closing in response to system conditions. In one embodiment, it maintains a constant low superheat, to maximize evaporator capacity while preventing liquid from entering the compressor. A plurality of TEV and control embodiments and are discussed in the System Controls section of this document.

Control, 32, serves several functions, such as cycle time and dryness control, also discussed in the System Controls section of this document.

The control, 32, may be a control and monitoring system implemented using a micro-controller, micro-computer, or the like. The control, 32, may receive input from sensors and user input/output devices. The control, 32, may be coupled to various drier components via control lines (not shown) for controlling the respective operations. Sensors which may be used with the control, 32, include temperature sensors positioned at various locations along the air supply flow path and the refrigerant flow path and moisture sensors positioned at various locations along the air supply flow path.

Heat Pump Dryer Performance and/or Efficiency Improvements

Warmup Considerations

Textile drying occurs in three phases, Rising Rate or Warmup, Steady State, and Falling Rate, as discussed in Appendix A: Theoretical Considerations. When the heat pump dryer is first started, it must reach operating temperature before steady state drying rate is achieved. In practice, the rising rate phase in a heat pump dryer can be inordinately long, undesirably increasing the total drying time. The warmup time is a function of the mass of the heated portions of the dryer and the wet laundry, and the available heat. It is advantageous that this phase be as short as practical, and the dryer and the wet fabric brought to operating temperature as rapidly as practical.

Warmup Heat

In the basic configuration, as shown in FIG. 1, the heat pump is the only source of heat. At normal operating temperatures, the heat pump supplies more heat than needed for steady state drying, and the excess is released through the heatsink, 14. However, at low starting temperatures, the refrigerant pressure is low, and as a result, refrigerant mass flow is low, the heat pump consumes very little power, and supplies very little heat. This causes slow warmup, and increases the overall drying time.

Figure 2:
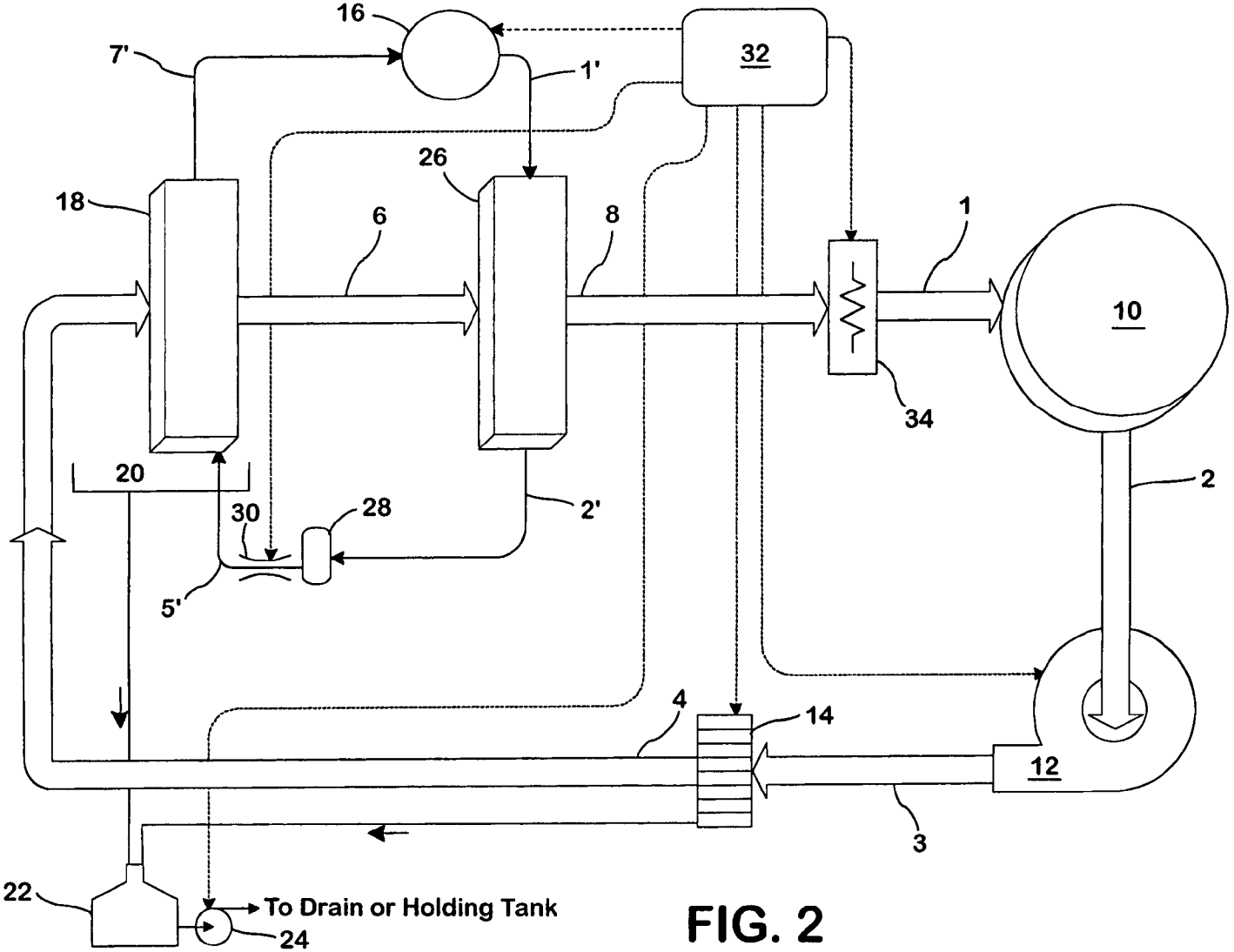
FIG. 2 is a schematic representation of a dryer with a warm up heater.

Warmup time may be reduced by the addition of a warmup heater, 34, as shown in FIG. 2, which directly heats the drying air, bringing the dryer and the laundry up to operating temperature in a comparatively short time. In the preferred embodiment, this heater is energized only until the dryer reaches operating temperature. The heater is preferably as large as available power permits, because a larger heater presents a shorter warmup period. It may be used without materially increasing overall energy consumption, because it is used for only a short time at the beginning of each cycle.

In an another embodiment, an electric warmup heater may be incorporated in the refrigerant piping, to either supplement or replace the warmup heater, 34, in the air loop. Radiant or conduction heating means, discussed in the section Nonconvective Heating, may also be used for warmup heat, either in lieu of or in conjunction with, a warmup heater in the air loop and/or the refrigerant circuit.

Alternate Warmup Means

External Evaporator

Figure 3:
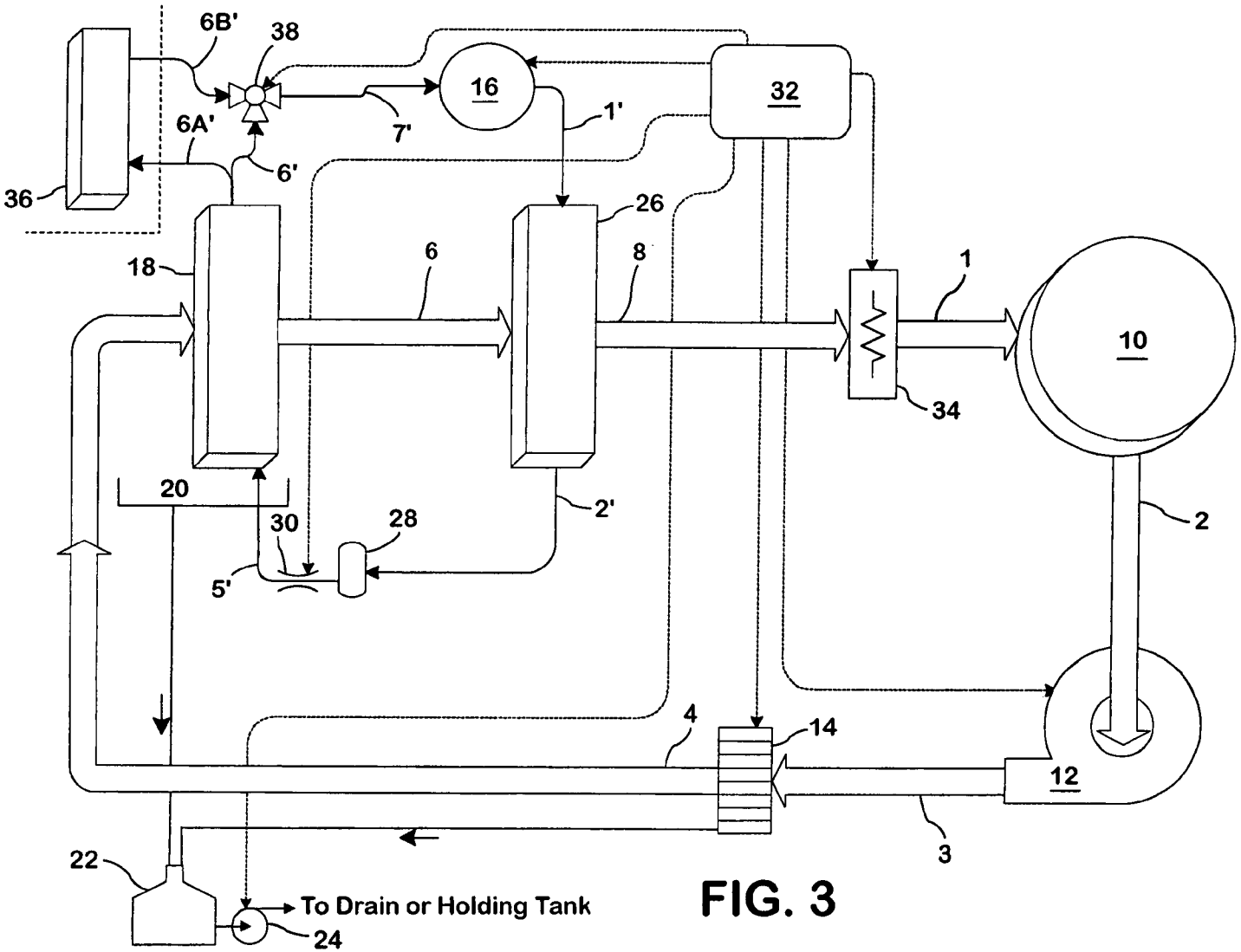
FIG. 3 is a schematic diagram of a dryer with an external warm up evaporator and a refrigerant diverter valve control.
Figure 4:
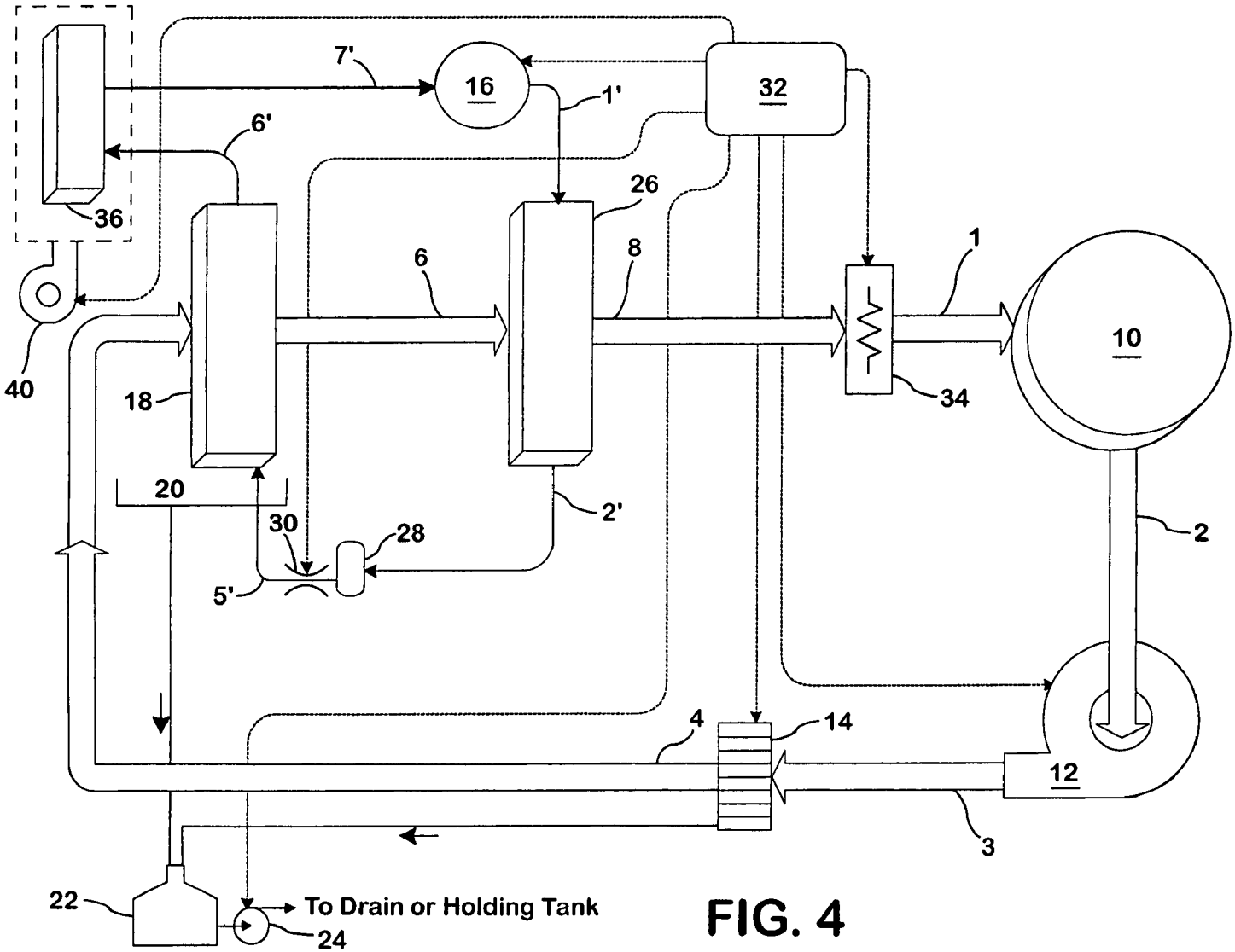
FIG. 4 is a schematic diagram of a dryer with an external warm up evaporator and a warm air supply control.

An alternate source of warmup heat may be realized by means of an external warmup evaporator, 36, as shown in FIG. 3 and FIG. 4. In both embodiments, during warmup, refrigerant gas passes from evaporator, 18, through warmup evaporator, 36, before entering compressor, 16. Warmup evaporator, 36, draws heat from the ambient room air, which is transported by the heat pump to the condenser, 26. This approach supplies warmup heat equivalent to warmup heater, 34, but takes advantage of the heat pump coefficient of performance (C.O.P.), consuming less energy than warmup heater, 34, while providing substantially the same quantity of warmup heat.

As shown in FIG. 3, warmup heat may be controlled by means of Diverter Valve, 38, which switches warmup evaporator, 36, out of the refrigerant circuit when it is not needed. Diverter valve 38, is preferably a simple 3 way solenoid valve that is activated by control, 32; however, any suitable valve type may be used.

When the diverter valve, 38, is in warmup mode, point 7' is connected through the diverter valve, 38, to point 6B', and point 6' is cut off. Refrigerant then flows from the evaporator, 18, to the warmup evaporator, 36, at point 6A'. The warmup evaporator, 36, transfers heat from the room air to the refrigerant. The refrigerant then exits warmup evaporator, 36, at point 6B', passes through diverter valve, 38, to compressor, 16, suction at point 7'.

When diverter valve, 38, is in normal steady state mode, point 7' is connected to point 6', and point 6B' is cut off. Refrigerant exits evaporator, 18, at point 6, and passes through diverter valve, 38, to compressor suction at point 7'. Refrigerant does not enter the warmup evaporator 36 at point 6A' because its discharge, at point 6B', is cut off. In this mode, refrigerant bypasses the warmup evaporator, 36, entirely.

In FIG. 4, an alternate means of controlling the warmup evaporator, 36, is shown. In this embodiment, refrigerant passes through the warmup evaporator, 36, continuously. Warmup evaporator, 36, is enclosed in a preferably insulated housing that substantially restricts heat transfer and natural convective airflow. When warmup heat is needed, blower, 40, is energized, preferably by control, 32, forcing ambient room air over warmup evaporator, 36. When warmup heat is not needed, blower, 40, is shut down, again preferably by control, 32, and warmup evaporator, 36, is effectively cut off.

Variable Capacity Compressor

This approach compensates for refrigerant behavior at low temperatures by increasing the effective volumetric capacity of the compressor during warmup. With sufficiently increased volumetric capacity, the compressor 16 will draw normal or near normal power during warmup, and will pump heat at normal or near normal steady rate. This will provide warmup heat and good heat pump performance during warmup. Preferably, the compressor 16 is operated at increased capacity during warmup, and then stepped or ramped down to normal capacity as the dryer reaches desired operating temperature. Compressor capacity control is preferably handled by Control, shown as item 32 in FIGS. 1-4.

This approach is also useful in conjunction with other warmup methods, to insure proper condensation of water extracted from the laundry during warmup. Variable capacity may be a feature of the compressor itself; with means such as unloading cylinders, variable stroke, or the like. Alternatively, a two speed compressor motor, with separate low and high speed windings, may be used. A preferred method is compressor speed control via variable frequency drive electronics.

Variable Drying Air Flowrate

This approach increases compressor power consumption by reducing the drying loop mass airflow during warmup. This causes the evaporator saturation temperature to drop slightly, and the condenser saturation temperature to rise, effectively increasing the $\Delta_T$ and $\Delta_P$ across the compressor. This in turn reduces the compressor COP, and increases compressor power consumption.

The increased compressor power consumption in this mode is commensurate with that achieved using a variable speed compressor. This approach may be implemented with a simple electronic blower speed control, or with a two speed or multispeed blower motor; less expensive to manufacture than a variable speed compressor drive.

Variable capacity compressor means and variable airflow means may be employed together, for combined effect. The warmup heater, 34, is not needed in embodiments with alternate warmup means; if desired, it may be used to supplement the alternate warmup means, and further reduce warmup time.

Air Economizer

Figure 5:
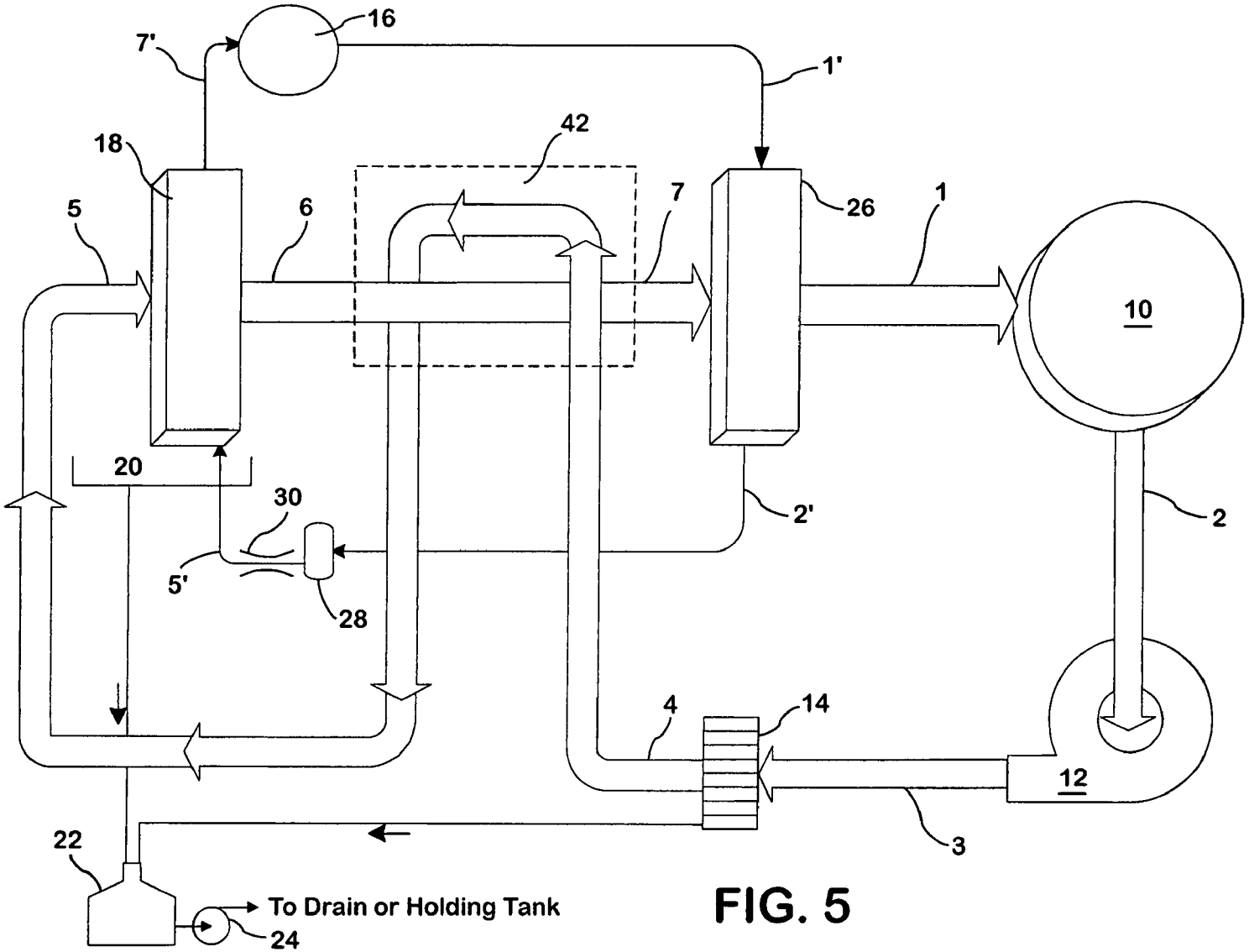
FIG. 5 is a schematic representation of a dryer with an air economizer.

Control, 32, has been deleted from FIG. 5, and subsequent figures, for clarity.

An improved embodiment of the heat pump dryer includes an air economizer, 42, as shown in FIG. 5. In this embodiment, the air economizer, 42, is an air to air heat exchanger which operates as follows: Wet air exits the Heatsink, 14, at point 4, and instead of passing directly to the evaporator, 18, it first enters the air economizer, 42. Heat from the wet airstream is transferred through the air economizer, 42, to the cold saturated air exiting the evaporator, 18, at Point 6. The two airstreams do not communicate, only heat is transferred between them.

The cooled wet air then exits the air economizer, 42, and enters the evaporator, 18, at Point 5. The evaporator 18 cools the air to below dew point, as in previously discussed embodiments. However, the economizer, 42, has extracted a significant portion of the sensible heat in the wet air, and as a result, a larger portion of the evaporator, 18, cooling capacity is available for condensing moisture. This benefit may manifest as a smaller (reduced cooling capacity) less expensive evaporator, or as increased moisture condensing rate, as desired.

Cooled saturated air then leaves the evaporator, 18, and enters the economizer, 42, at point 6, where it receives heat from the wet air entering at point 4, as discussed above. The warmed air then leaves the economizer, 42, and enters the condenser, 26, at point 7. The condenser 26 reheats the air as per previously discussed embodiments, however, the entering air is significantly warmer, and the required condenser heating capacity is reduced. This may manifest as a smaller (reduced heating capacity) less expensive condenser, or as increased heating rate, as desired.

The heat exchange capacity of the economizer, 42, manifests as additional effective cooling capacity at the evaporator and additional heating capacity at the condenser, with no additional energy consumption. For a given evaporator and condenser, the addition of the air economizer, 42, will result in increased drying rate. If they are made smaller, the compressor, 16, may also be made smaller and less expensive, and the same drying rate will be realized, with reduced energy consumption.

Refrigerant Subcooler

Figure 6:
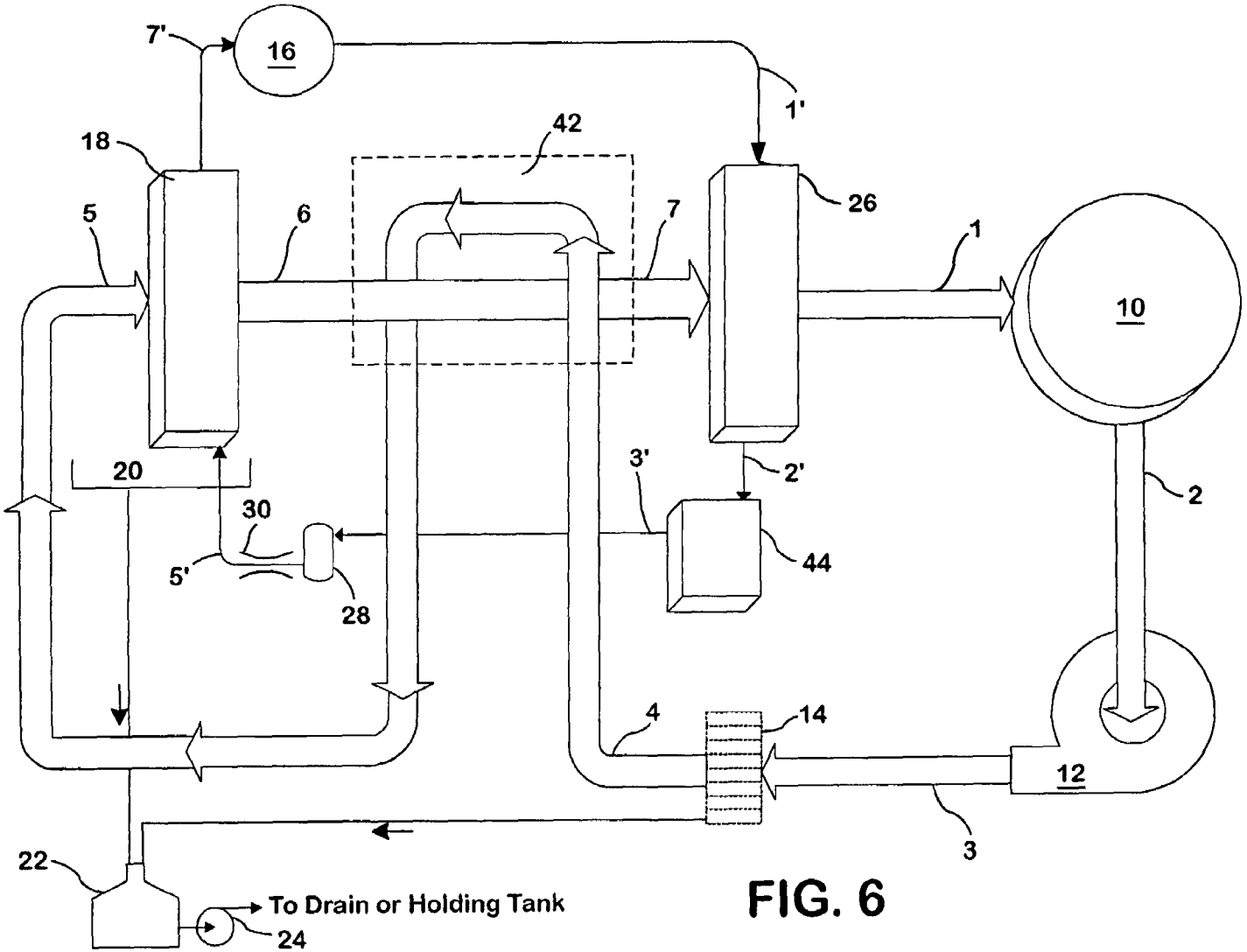
FIG. 6 is a schematic diagram of a dryer with an air economizer and a refrigerant subcooler.

The wet air heatsink, 14, is effective as a means for removing heat from the dryer, after the heat has done useful work. An alternate means for removing heat substantially equal to the compressor power consumption, an improvement over the wet air heatsink, 14, is shown in FIG. 6.

In this embodiment, refrigerant exits the condenser, 26, and enters the refrigerant subcooler, 44, at point 2'. The subcooler, 44, removes heat substantially equal to the compressor, 16, power consumption, effectively performing the same function as the heatsink, 14, which is not needed when subcooler, 44, is used. The heatsink, 14, is shown as dashed lines to indicate that it is not required.

Refrigerant exits the subcooler, 44, at point 3', and passes through receiver, 28, to TEV, 30. The TEV, 30, reduces the refrigerant pressure, as in previously discussed embodiments. However, the subcooler, 44, has removed substantial heat from the refrigerant, and it enters TEV, 30, at significantly lower enthalpy. Refrigerant exiting TEV, 30, and entering evaporator, 18, at point 5' is of much lower quality (more liquid, less gas) when subcooler, 44, is used. This materially improves the cooling capacity of evaporator, 18.

The subcooler, 44, has additional advantages over the heatsink, 14. The subcooler, 44, is preferably a refrigerant to air or refrigerant to liquid heat exchanger, as opposed to the heatsink, 14, which is an air to air heat exchanger. Consequently the subcooler, 44, is more effective, and may be smaller and less expensive to manufacture.

The refrigerant entering the subcooler, 44, at point 2' is substantially hotter than the wet air entering the heatsink, 14, at point 3. Consequently the subcooler, 44, has a larger approach ($\Delta T$ between the refrigerant, and the cooling fluid, e.g., room air) than does the heatsink, 14, further improving its effectiveness, and permitting additional size reduction.

The subcooler 44 also changes the system heat balance. Normally, the condenser, 26, capacity is equal to the evaporator, 18, capacity plus the compressor, 16, power consumption. However, since compressor, 16, power is removed by the subcooler, 44, energy balance dictates that the condenser, 26, capacity must equal the evaporator, 18, capacity. Saturation temperatures are reduced when the subcooler is active, evaporator capacity increases, and condenser capacity drops, until this equilibrium is reached.

As saturation temperatures in the system are reduced when the subcooler, 44, is active, either the evaporator, 18, superheat or the refrigerant mass flow will change accordingly. This is dependent on TEV, 30, behavior. If the TEV, 30, is configured to maintain constant superheat, it will increase refrigerant mass flow as needed when the subcooler, 44, is active, This will commensurately increase heat pump capacity and drying rate, provided loop airflow is sufficient.

If evaporator, 18, superheat is permitted to float, then it will increase when subcooler, 44, is active. This may be advantageous in some embodiments, discussed in the Refrigerant Economizer section of this document. When the subcooler, 44, is used, increased refrigerant superheat at the compressor suction, point 7', causes increased superheat in the refrigerant exiting the compressor, 16, at point 1'. This in turn reduces the condenser, 26, effectiveness, commensurate with the reduced condenser, 26, capacity required when the subcooler, 44, is active.

The subcooler, 44, has an additional advantage when used with the air economizer, 42. When the heatsink, 14, is used, the air economizer, 42, performance is materially reduced because wet air entering at point 4 has been cooled by the heatsink, 14. When the subcooler, 44, is used, and the heatsink, 14, is preferably not used, and the wet air entering the economizer, 42, is substantially warmer, substantially increasing economizer, 42, performance.

The subcooler 44 may be configured as an air cooled heat exchanger. In the air cooled embodiment, suitable fan or blower means are preferably included to deliver ambient room air to the subcooler air side. The fan or blower means preferably draws room air from the front of the dryer cabinet as close to the floor as practical, where the air is generally coolest, and exhausts the air at the rear of the cabinet, so as to avoid discharging warm air toward the operator, and to prevent drawing exhaust air.

Subcooler, 44, may be enclosed in a preferably insulated housing that substantially restricts heat transfer and natural convective airflow when fan or blower means are not operating, thus facilitating accurate subcooler, 44, effectiveness control, via cooling airflow control means.

Figure 33:
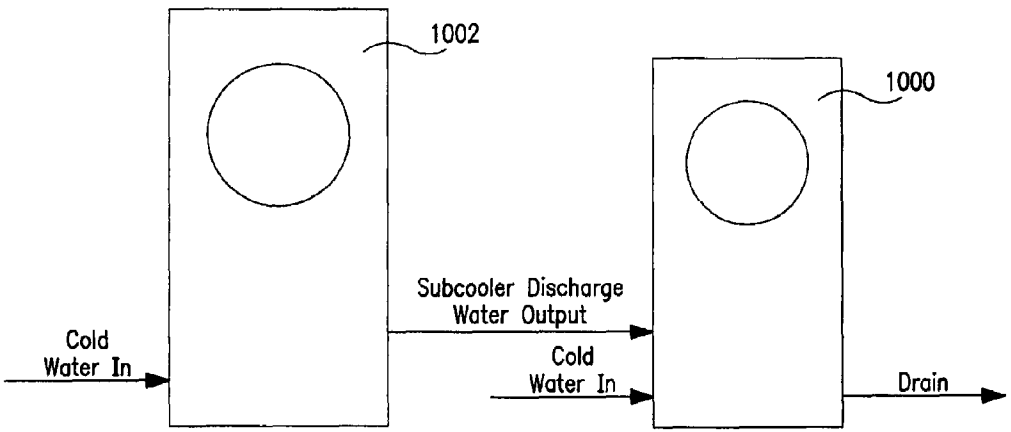
FIG. 33 illustrates the use of a water cooled dryer subcooler discharge as a hot washwater source.
Figure 35:
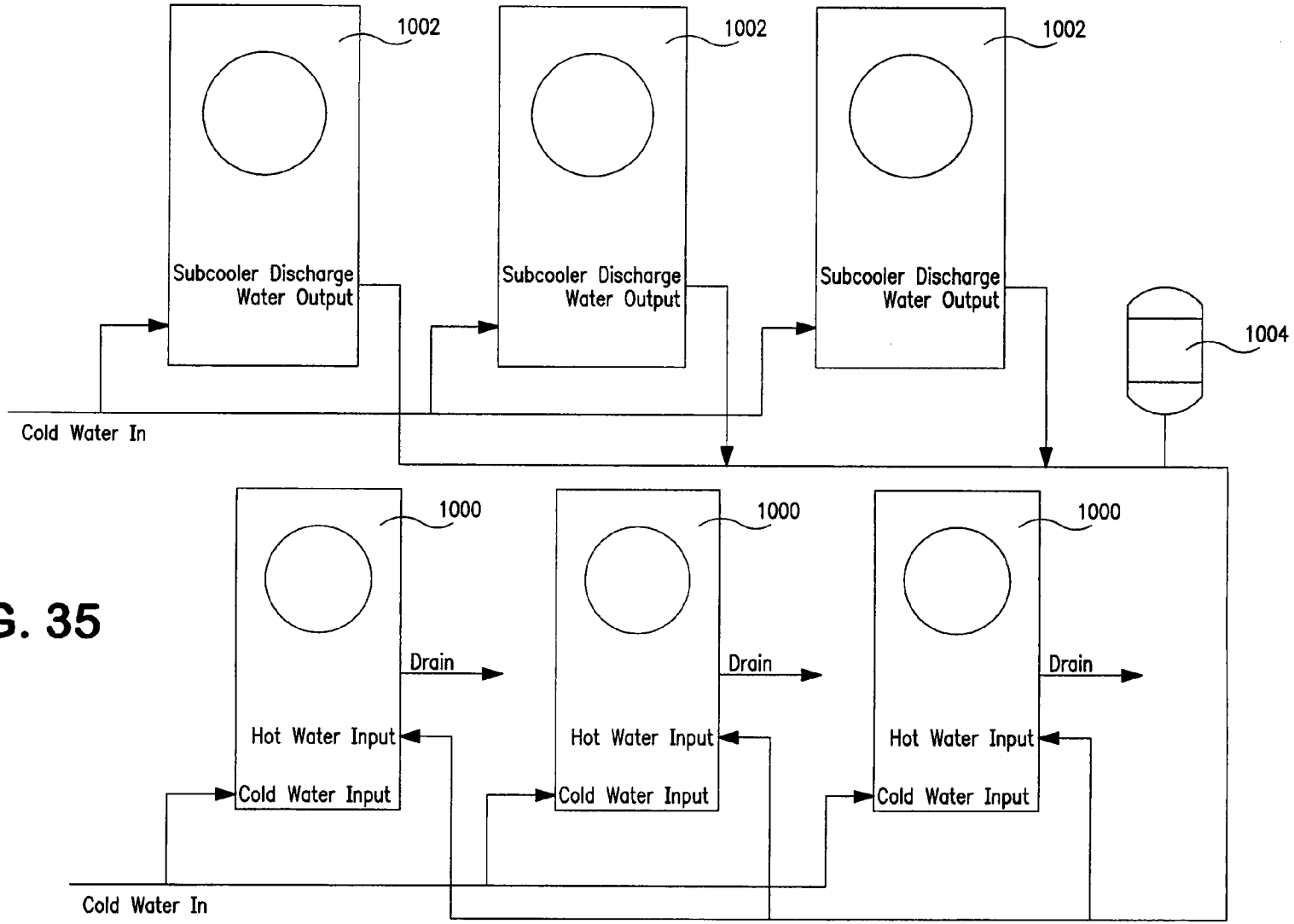
FIG. 35 illustrates a water cooled dryer subcooler as hot washwater source for multiple washers.

Alternatively the subcooler, 44, may be liquid cooled. In this embodiment, the cooling media may be cold tap water. In a laundry room or laundromat venue, the heat from the subcooler in each dryer 1002 may be used to preheat wash water for use by a washer 1000. Such a scenario is illustrated in FIGS. 33 and 35. As shown in FIG. 35, multiple washers 1000 and dryers 1002 may be manifolded together. If desired, an optional accumulator 1004 may be provided. Each dryer 1002 may be fitted with two common subcooler discharge water output ports if desired. Both ports are the same, and if only one is used, the other should be capped. They may be used together for daisy chaining the dryers together, eliminating the need for a manifold.

Figure 34:
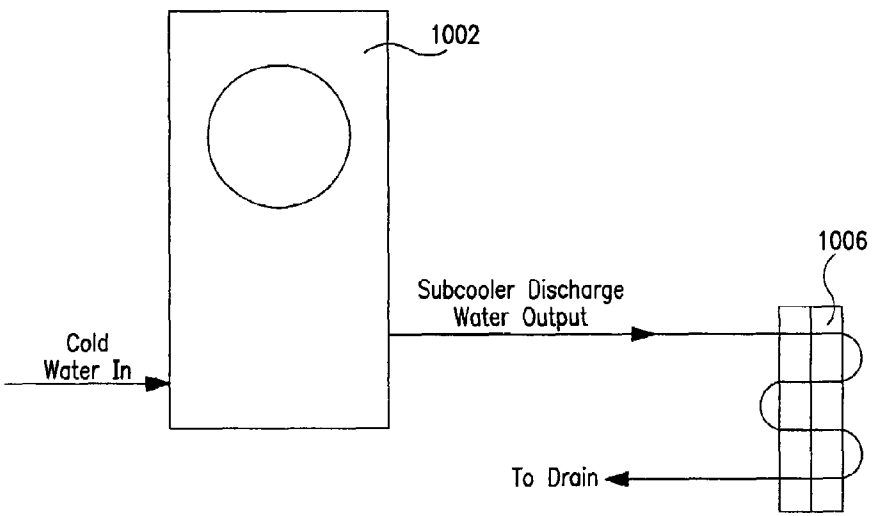
FIG. 34 illustrates the use of a water cooled dryer subcooler discharge as space heat source.

Referring now to FIG. 34, the water cooled dryer subcooler discharge may be used as a space heating source when supplied to an external radiator 1006 for space heating. If desired, the external radiator 1006 could be used for dryer cooling.

If desired, a liquid cooled subcooler, 44, embodiment may be used with a separate air cooled radiator to cool the liquid coolant. The radiator may be used within a unitary dryer housing to facilitate component fit, or may be remotely located, for example on a roof, or may provide useful space or process heat. The radiator may be used for cooling a single dryer or a plurality of dryers.

Heat Pipe Air Economizer

Figure 7:
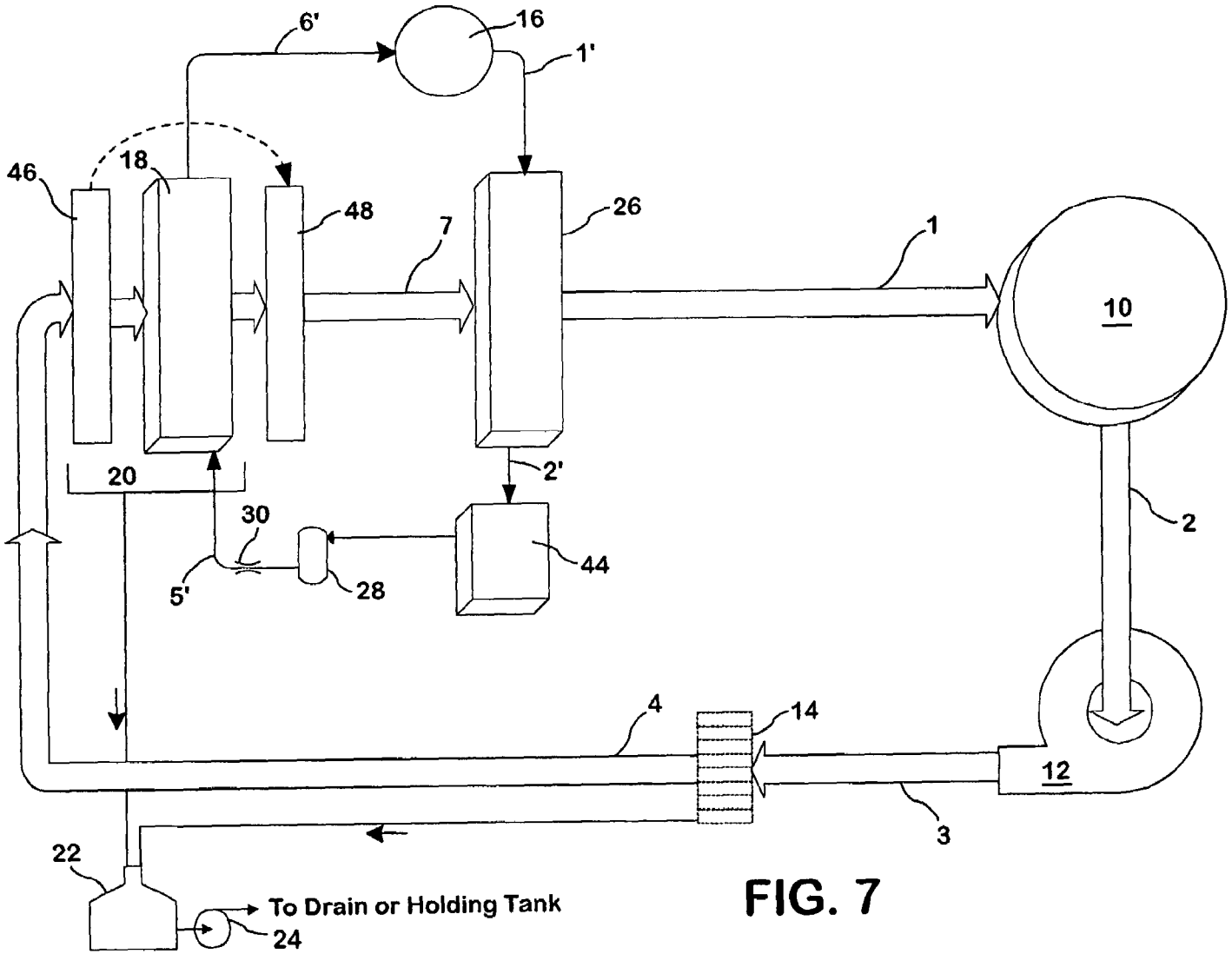
FIG. 7 is a schematic diagram of a dryer with a heat pipe air economizer and a refrigerant subcooler.

An alternate embodiment of the Air Economizer, 42, is shown in FIG. 7. In this embodiment, the air economizer, 42, comprises a heat pipe assembly in two heat exchanger sections connected by heat pipe means, designated 46 and 48, shown connected by a dashed line representing heat flux.

This approach offers thermodynamic performance similar to the air to air economizer, 42, shown in FIG. 5, with added practical manufacturing advantages. These advantages include the ability to install the economizer, 42, in line with the evaporator, 18, eliminating the need for crossover air ductwork, and multiple changes of direction in the airflow path. This embodiment presents reduced air loop pressure drop, and requires less cabinet space.

The heat pipe air economizer, 42, operates as follows: Wet air enters the heat pipe air economizer hot section, 46, at point 4. Heat from the wet air stream is transferred away by the hot section of the heat pipe economizer, 46. The heat pipe transports this heat to cold section, 48. The cooled wet air then exits the air economizer hot section, 46, and enters the evaporator, 18, at Point 5.

The evaporator cools the air below its dew point, as in previously discussed embodiments. However, the economizer, 42, has extracted a significant portion of the sensible heat in the wet air, and as a result, a larger portion of the evaporator, 18, cooling capacity is available for condensing moisture. This benefit may manifest as a smaller (reduced capacity) evaporator, or as increased moisture condensing rate, as desired.

Cooled saturated air then leaves the evaporator, 18, and enters the heat pipe economizer cold section, 48, at point 6, where it receives heat from the wet air entering at point 4, via the heat pipe, as discussed above. The warmed air then leaves the heat pipe economizer cold section, 48, and enters the condenser, 26, at point 7. The condenser, 26, reheats the air as per previously discussed embodiments. However, the entering air is significantly warmer, and the required condenser, 26, heating capacity is reduced. This may manifest as a smaller (reduced capacity) condenser, 26, or as increased heating rate as desired.

As with the air to air economizer, the heat exchange capacity of the economizer, 42, manifests as additional cooling capacity at the evaporator, 18, and additional heating capacity at the condenser, 26, with no additional energy consumption. If the evaporator, 18, and condenser, 26, are not changed, then the addition of the air economizer, 42, will result in increased drying rate. If the evaporator, 18, and condenser, 26, are made smaller, the compressor, 16, may also be made smaller, and the same drying rate will be realized with reduced energy consumption. In Beta level residential lab tests, the air economizer, 42, reduced energy consumption by 10%~15%.

Refrigerant Economizer

Figure 8:
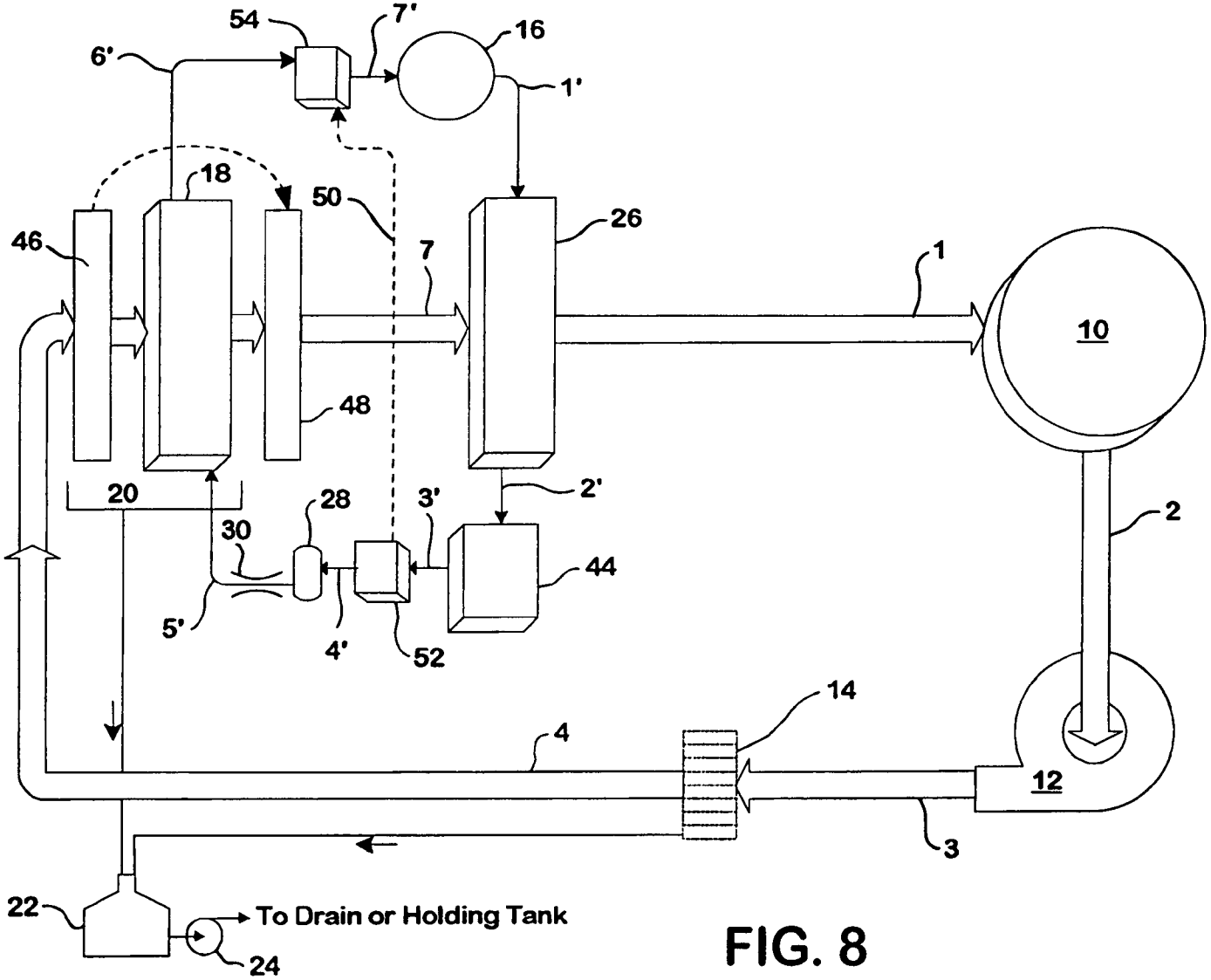
FIG. 8 is a schematic diagram of a dryer with a heat pipe air economizer, a refrigerant subcooler, and a refrigerant economizer.

Additional operating efficiency may be realized with a refrigerant economizer, 50, as shown in FIG. 8. The refrigerant economizer (RE), comprises two sections, 52, and 54. For clarity, the drawing shows the RE, 50, as two separate sections connected by a dashed line representing heat flux; typically the two sections comprise a single assembly. The preferred embodiment is a flat plate type heat exchanger, but any suitable refrigerant grade heat exchanger, such as coaxial tube, or the like, may be used.

In operation, referencing FIG. 8, refrigerant exits the subcooler, 44, at point 3', and enters the hot section of the RE, 52. The RE hot section, 52, transfers heat away from the refrigerant, to its cold section, 54. The refrigerant then exits the RE hot section, 52, at point 4, and passes through the receiver, 28, to the TEV, 30.

The TEV, 30, reduces the refrigerant pressure as in previously discussed embodiments. However, the enthalpy of the refrigerant entering the TEV, 30, is reduced, and exits the TEV, 30 at point 5' as a lower quality mixture (more liquid, less gas) than when the RE, 50, is not used. This increases the effective capacity of the evaporator, 18. This benefit may manifest as a smaller (reduced capacity) evaporator, or as increased moisture condensing rate, as desired.

In the preferred embodiment, the RE, 50, is used in conjunction with the subcooler, 44. In this configuration, heat is sequentially removed from the refrigerant in both the subcooler, 44, and the RE, 50, reducing the enthalpy of the refrigerant entering the TEV, 30, at point 4', further than with either component alone.

Refrigerant enters the evaporator, 18, at point 5' at reduced enthalpy, where it extracts heat of vaporization from the wet air. The refrigerant then exits evaporator, 18, as slightly superheated vapor, and enters the RE cold section, 54, at point 6'. In the RE cold section, 54, the refrigerant absorbs heat conducted from the liquid refrigerant in the RE hot section, 52, and exits the RE cold section, 54, as very superheated vapor. In Beta level lab testing, typical superheat has been on the order of 100° F.

The high superheat substantially increases the refrigerant density at the compressor, 16, suction, point 7'. If compressor, 16, is a constant displacement type, the increased refrigerant density at point 7' results in increased refrigerant mass flow. The high temperature at the compressor suction, point 7', also improves compressor isentropic efficiency.

In Beta level lab testing, the refrigerant mass flow increase has been on the order of 20%. This may manifest as increased heat pump capacity, and concurrent increased drying rate, or alternatively, a less expensive, smaller displacement compressor may be used with the RE, 50, with no performance degradation.

The high superheat delivered by the RE, 50, permits novel control methods. It is not necessary to maintain a margin of superheat at the evaporator, 18, discharge, point 6', because with the RE, 50, in use, there is no risk of liquid entering the compressor at point 7'. An alternate control algorithm that maintains constant temperature of the air exiting the evaporator, 18, at point 6, may be used, as discussed in the Controls section of this document.

The refrigerant economizer, 50, is shown in FIG. 8 with the preferred heat pipe air economizer. It may alternately be used with an air to air economizer such as shown in FIGS. 5 & 6; or with no air side economizer, at some loss of performance and efficiency. The RE, 50, may also be used with the heatsink, 14, with or in lieu of the subcooler, 44.

Alternate Configuration

Figure 9:
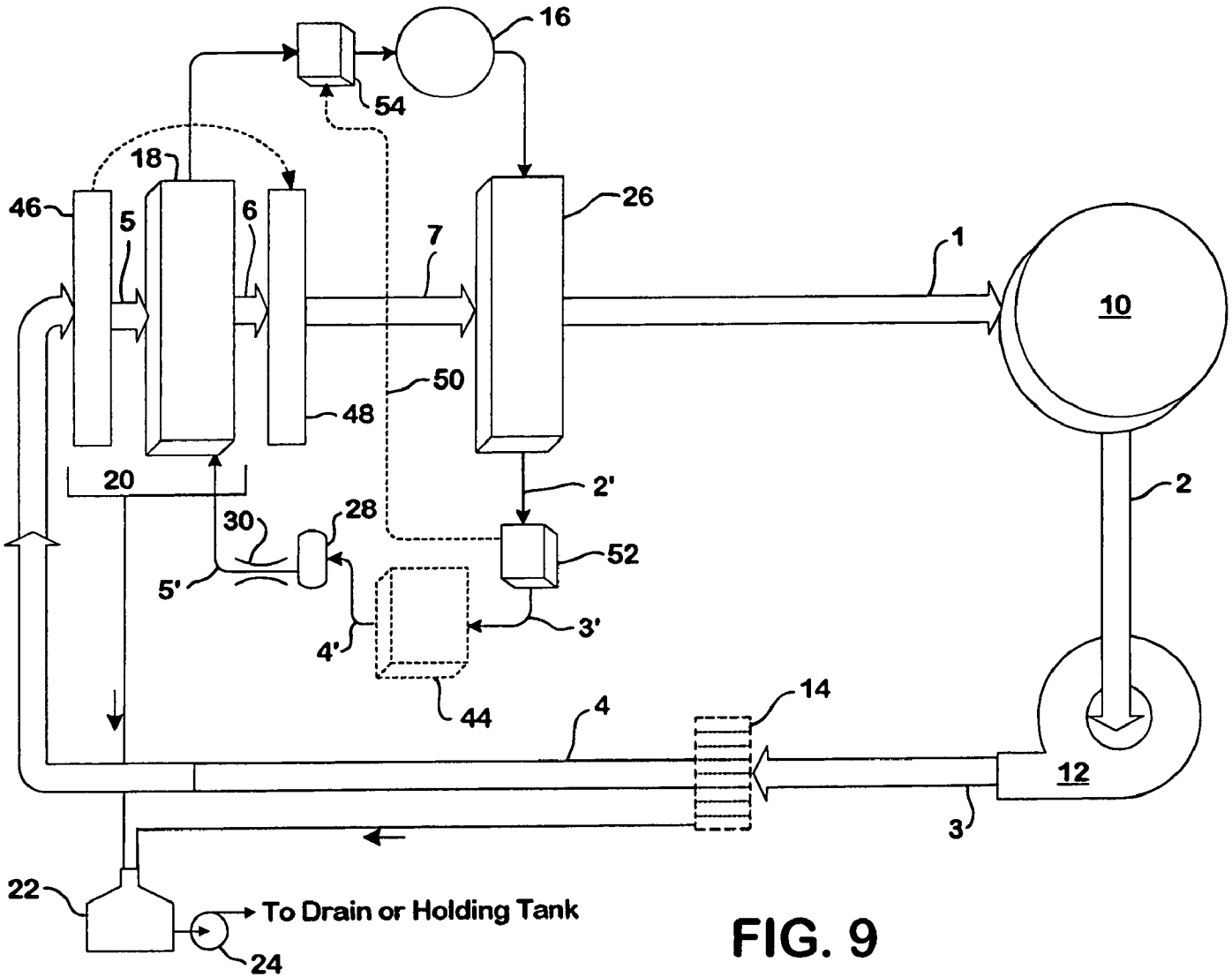
FIG. 9 is a schematic diagram of a dryer with an alternate refrigerant subcooler location.

FIG. 9 shows an alternate configuration in which the relative locations of the subcooler, 44, and the RE, 50, are interchanged. This is generally not a preferred embodiment, but can be advantageous if a liquid cooled subcooler, 44, is desired. The advantage of a liquid cooled subcooler, 44, is the ability to extract more heat, especially in hot ambient conditions. However, the refrigerant exiting a liquid cooled subcooler, 44, is sufficiently cold as to restrict or prevent useful heat extraction by the RE, 50, in the previously discussed embodiment of FIG. 8.

The alternate embodiment of FIG. 9, eliminates this limitation; the RE, 50, receives refrigerant directly from the condenser 26, at point 2', which is sufficiently hot to permit good RE, 50, performance, and the water cooled subcooler, 44, has sufficient approach to permit good subcooler performance with refrigerant exiting the RE, 50, at point 3'.

Compressor Desuperheater

Figure 14:
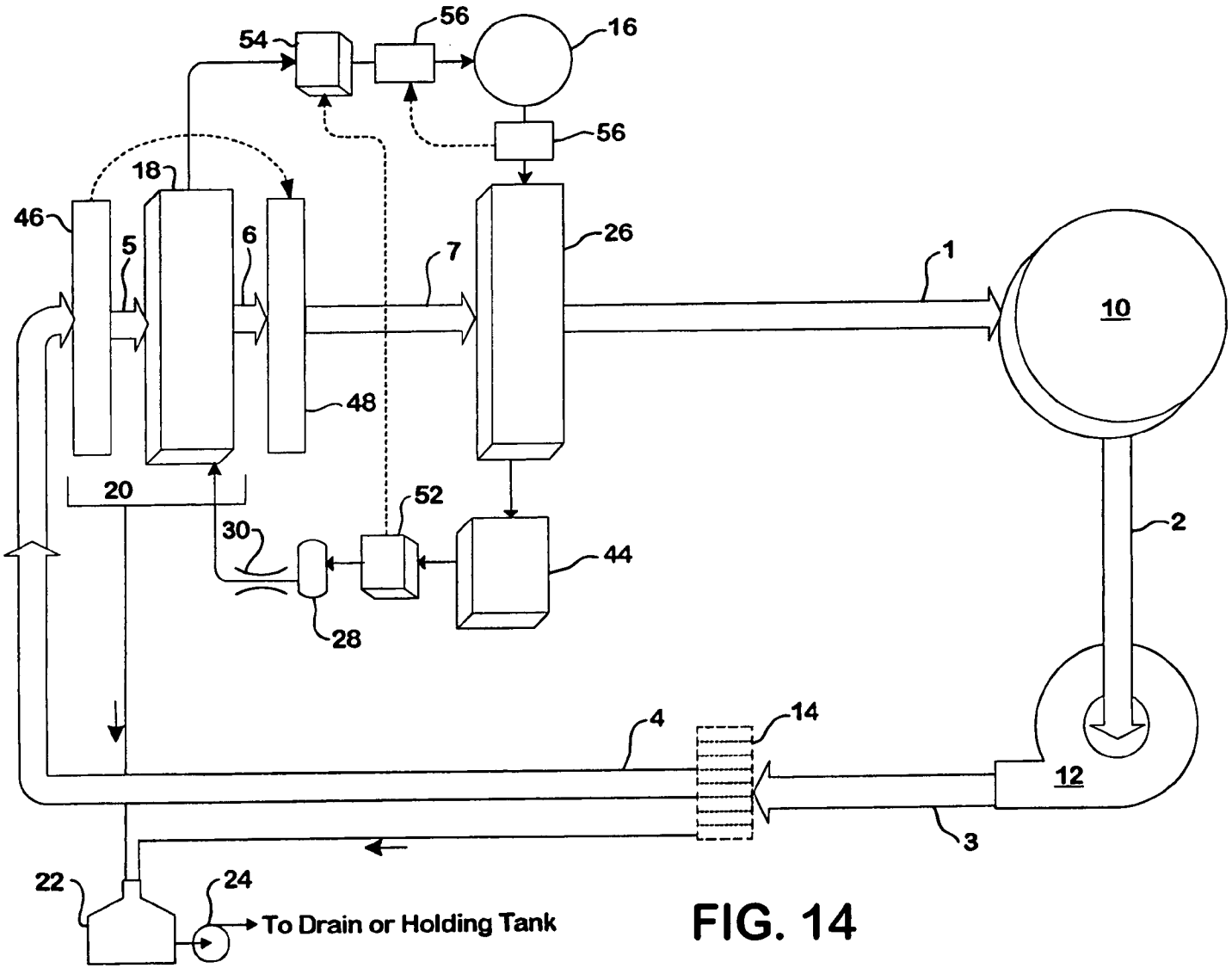
FIG. 14 is a schematic diagram of a dryer with a heat pipe air economizer, a refrigerant subcooler, a refrigerant economizer, and a compressor desuperheater.

A compressor desuperheater, 56 may be used as shown in FIG. 14 to further increase refrigerant mass flow for a given compressor. The increased mass flow may be used toward increased drying rate, or a smaller less expensive compressor, may be used, with no loss in performance.

Low Temperature Drying

Figure 25:
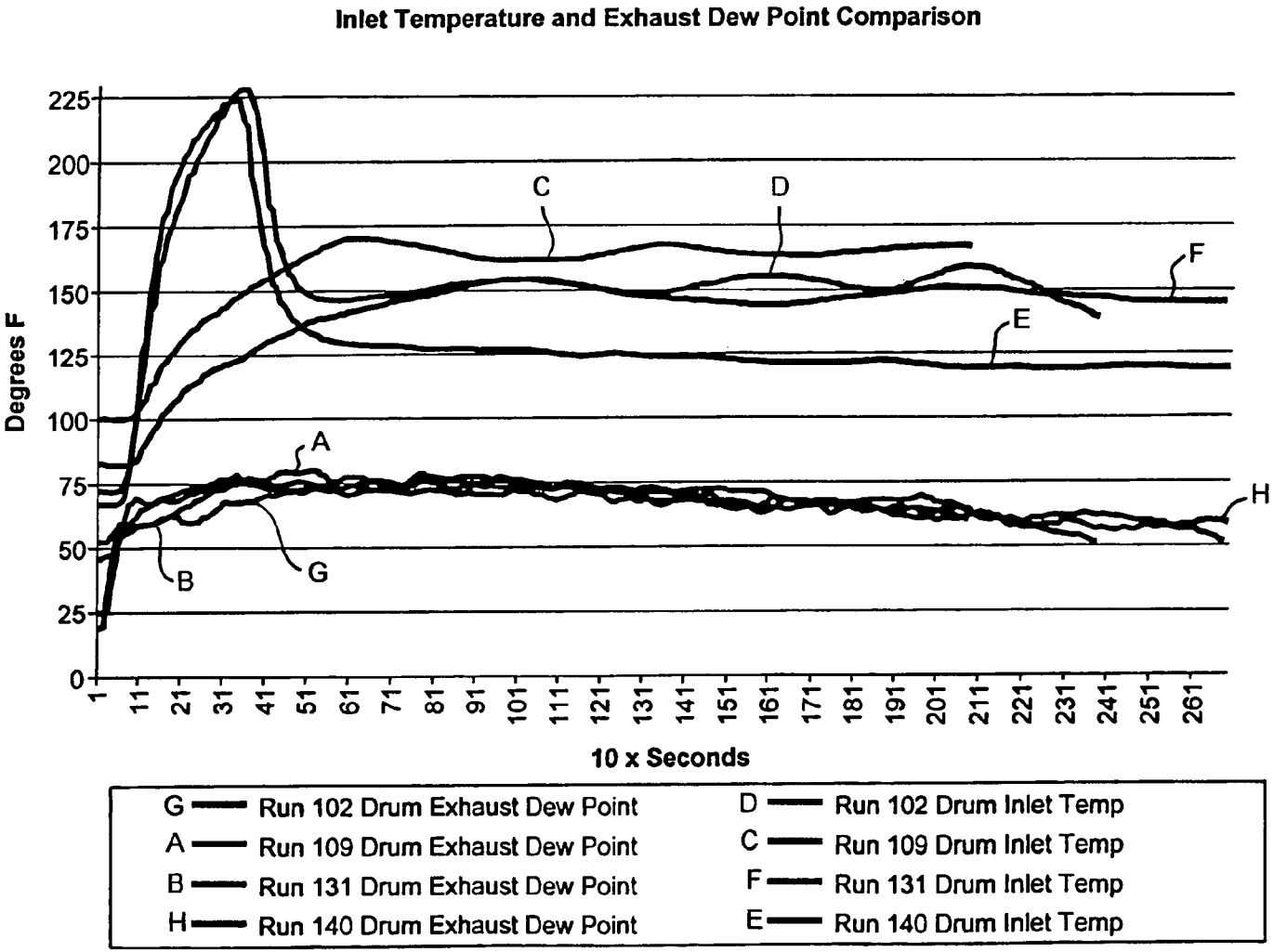
FIG. 25 shows a graph showing the effect of drum inlet air temperature on drum exhaust dew point.

During steady state, increasing the drum inlet temperature does not materially affect the drum exhaust dew point, as shown in the examples of FIG. 25. However, it does increase the drum exhaust dry bulb temperature. This introduces significant sensible heat that must be removed by the wet air heat sink and/or the evaporator, before moisture condensation can commence.

Figure 26:
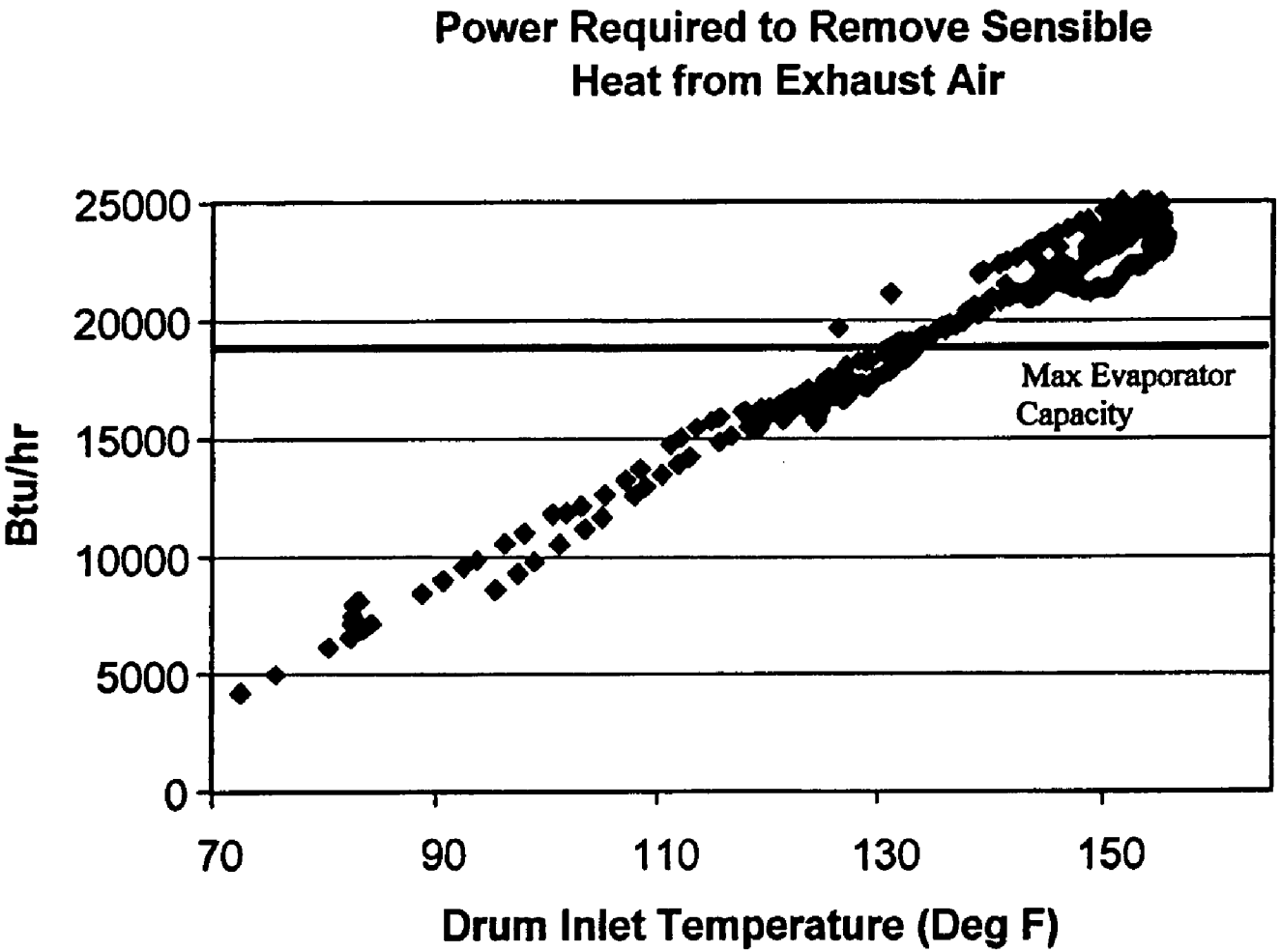
FIG. 26 is a graph showing the effect of drum inlet air temperature on drum exhaust sensible heat.

The sensible heat represents parasitic work that is not used for drying the clothes. As the drum inlet dry bulb temperature rises, the sensible heat rises concurrently. For a given evaporator size, it is possible for the sensible heat to exceed the evaporator cooling capacity, leaving no cooling capacity for condensation of water. An example of this is shown in FIG. 26. It is substantially more efficient to operate with the lowest practical level of sensible heat.

There is a lower limit to this approach. If the drum exhaust temperature is low enough, then condensate may freeze on the evaporator surface. This has compromising effects on air mass flow and heat transfer. During steady state, the preferred configuration employs drum inlet air as dry as practical, and operating temperatures just high enough to prevent freezing.

Low temperature drying reduces or eliminates warmup time, uses less energy, and is gentler to the fabric, with no compromise in performance. This is discussed in more detail in Appendix A: Theoretical Considerations.

Improved Airflow

Horizontal Updraft Fluidized Bed Airflow

Conventional residential dryers generally employ downdraft airflow, or airflow with a prominent downdraft component. Most residential dryers employ a drum inlet high on the rear bulkhead, and a drum exhaust on the front bulkhead, below the door. A small number of residential dryers employ horizontal airflow from back to front, employing a door comprising a downdraft perforated plenum. This design also introduces a significant downdraft component to the airflow. Another design locates both drum inlet and exhaust on opposite sides the rear bulkhead, with the inlet located higher on the bulkhead than the exhaust. No dryers currently employ updraft airflow, or airflow with a significant updraft component.

Downdraft airflow is disadvantageous to tumble drying. It drives the falling fabric downward, reducing critical falling dwell time, and compacting the falling items closer to each other. Fabric is driven forward, as well as downward toward the drum exhaust, causing a tendency to occlude the exhaust vent. These factors compromise performance and efficiency.

Figure 12B:
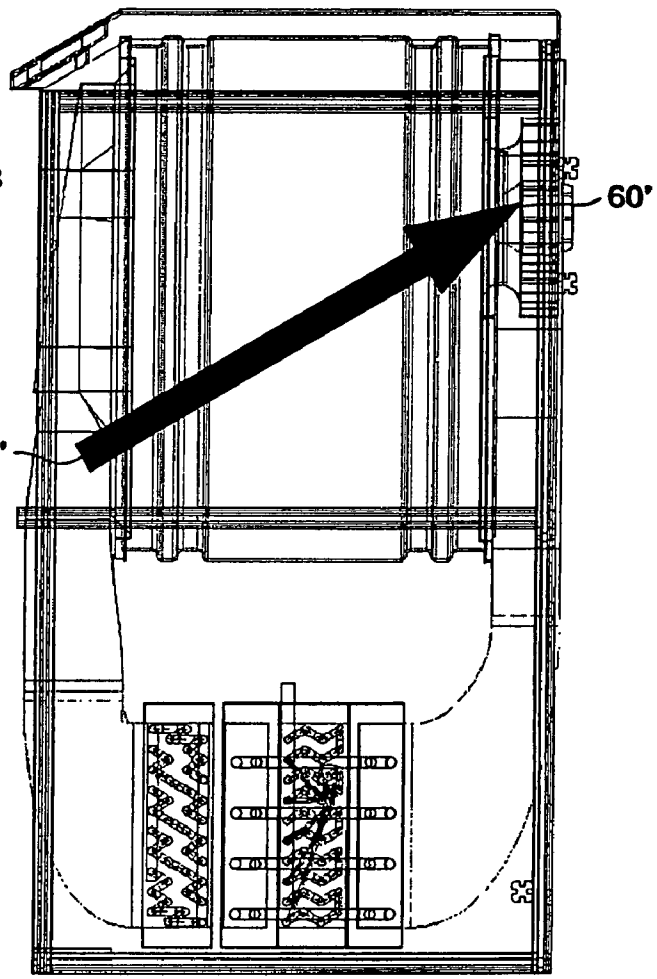
FIG. 12*b* shows a dryer in accordance with the present invention having improved air flow.
Figure 12A:
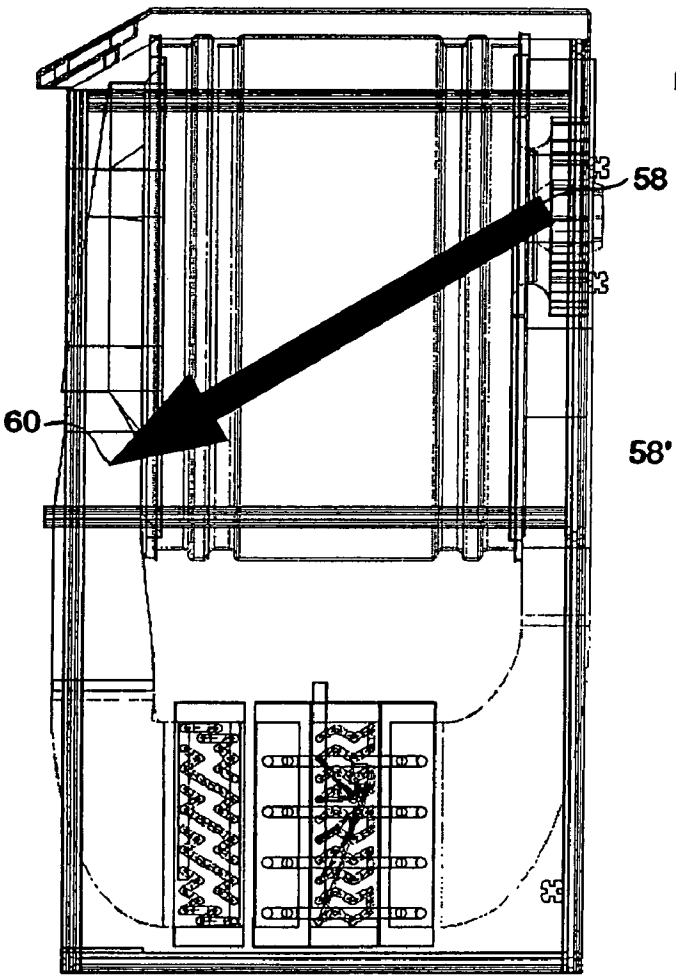
FIG. 12*a* shows a dryer with a conventional air flow.

An alternate airflow path may be advantageously applied, as shown in FIG. 12. Typical conventional airflow is shown in FIG. 12A. Air enters the drum near the top, at the rear, at point 58, and travels forward and downward, exiting under the door, at point 60. FIG. 12B illustrates improved airflow, in which air enters the drum under the door, at point 58', and exits near the top of the rear bulkhead, at point 60'.

In this embodiment, the updraft component of the airflow tends to fluidize the bed; falling fabric items are falling against the airflow rather than with it, and fall more slowly, extending critical dwell time. Falling items tend to fluff and separate rather than aggregate, and exposure to drying air is substantially enhanced. The effects of the horizontal component of the airflow are substantially mitigated. Fabric items do not bunch up at the bottom front or rear of the drum, and do not occlude the drum exhaust. This embodiment provides improved moisture extraction and drying performance.

An alternative embodiment, comprises a drum inlet on the rear bulkhead, situated near or at the bottom, and a front drum exhaust. The door may be constructed as a plenum, with the front drum exhaust at or near the top of the door, or alternatively, the drum exhaust may be in the front bulkhead, above the door. These embodiments present the same advantageous updraft airflow, with the added benefit of more accessible lint filter location.

If the drum exhaust is in the door, the lint filter may also be located in the door, preferably near the top, to be reached easily for removal. The filter assembly may be configured for access from inside the door, from the top of the door, or from the outside of the door, as desired. If the drum exhaust is in the bulkhead above the door, the filter assembly may be configured for easy access from the front of the dryer, above the door, or from the top of the dryer, at the front, as desired.

Vertical Updraft Fluidized Bed Airflow

Conventional commercial and industrial dryers generally employ vertical downdraft airflow. This is believed to be a safety requirement commensurate with the use of large electric or gas fired heaters for heating the drying air. Placing a large heater or burner directly under a load of fabric is not intrinsically safe. Consequently, the heater is generally located above the drum, and vertical downdraft air is employed. This approach is disadvantageous; it drives the falling clothes down toward the bottom of the drum, compacting the falling items and substantially reducing dwell time. The exhaust draft pulls the fabric to the bottom of the drum, substantially occluding the drum exhaust.

Figure 13A:
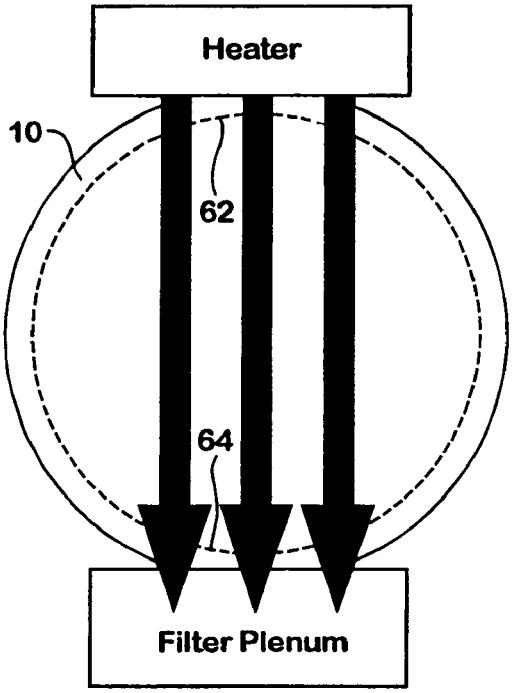
FIG. 13*a* shows a dryer with a conventional air flow.
Figure 13B:
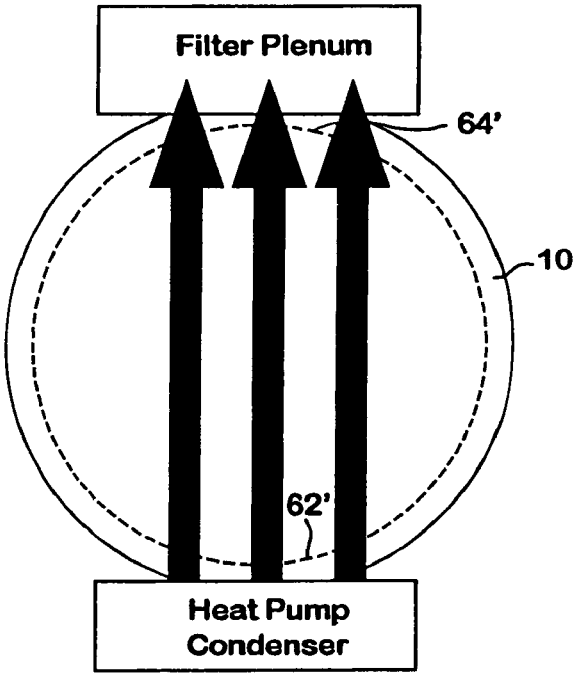
FIG. 13*b* shows a dryer with improved air flow.

The heat pump dryer does not present the intrinsic fire hazard of electric and gas fired units, and is well suited to vertical updraft airflow. An example embodiment that may be advantageously applied is shown in FIG. 13. As shown in FIG. 13A, in conventional dryers, air enters the drum from the top, at point 62, and travels vertically downward, exiting through the bottom of the drum at point 64. In the improved embodiment, shown in FIG. 13B, air enters from the bottom of the drum, at point 62', and travels vertically, exiting through the top of the drum, at point 64'.

This embodiment presents substantially improved tumbling action; longer falling dwell time, and improved separation of the fabric items, with commensurate improved exposure to drying air. Drum exhaust occlusion is eliminated, and drying airflow is substantially enhanced. Moisture extraction and drying performance may be substantially improved with this embodiment.

Nonconvective Heating

During steady state convective drying, used by all conventional tumble dryers, and by heat pump dryer embodiments previously discussed in this document, the overall core fabric temperature will not exceed the wet bulb temperature of the air in the drum. This phenomenon is not affected by the dry bulb temperature of the air entering the drum, as discussed in the above section, Low Temperature Drying.

Nonconvective heat sources do not suffer this limitation, and present effective and novel methods for enhancing dryer performance. These methods are capable of achieving fabric temperature and drum exhaust dew point substantially higher than convective heating, thus reducing warmup time, increasing drying rate, and improving efficiency.

Electric Nonconvective Heating

In one embodiment, radiant heat means may be placed so as to directly heat the fabric, for example in the door, facing rearward toward the drum interior. This approach is effective, but consumes additional energy. An alternate approach employs electric resistance heaters attached to a portion of the drum wall, also effective, but also consumes additional energy. This latter approach also introduces the need for rotating electrical connections, or a stationary drum, as discussed in the next section of this document.

Heat Pump Nonconvective Heating

Figure 10:
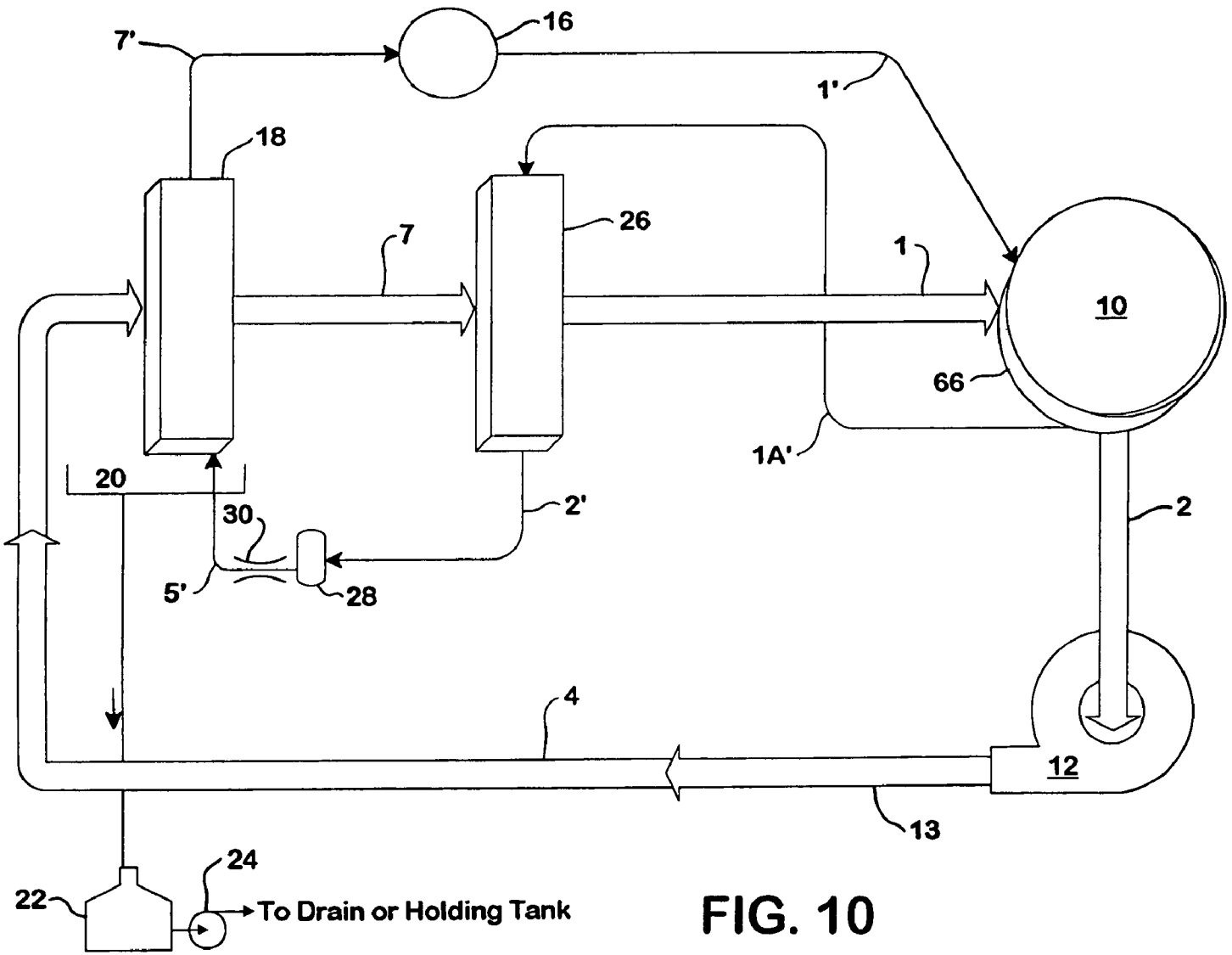
FIG. 10 is a schematic diagram of a dryer with a conduction drying heat source.

In a preferred embodiment, conductive heating means are implemented, as shown in FIG. 10, comprising a heated drum wall, 66, that directly heats the fabric via conduction. The drum wall, 66, includes a refrigerant heat exchanger, of any suitable construction, over a suitable portion of its circumference.

At any given time during normal tumbling, a portion of the fabric items are falling, a portion are being lifted by the drum vanes, and a portion of the items are resting in a dense pile at the bottom of the drum. In the preferred embodiment, the portion of the drum circumference that is heated corresponds with the portion of the drum circumference that is occupied by fallen fabric during tumbling. This is typically the bottom third of the drum circumference.

In one embodiment, serpentine tubing may be bonded to the heated portion of the drum wall, 66, by welding, soldering, or other suitable means. Alternatively, the heated portion of drum wall, 66, may include integrated flow channels, of the type commonly used in small refrigerator evaporators. The drum wall exterior is preferably insulated to minimize heat loss.

In operation, high pressure superheated refrigerant exits the compressor, 16, at point 1', and enters the drum wall, 66, heating the drum wall, 66, and conducting heat to the fabric resting on the bottom of the drum. The fabric temperature is thus raised above the wet bulb temperature of the surrounding air, substantially increasing the moisture extraction rate.

In the preferred embodiment, the drum wall heat exchanger, 66, substantially desuperheats the refrigerant, but does not condense it. This permits simpler, less expensive, drum wall design, and provides ample heat for substantially increased drying rate. The nearly saturated refrigerant then exits the drum wall, 66, at point 1A' and enters the condenser, 16.

The remaining portion of the refrigerant cycle is effectively similar to previously discussed embodiments, except that the heating capacity of condenser, 16, is reduced by the heating capacity of drum wall, 66. This is not a disadvantage, as the total heat applied to the drum is the sum of the heat supplied by the condenser, 16, and the drum wall, 66.

In this embodiment, the drying air entering the drum, 10, at point 1, is slightly cooler than in embodiments not using heated drum wall, 66. This air functions primarily as a carrier to remove extracted moisture from the drum, and need only be hotter than the wet bulb temperature exiting the drum, nominally equivalent to the surface temperature of the fabric. Performance using heated drum wall, 66, will be substantially improved over convection heated embodiments.

If the refrigerant economizer, 50, is used with the heated drum wall, the resulting increase in compressor discharge superheat will increase the available heat at the drum wall, further increasing the moisture extraction rate in the drum.

Rotating Drum

In a variation of this embodiment, the entire rotating drum circumference may be heated, and preferably with insulated exterior. Refrigerant may be coupled to the drum wall heat exchanger through rotating fittings. Alternatively, electric drum wall heat may be similarly implemented with electric heaters on the drum wall, and slip rings for the electrical connections.

Stationary Drum, Rotating Vane Cage

The fundamental purpose of drum rotation is to tumble the fabric being dried. Tumbling is an essential and integral function of forced convection drying. Tumbling fluidizes the bed, and circulates the fabric items. The fabric is exposed to drying air primarily while it is falling.

The drum wall itself does not contribute materially to tumbling; this is the function of the lifting vanes, which are attached to the drum wall. As the drum and vanes rotate, when the vanes are below the horizontal centerline of the drum, their incident angle is upward, and they catch fabric items and lift them. When the vanes are sufficiently above the horizontal center line that their incident angle is downward, the fabric items slip off, and fall toward the bottom of the drum.

This occurs near, but not at, top dead center. The rotational velocity imparted to the fabric by the vanes, causes the fabric to fall in a slight arc, such that it tends to fall primarily through the vertical centerline of the drum. If the drum did not have vanes, the fabric would slip along the drum wall without significant lifting, and tumbling effect would be reduced to negligibility.

To facilitate a heated drum wall in a practical manufacturable manner, it is advantageous to couple the heat exchanger (HX) means to the refrigerant piping circuit, without rotating slip joints or the like. In a novel preferred embodiment, the drum does not rotate. This permits simple and low cost serpentine tubing or other suitable HX means to be attached directly to the drum wall, and coupled to the refrigerant piping by conventional means, known in the HVAC industry, such as soldering, brazing, or the like. Alternatively, the heated portion of drum wall may include integrated flow channels, commonly used in small refrigerator evaporators.

In a preferred embodiment, shown in FIGS. 16-19, tumbling is accomplished by independently rotating a group of vanes 68, inside a stationary drum, 70. These vanes, 68, are preferably supported by annular rings, 72 at the front, and 74 at the rear, of the drum, 70. The rings and vanes together form a cage that fits snugly inside the drum and is rotated by a suitable driving means, such as an electric motor.

The inside diameter of the front ring, 72, is large enough to provide access clearance for loading and unloading the laundry, with suitable door means. The front ring, 72, may be supported by rollers, 76, in FIG. 18, which bear on the inside surface of the stationary drum, 70. The rear ring, 74, may be formed as a perforated disk to facilitate supporting with an axle shaft. In the latter perforated embodiment, the perforations permit drying air to pass through the disk.

Figure 19:
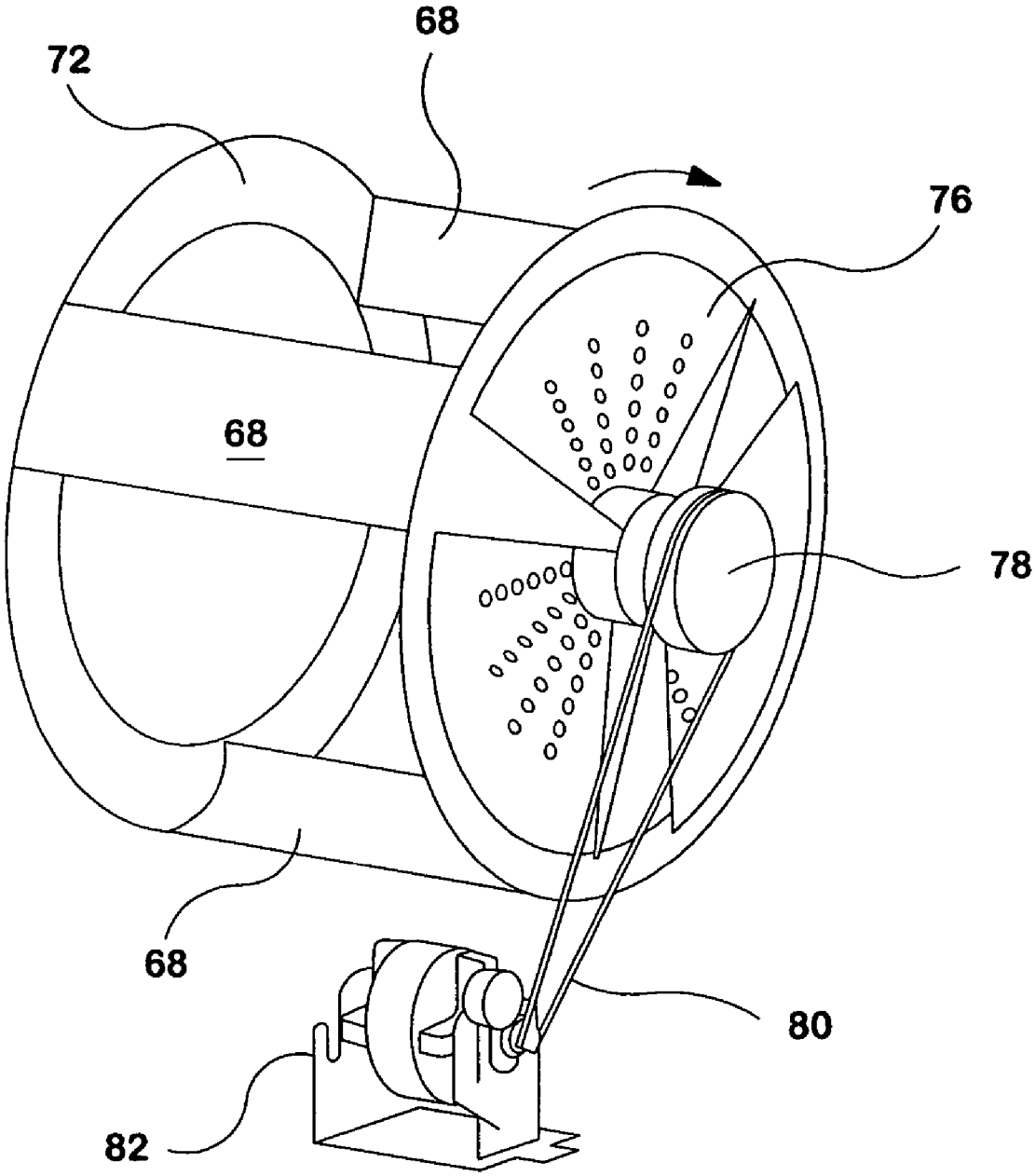
FIG. 19 is a rear view of a drum showing an internal rotating vane assembly.

The axle shaft, not shown, passes through the rear wall of the stationary drum, and may be attached to a suitable drive pulley or sprocket, 78, as shown in FIG. 19. Pulley or sprocket 78, may be coupled via belt or chain, 80, to a drive motor, 82. The shaft is preferably supported by suitable bearing means in the rear drum wall. A suitable shaft seal is preferably provided at the bearing location to prevent air leakage.

In a variation of this embodiment, one or both rings, 72 & 74, fit snugly inside the drum, and may be fabricated from or covered with a low friction material, such as UHMW polyethylene or Teflon, such as is currently used in the supporting drum glides in many conventional residential dryers. Alternatively, the low friction material may be applied to the inside surface of the drum, along the glide path of the rings.

In another alternate embodiment, the vane cage may fully be cantilevered to the rear axle shaft, eliminating the need for rollers, 76, or glides at the front.

These embodiments have the added advantage of eliminating drum rim seals. No moving seal is required at the front of the drum, which is effectively sealed by the door gasket; the rear requires only a simple conventional shaft seal.

Figure 21:
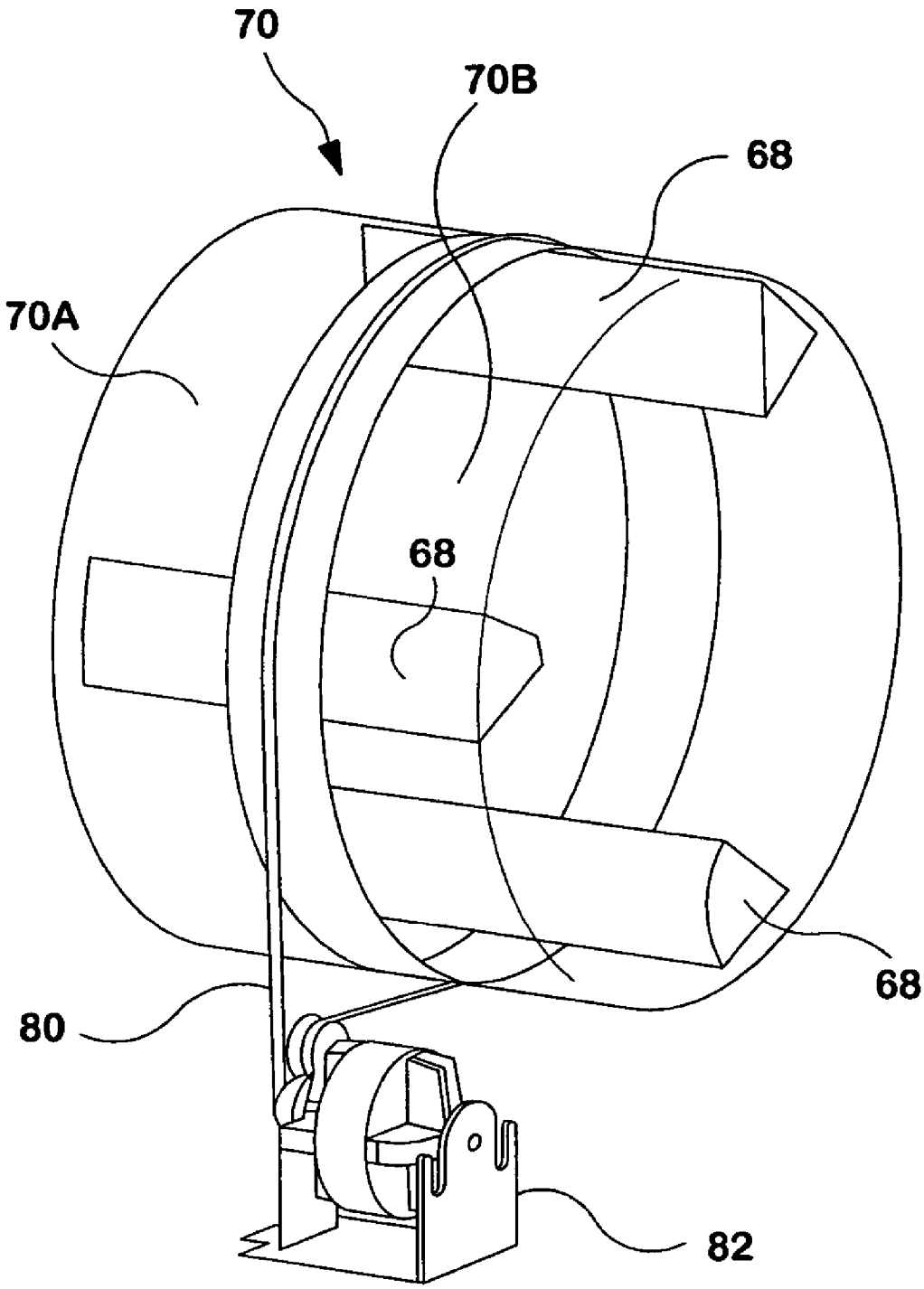
FIG. 21 illustrates a drum with a support ring configuration and internal rotating vane assembly.
Figure 22:
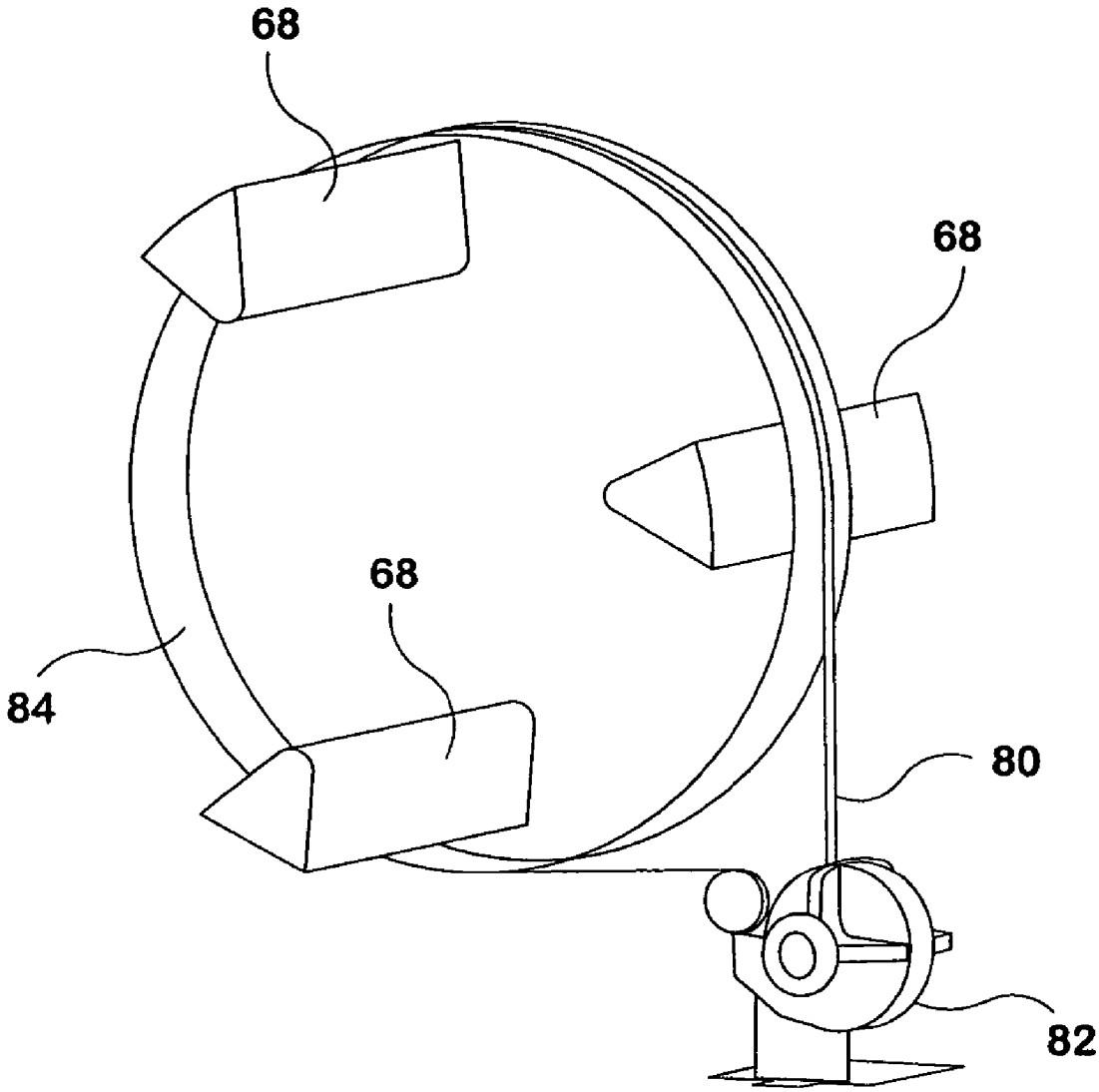
FIG. 22 illustrates a center support ring configuration and an internal rotating vane assembly used therein.

In an alternate embodiment, shown in FIGS. 21 & 22, the stationary drum, 70, is comprised of two half shells, 70A & 70B, with a slot around the centerline. The front half shell preferably includes an opening on its end wall (not shown) for loading and unloading laundry, with suitable door means. A single ring, 84, fits between the drum shells, 70A & 70B, and supports each vane, 68, at its center. The ring, 84, may be primarily inside the drum as shown in FIG. 21, primarily outside the drum, or may be double layered, bearing on both the inside and outside surfaces of the drum, with integral edge grooves, in which the open ends of each drum shell ride.

At least a portion of ring, 68, is preferably exposed through the slot between the drum half shells, 70A & 70B, and a drive belt, 80, may be wrapped around it to provide rotation, with suitable driving means, such as an electric motor, 82. The ring, 84, may include supporting rollers or bearing balls, riding inside and/or outside the drum wall. Alternatively, the ring, 84, may include glide strips or bands of Teflon or UHMW polyethylene, or other suitable low friction bearing material, such as is used to support the drum in many conventional residential dryers.

Suitable sealing means, such as the drum sealing method discussed in the Drum Sealing section of this document, are preferably provided at the interfaces between the ring, 84, and the drum shells, 70A, & 70B.

The vanes, 68, are preferably tapered, thick at the root, and thin at the distal edges, and forward curved where they contact the drum wall. The vanes or the leading edges are preferably made from a flexible, low friction material, such as UHMW polyethylene, Teflon, or other suitable material, and may include suitable internal structural means as needed.

The vanes, 68, preferably have sufficient resilience and travel at their leading edges to maintain contact with the drum wall, and absorb drum shape tolerance and runout, such as that commonly found in consumer grade dryers. As the vane cage rotates, the vanes, 68, travel under the fabric items at the bottom of the drum, and lift them to the top or nearly to the top, where they are permitted to fall, thus facilitating tumbling action in the stationary drum, 70.

Figure 20:
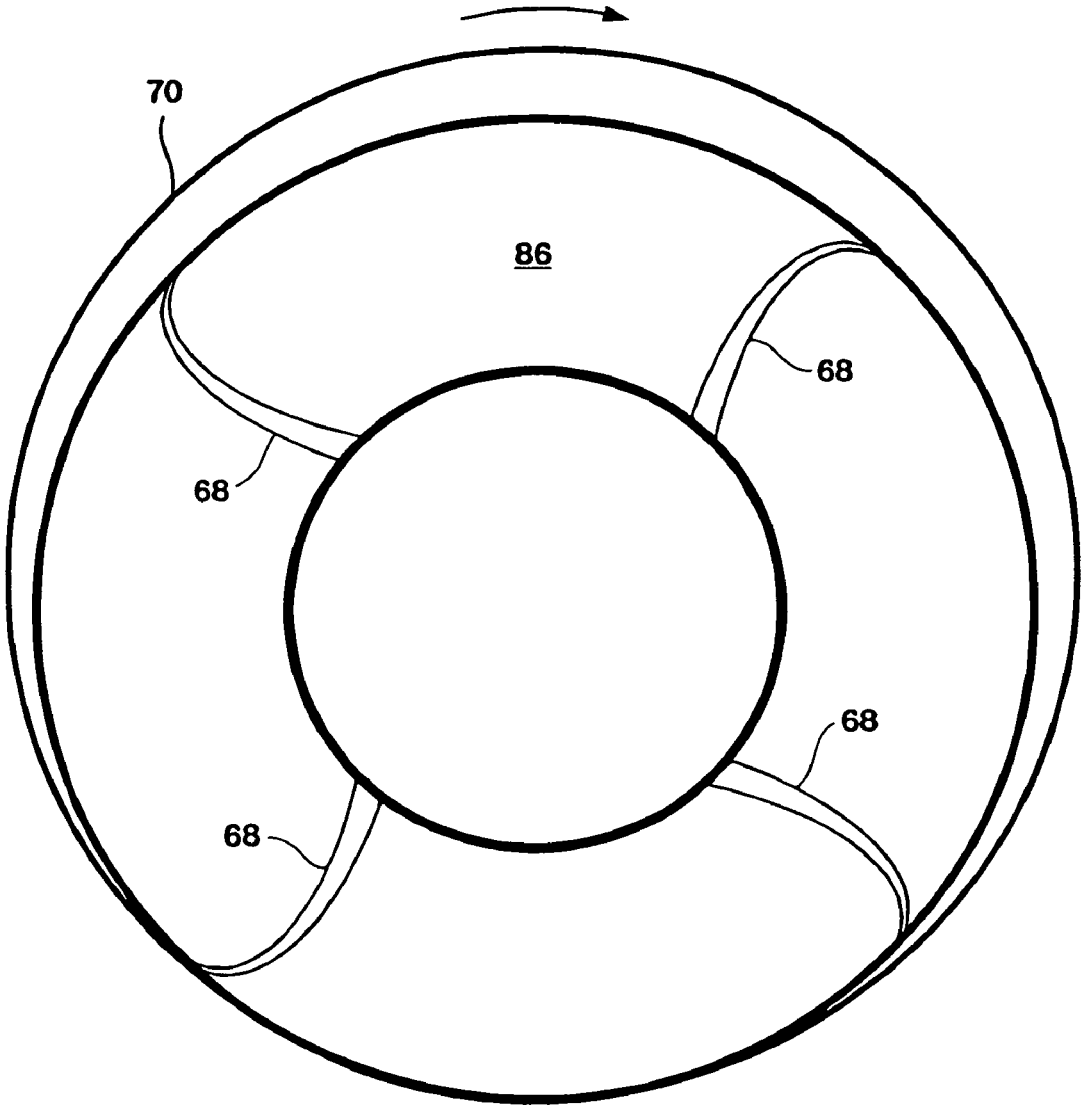
FIG. 20 illustrates an internal rotating vane assembly.

Although unlikely, it is conceivable that an article of clothing may become caught between the drum wall and a vane, 68. To address this, the vane cage assembly may be of slightly smaller diameter than the drum. In this embodiment, the vane cage is positioned slightly below the axial center of the drum, such that vanes contact the drum wall firmly at the bottom, and begin to separate from the drum wall as they approach the top of the drum. FIG. 20 illustrates the preferred swept volume, 86, of the rotating vanes.

As the vanes 68 approach the top of the drum 70, they separate from the drum wall freeing any clothing caught between the wall and a vane, 68, and permitting it to drop to the bottom. In the preferred embodiment, the maximum clearance between the vanes, 68, and the drum wall is approximately ¼" to 1" at the top of the drum 70.

An alternate embodiment comprises electric heat means or refrigerant heat exchanger means on the rear and/or front drum bulkheads, which are typically stationary in residential dryers. This is less effective than heating the bottom of the drum circumference, but may be less expensive to manufacture.

In a more effective variation of a heated bulkhead embodiment, the rear bulkhead may be heated, and the drum tilted back, for example 30°~45° from horizontal, thus improving overall contact between the laundry and the heated rear bulkhead.

Stationary Drum, Commercial Dryers

Large conventional commercial dryers, typically with capacities of 50 pounds or more, employ vertical airflow. These dryers have a stationary drum in which an inner basket rotates. The inner basket is perforated over its entire cylinder wall. The lifter vanes are attached to the inner basket. The outer drum includes an opening at the top and bottom, each of which generally extends from front to back. These openings are sufficiently wide to permit adequate airflow, typically 10%~15% of the drum circumference. Heated air typically enters the top opening, passes through the perforated rotating inner basket, and wet air exits through the bottom opening.

Figure 29:
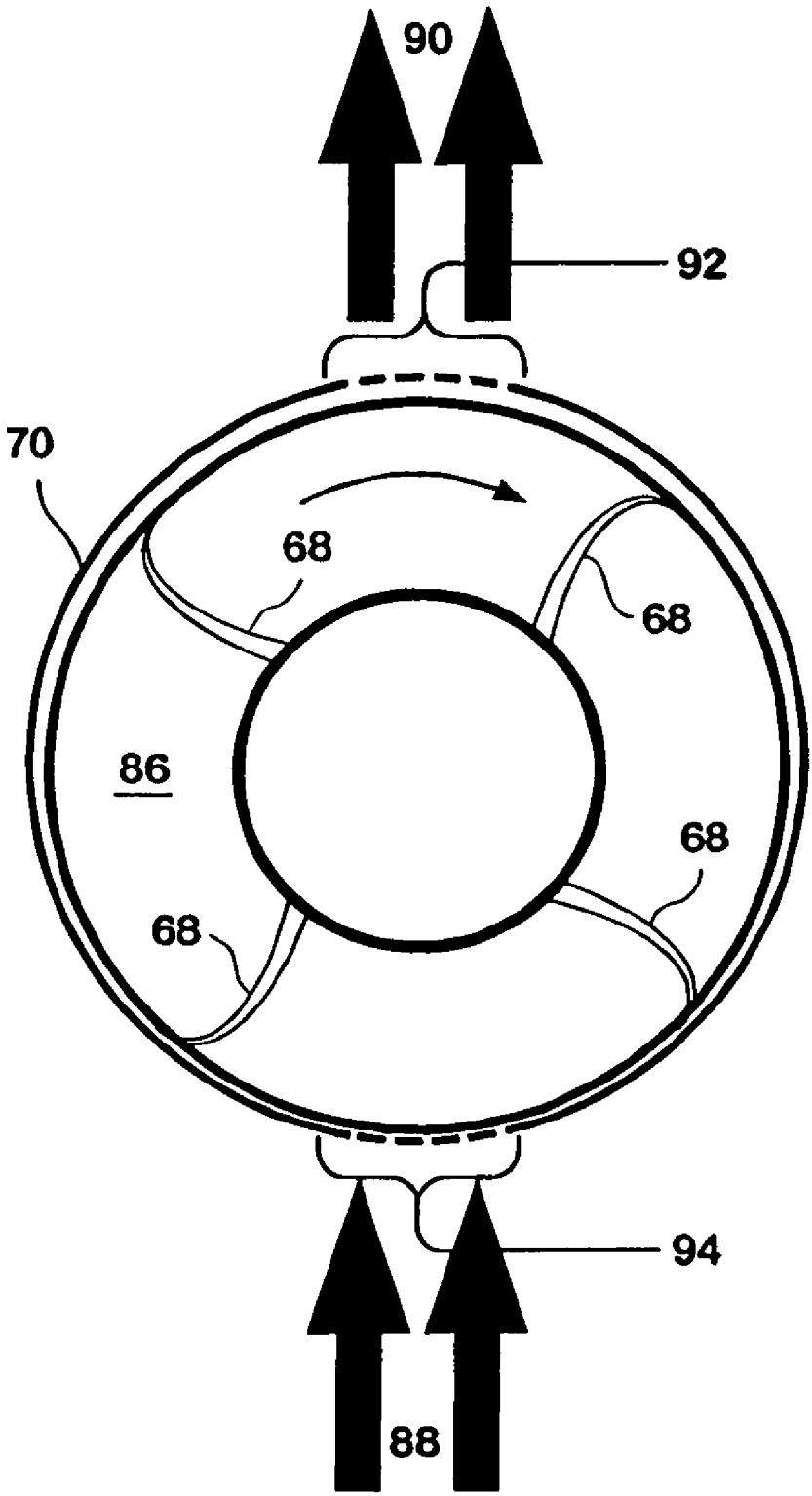
FIG. 29 illustrates a drum having a rotating vane assembly and a vertical updraft.
Figure 30:
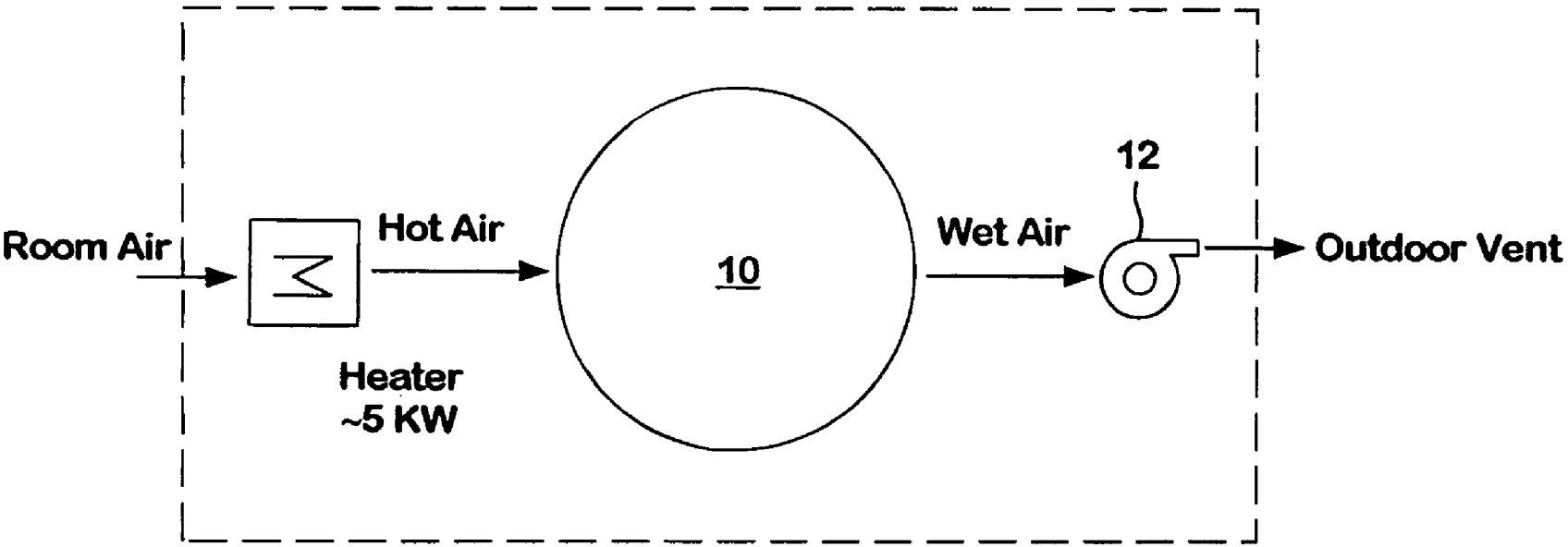
FIG. 30 (PRIOR ART)
FIG. 30 shows a conventional clothes dryer.

To facilitate a heated drum wall in this type of dryer, the inner perforated basket may be eliminated, and a vane cage, similar to that discussed in the previous section, may be used. An schematic example of this is shown in FIG. 29, which also illustrates preferred updraft airflow. In the preferred updraft embodiment, heated air, 88, enters the bottom opening and wet air, 90, exits through the top opening.

To support the heavy loads encountered in commercial dryers, the vane cage is preferably of high structural strength and stiffness. The rear ring may be formed as a solid disk, and the front ring may be formed as a ring with a large inside diameter to accommodate the door. This will provide good structural integrity, and permit unimpeded vertical airflow.

As the vanes, 68, are in resilient contact with the drum wall, they may undesirably expand into the top, 92, and/or bottom, 94, airflow openings in the stationary drum, and become lodged against the far edge of each opening. To prevent this, and to prevent the laundry from entering the airflow openings, the stationary drum wall may be formed of an effectively contiguous material, such as sheet metal, and perforated in the area of each airflow opening, 92 & 94, preferably at the top and bottom of the drum 70. Laundry and vanes can pass cleanly over the perforated area.

Heated Drum Cool Down

The heat pump dryer generally does not require a cool down period; the fabric is generally cool enough to handle at the end of a drying cycle, when the dryer is operating in the preferred low temperature range. However, conduction heating sources, e.g., heated drum wall means, preferably operate at temperatures exceeding 140° F., and cool down means are preferred for safe and comfortable unloading and reloading of the dryer without a lengthy cool down period.

In a simple embodiment, the cool down cycle is a control function. At the end of the drying cycle, the control means may open the TEV, 30, permitting high pressure refrigerant to rapidly expand and cool. This will effectively cool the accessible surfaces of the drum wall to a safe temperature.

In situations where time is critical, such as commercial operations, a more rapid cool down may be advantageously achieved with an alternate embodiment. This embodiment includes valve means, preferably of the electric solenoid type, such as those used in reversible residential HVAC heat pumps.

When the drying cycle ends, valve means are activated, preferably by control, 32, redirecting the flow of refrigerant. In the redirected mode, low pressure refrigerant enters the drum wall from the TEV, 30, and the drum wall effectively becomes the evaporator. During this mode, the main blower may be shut down, effectively cutting off the condenser, and permitting the subcooler to condense refrigerant, removing heat from the system.

This embodiment effectively chills the drum wall, providing very rapid cool down. This mode will generally be needed for a very short time at the end of each drying cycle. When the dryer is sufficiently cooled, the system may be shut down, and the diverter valve returned to normal mode.

Another alternate embodiment includes valve means to configure both the condenser and the drum wall to act as evaporators, cooling both the drum wall, and the airstream, thus removing heat from the dryer and the fabric via the subcooler. In this embodiment, during cool down mode, the heat released via the subcooler equals the heat removed plus the power consumption. To accommodate this, the compressor may be operated at reduced capacity, via speed control, or the like.

Alternatively, the subcooler capacity may be larger than necessary for normal drying, and modulated as necessary to control drying temperature, by means discussed in the System Controls section of this document. In cool down mode, the subcooler may then be operated at full capacity, sufficient to remove the heat equal to the power consumption, as well as cool the drum and fabric.

Drum Sealing

Drum sealing is an important aspect of heat pump dryer design. Minor air leaks around the drum, generally unimportant in conventional dryers, can materially degrade heat pump dryer performance. Room air leaking into the drum can reduce the drying air temperature and raise the humidity, compromising moisture extraction. Air leaking from the drum into the surrounding room can cause excessive heat loss, and undesirably raise room humidity.

Figure 23B:
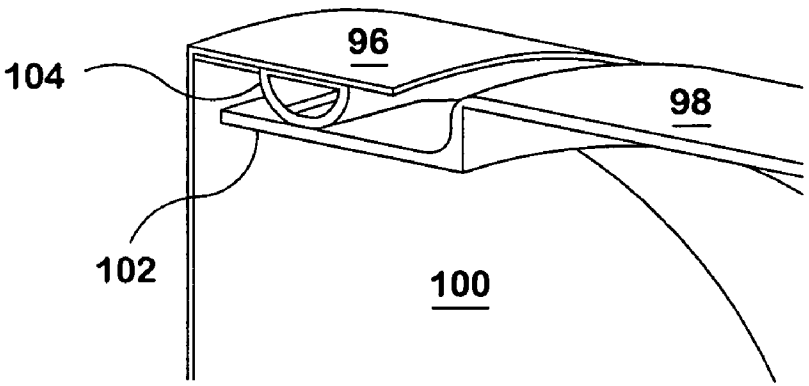
FIGS. 23*a* and 23*b* show a cutaway view of a drum seal.
Figure 23A:
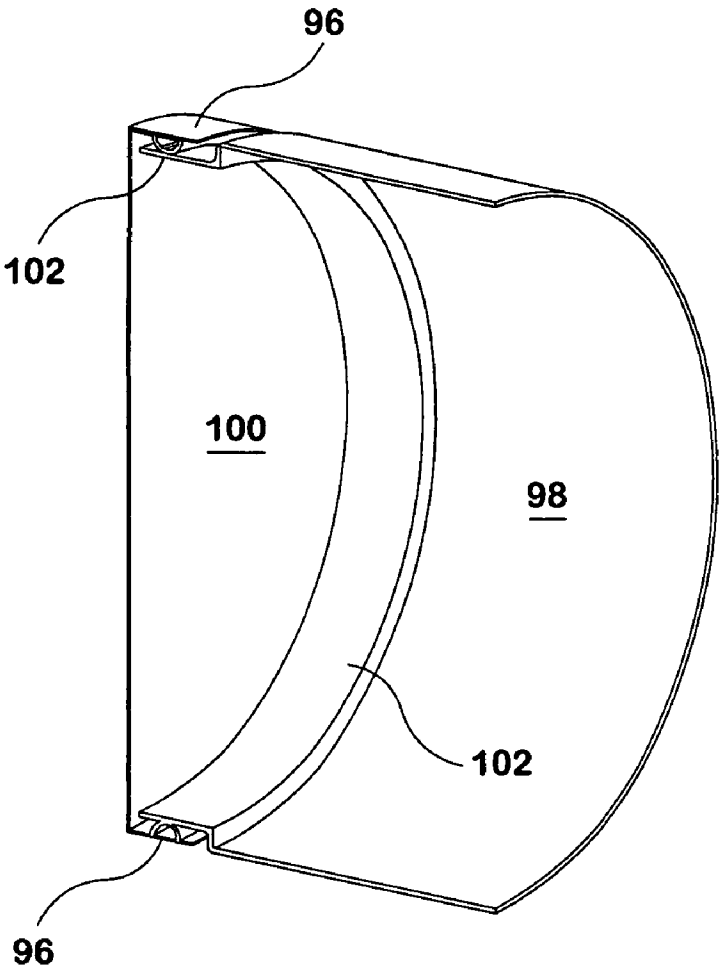
Figure 24B:
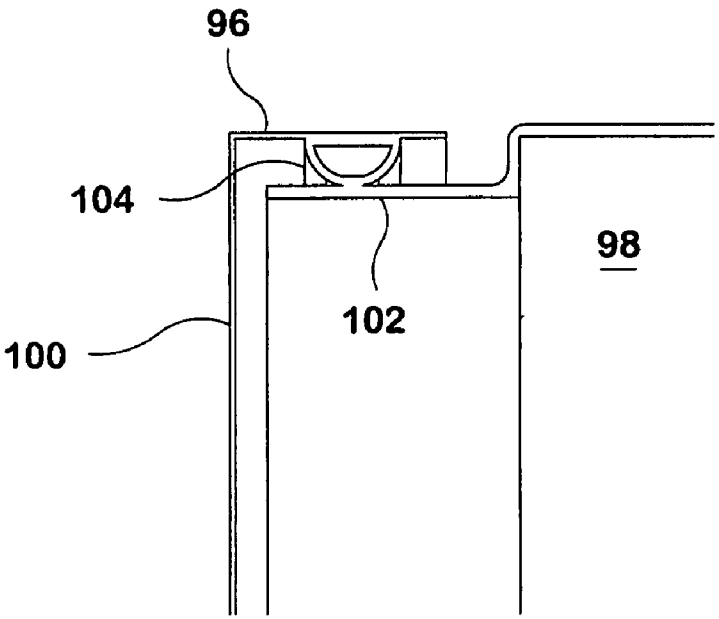
FIGS. 24*a* and 24*b* show a drum seal cross-section.
Figure 24A:
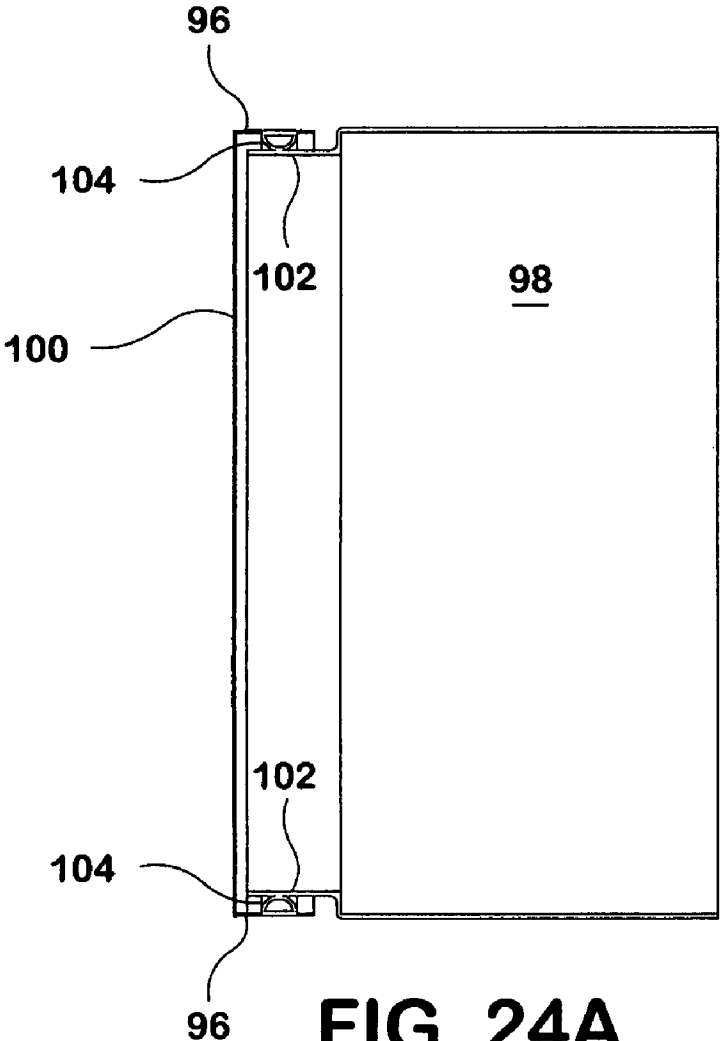

A preferred embodiment for typical residential heat pump dryers, with rotating drums and stationary bulkheads, is shown in FIGS. 23 and 24. This embodiment comprises integral flanges, 96, incorporated in the front and rear bulkheads, parallel with the drum wall, 98. Only rear bulkhead, 100, is shown. Drum wall, 98, includes a sealing area, 102, front and rear, which may be of the same diameter as the drum, or may be stepped to a slightly smaller diameter than the drum, as shown.

An elastomeric seal member, 104, is preferably interposed between the flange, 96, and the drum wall seal area, 102. Seal member, 104, is of a 'D' cross section or other suitable profile, with sufficient resilience and travel to absorb drum shape tolerance and runout, commonly found in consumer grade dryers, while maintaining good sealing contact with the drum wall sealing area, 102.

Seal member, 104, is preferably bonded to flange, 96, with double faced tape, self adhesive backing, or other suitable means, and drum wall sealing area, 102, is then the sliding seal surface. In the preferred embodiment, the seal assembly is not weight bearing, and the drum is rotationally supported by separate means. Reduced friction means, such as Teflon or UHMW polyethylene tape, may be bonded to the drum wall sealing area, 102, along the contact line of the sealing member, 104, to reduce rotational drag.

Alternatively, seal member 104, may be bonded to drum sealing area, 102, with 'D' profile facing outwards, in orientation opposite that shown, and flange, 96, is then the sliding sealing surface. Reduced friction means may be bonded to flange, 96, to reduce drag. A single sealing member, 104, or a plurality of sealing members may be used, as desired.

In an alternate embodiment, not shown, flange 96, may be eliminated, and drum wall sealing area may be folded inward, 90° to drum wall, 98, and parallel with bulkhead, 100, forming an inner flange on drum wall, 98. Sealing member 104, may then be bonded to the drum wall sealing area, or to the mating portion of the bulkhead, 100, forming a face seal.

The location of blower, 12, is generally not critical, however it is preferably located at the drum exhaust, to induce slight negative air pressure in the drum, preventing any moisture or heat from escaping into the room.

System Controls

Control, 32, shown in FIGS. 1-4, serves several functions. In the most basic embodiment, the control, 32, may comprise a simple timer, preferably electronic, that starts the system and stops it after a preselected running time elapses. It preferably performs startup sequentially, to minimize electrical surge loads and to establish drum rotation and airflow before starting the compressor, 16.

In the preferred sequence, the control, 32, first starts the blower, 12, then starts the drum, 10, rotation, and then starts the compressor, 16. The time between these events is preferably sufficient for the blower to reach full speed before starting the compressor, e.g., 1-2 seconds, however any desirable delay may be employed. In another alternate embodiment, the drum, 10, and blower, 12, may be driven by the same motor. Additional functionality of control, 32, may include temperature and/or humidity control, safety limits, cycle selection, and the like.

Figure 38:
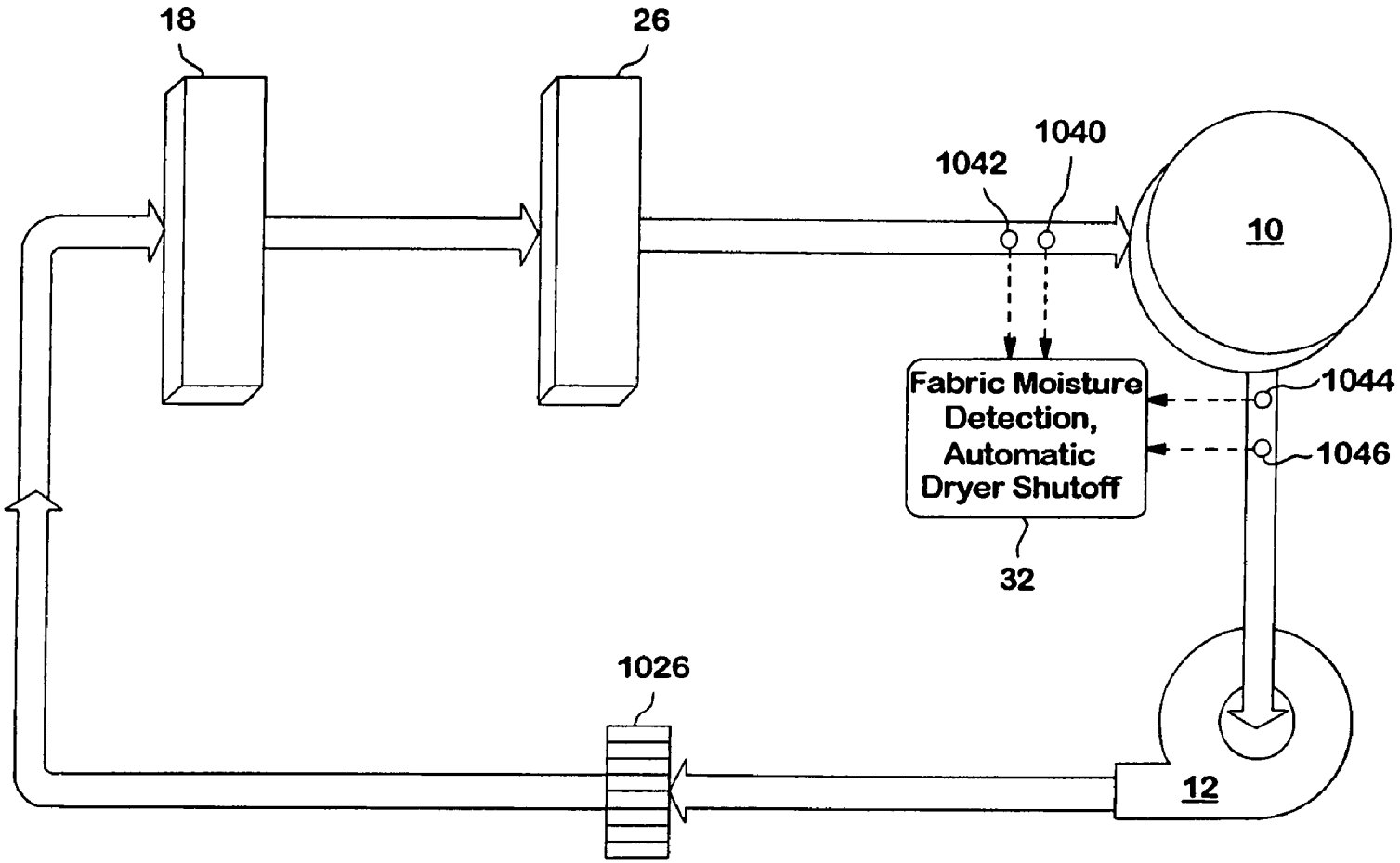
FIG. 38 is a schematic diagram of a heat pump dryer in accordance with the present invention having fabric moisture detection and an automatic shutoff.
Figures 40, 41, 42:
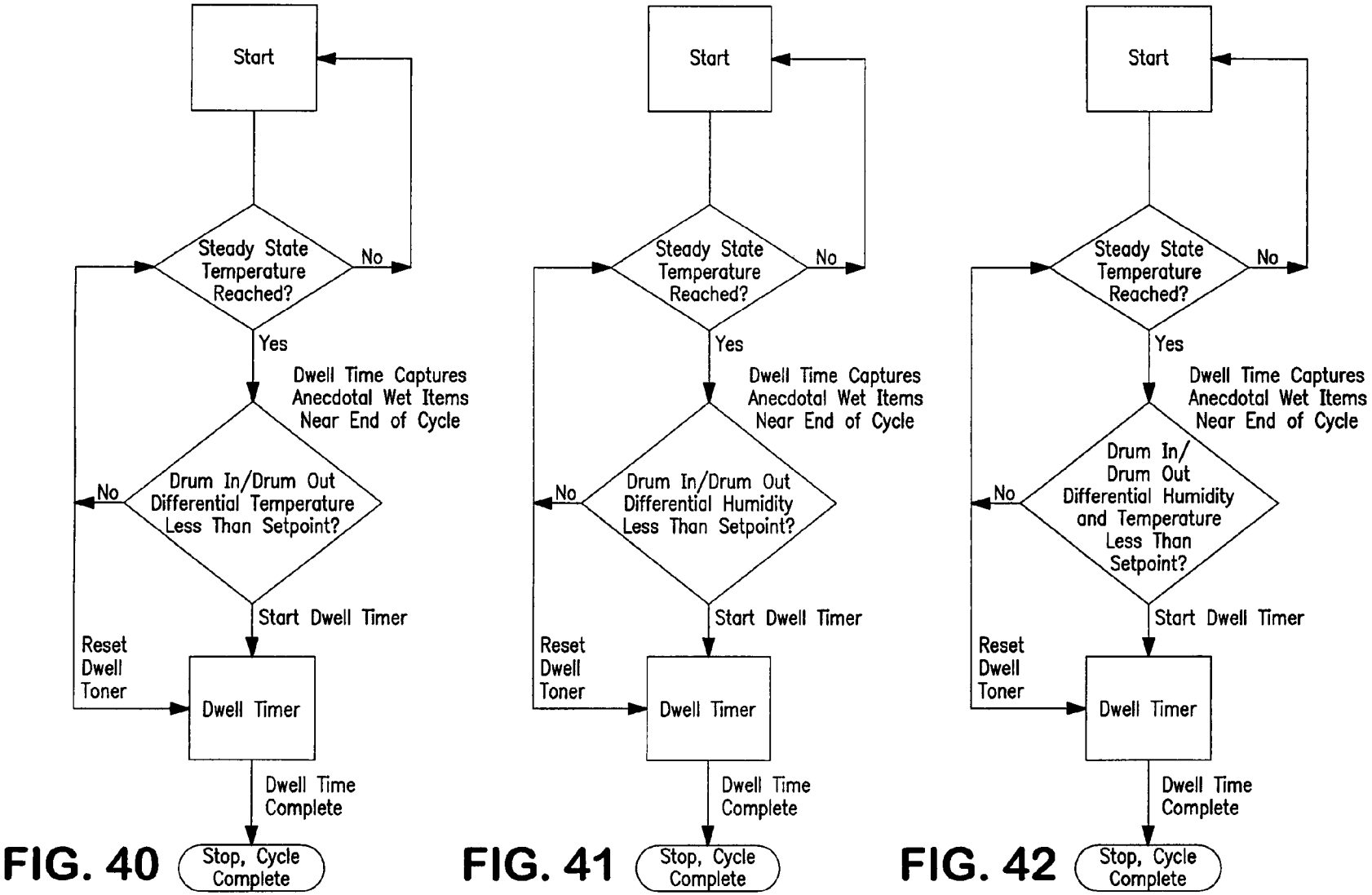
FIGS. 40-42 illustrate fabric moisture detection algorithms which can be used in the system of FIG. 38.

In the preferred embodiment, fabric dryness is monitored by control, 32, and the system is shut down automatically when desired dryness is achieved; this is discussed in the Dryness Control section of this document. Such a system is shown in FIG. 38. As shown therein a drum air in, humidity sensor 1040 and a drum air in temperature sensor 1042 are provided at the inlet to the drying drum 10. Also provided are a drum air out temperature sensor 1044 and a drum air outlet humidity sensor 1046 at the outlet of the drum 10. Each of the sensors 1040, 1042, 1044, and 1046 provides a signal to the control 32 which determines the fabric moisture and provides a signal to shutoff the dryer when a desired moisture is attained. Logic flow charts of sample algorithms which may be used in such a system are shown in FIGS. 40-42. FIG. 40 shows a differential temperature algorithm. FIG. 41 shows a differential humidity algorithm. FIG. 42 shows a combined differential humidity and temperature algorithm. The intent of all these algorithms is to recognize when the aggregate fabric load is dry, and then check for individual wet items. Typically, an isolated item will be wet when the rest of the load is dry, because it was wrapped in another item or is of substantially heavier fabric than the rest of the load. In this instance, as the wet time tumbles past the drum exhaust, the temperature will briefly fall and the relative humidity will briefly rise. Either may reset dwell time.

While FIG. 38 shows both temperature and relative humidity sensors, both are not required. Optionally, the dwell timer may also be reset by a dT/dt or dRH/dt spike. For example, if differential temperature is used as shown in FIG. 40, a single relative humidity sensor at the drum exhaust or outlet may also be employed. If, during the dwell time, there is a rapid rise in exhaust relative humidity, faster than a threshold slope, this will also reset the dwell timer.

Temperature Control

It is desirable to maintain relatively constant operating temperature during drying. In the preferred embodiment, the evaporator saturation temperature is kept as low as practical without causing ice accumulation. The dryer temperature may preferably be controlled by modulating the effectiveness of the wet air heatsink, 14, and/or the subcooler, 44, as desired.

It is desirable to accomplish temperature control with as little hysteresis as practical, particularly when the subcooler, 44, and refrigerant economizer, 50, are both used.

The refrigerant economizer, 50, transfers more heat when the subcooler, 44, is cut off. When the subcooler, 44, is switched on or off, e.g. via fan cycling, the TEV, 30, typically requires 15~30 seconds to equalize; an inefficient transitional state. Proportional control is thus preferable to on/off control for this embodiment, and is advantageous for all embodiments.

Figure 31:
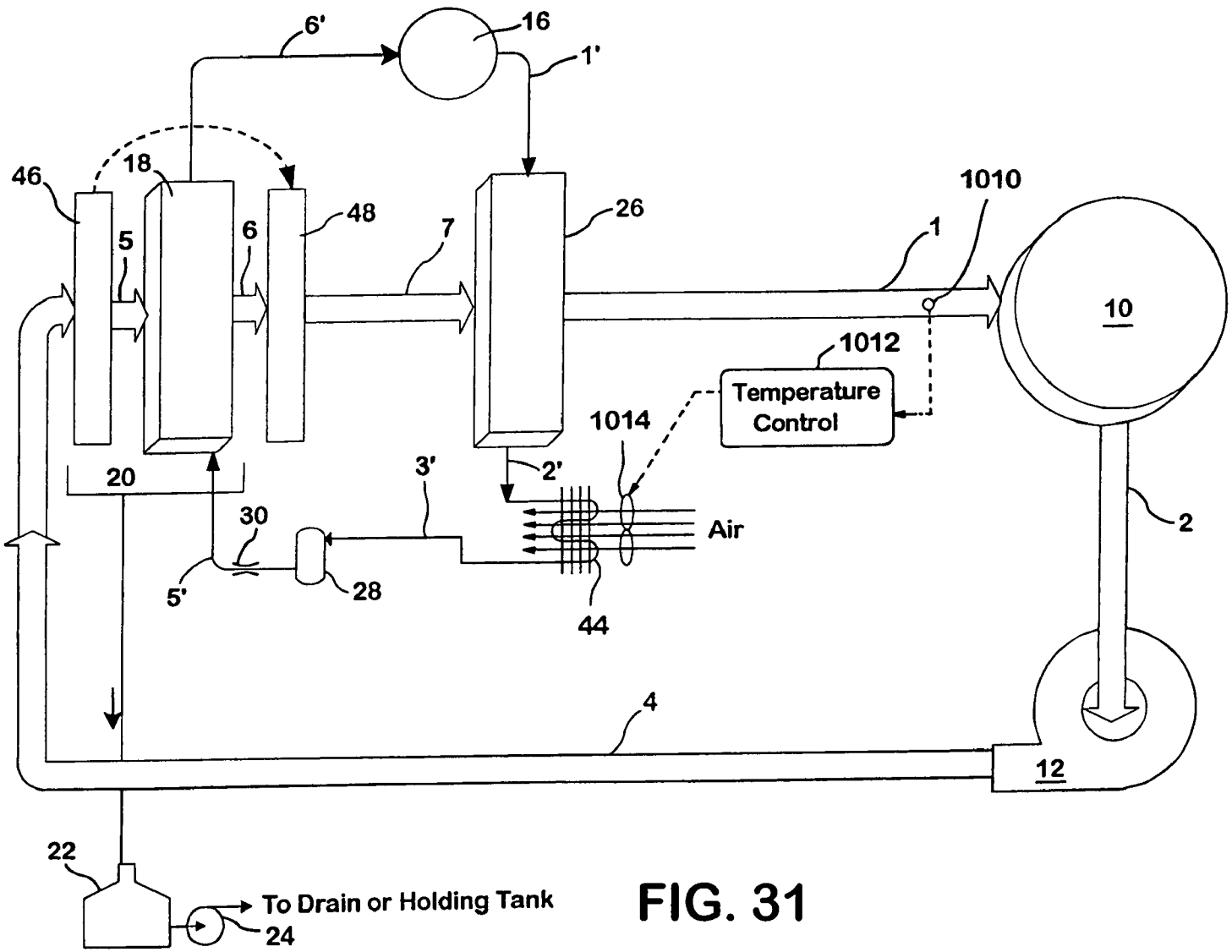
FIG. 31 is a schematic diagram of a heat pump dryer in accordance with the present invention with an air cooled refrigerant subcooler.

FIG. 31 illustrates a further embodiment of a heat pump dryer system in accordance with the present invention wherein a temperature sensor 1010 is placed just outside the hot air inlet to the drying drum 10. The sensor 1010 provides a signal representative of the temperature at the inlet of the drying drum 10 to a temperature control 1012. The temperature control 1012 generates a fan speed control signal which is used to operate a subcooler fan or blower 1014. The fan or blower 1014 utilizes cooling air from a room or other suitable source to air cool the subcooler 44.

Figure 32:
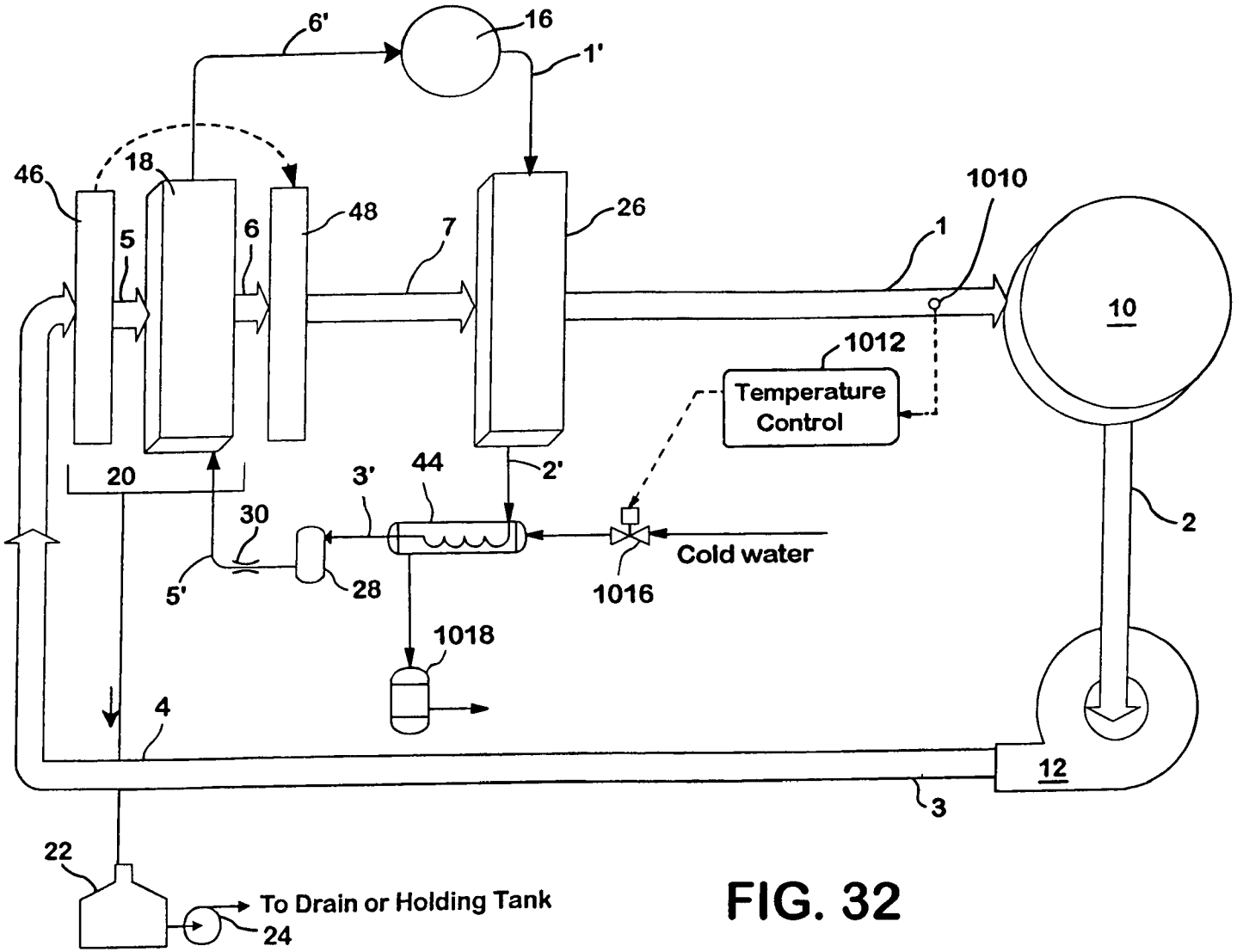
FIG. 32 is a schematic diagram of a heat pump dryer in accordance with the present invention with a water cooled refrigerant subcooler.

FIG. 32 illustrates still another embodiment of a heat pump dryer system in accordance with the present invention where the temperature sensor 1010 provides a signal representative of the temperature at the inlet of the drying drum 10 to a temperature control 1012. The temperature control 1012 generates a cooling water control signal which is fed to a cooling water control valve 1016. The valve 1016 receives cooling water from a facility water supply or other suitable source and supplies the cooling water to a water cooled subcooler 44. As shown in FIG. 32, the outlet of the water cooled subcooler may be connected to a discharge water accumulator 1018. If desired, water in the accumulator 1018 may be discharged to a heat load such as a washer as shown in FIG. 35.

Heatsink

In embodiments using the wet air heatsink, the heatsink, 14, may be modulated by means of active mechanical dampers; varying the volume flow of cooling room airflow over the heatsink, or varying heatsink bypass in the drying air loop.

Alternatively, modulation may be accomplished by cycling the heatsink fan, or preferably, by varying the heatsink fan speed. Variable fan speed, will advantageously reduce or eliminate parasitic temperature hysteresis that is typically encountered with fan cycling.

In fan controlled embodiments, the heatsink, 14, may be enclosed in a preferably insulated housing that substantially restricts heat transfer and natural convective airflow when the fan or blower is not operating, thus facilitating accurate control of heatsink, 14, effectiveness with variable cooling airflow means.

Subcooler

In embodiments using the subcooler, modulation may be accomplished with diverter valve means, that switch the subcooler in or out of the refrigerant circuit, as desired, in a manner similar to the warmup evaporator diverter valve, shown as item 38, in FIG. 3.

Alternatively, the subcooler fan may be cycled as needed to modulate the subcooler. In the preferred embodiment, subcooler modulation is accomplished with variable fan speed, which achieves modulation without the hysteresis introduced by fan cycling.

In fan controlled embodiments, the subcooler, 44 may be enclosed in a preferably insulated housing that substantially restricts heat transfer and natural convective airflow when the fan or blower is not operating, thus facilitating accurate control of subcooler, 44, effectiveness with variable cooling airflow means.

Thermal Expansion Valve

The thermal expansion valve (TEV), 30, may be configured to maintain constant or near constant superheat at the evaporator discharge. This may be accomplished with a simple mechanical TEV, 30, of the sensing bulb type, or preferably with a stepper motor type valve, under proportional or PID control.

In an alternate embodiment, the TEV, 30, may be configured to ignore evaporator superheat, and seek to maintain constant air temperature exiting the evaporator. This is the most direct method of maintaining evaporator air temperature as low as practical without freezing.

This latter approach ignores evaporator superheat, which may in practice approach zero (saturated vapor). This will not compromise performance, or introduce risk of liquid entering the compressor, if it is used with the refrigerant economizer, 50. The refrigerant economizer, 50, introduces substantial superheat at the compressor suction, and saturated vapor at the evaporator discharge will have no undesirable effect.

A constant pressure valve, capillary tube or other suitable expansion means, may be used in place of the TEV, 30, if desired.

Refrigerant receiver, 28, is preferred, offering modest performance improvement, but it is not essential, and may be eliminated if desired, slightly reducing manufacturing cost.

Dryness Control

Dryness may be monitored with classical electronic means that measure the electrical resistance of the fabric, via metallic fingers, that are mounted in the bulkhead or over insulated vanes. While this method works well, and has evolved into an industry standard, it does have its disadvantages. The placement of the metal strips is critical, else the wet clothes may not make the connection often enough to satisfy the sensor logic. In addition, it relies heavily on perfect tumbling of the clothes. If the clothes become wound up, as is common with large items such as sheets, or if a few pieces of clothing simply stay toward the back or front of the dryer, the metal strips may not sense individual wet items, and the dryer may stop short of appropriate dryness.

In a preferred embodiment, the mixing ratio of drying air entering and exiting the drum may be monitored. When the mixing ratio difference across the drum is within a desired tolerance, such as 5 grams of water per kilogram of dry air, the run may be continued for a suitable dwell time, such as 5 minutes, and stopped. This 5 minute dwell accommodates fabric windup and/or hidden small items. If such is the case, these items intermittently separate during the 5 minute dwell, and the mixing ratio of the air leaving the drum briefly rises, restarting the dwell timer means. However, if after five minutes, there is no transient rise in the drum exhaust mixing ratio, the laundry is considered dry. This method has generally proved accurate to 0.2 pounds of bone dry (2.5% of dry weight).

Open Loop Air Circuit

Figure 27:
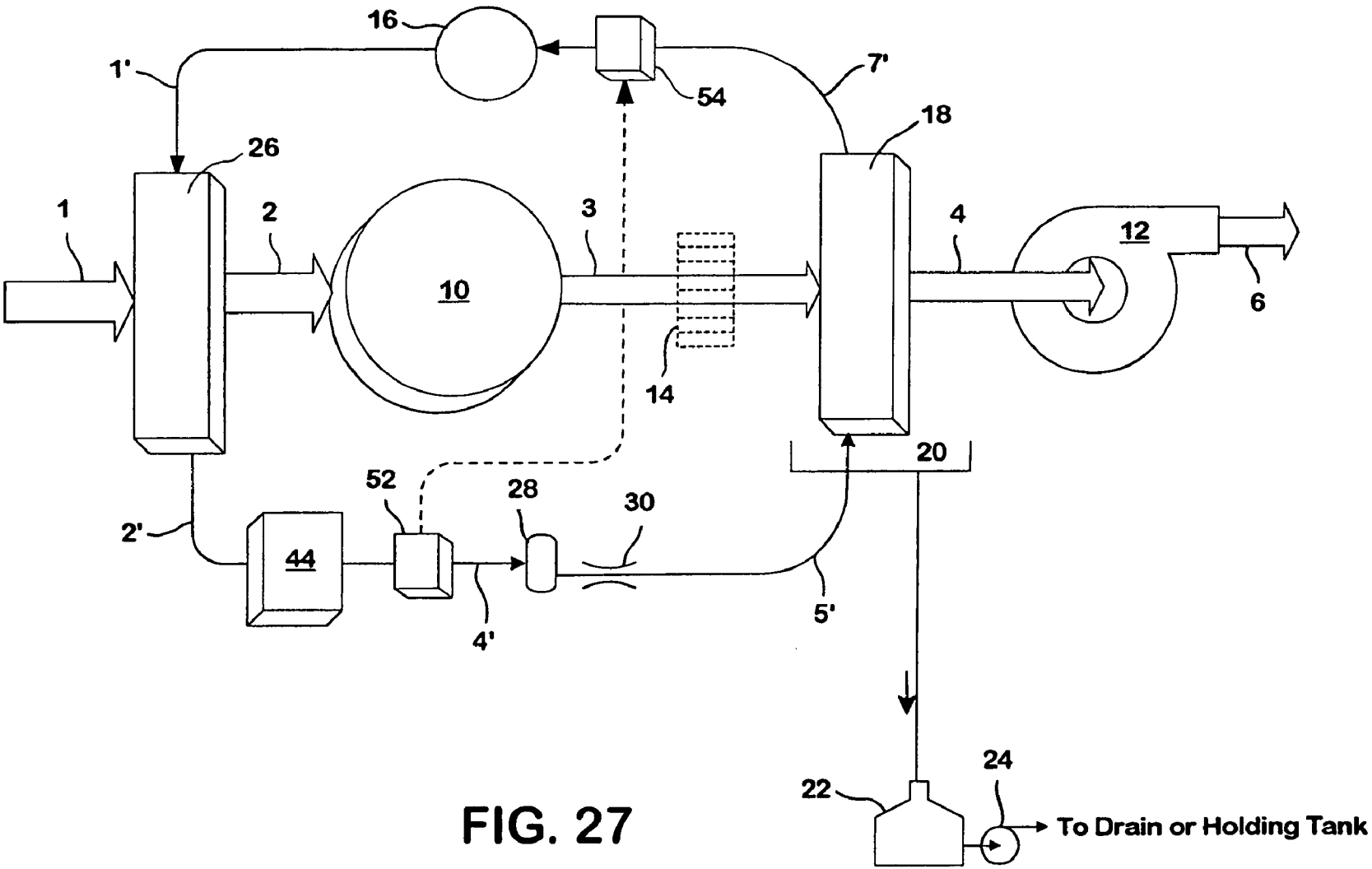
FIG. 27 is a schematic diagram of a dryer having an open air circuit.

An alternative to the closed air loop embodiments discussed in previous sections of this document is shown in FIG. 27. The blower, 12, may be located as shown, or may be located at the drum, 10, exhaust, point 3, to induce slight negative static pressure in the drum, as discussed in the section Drum Sealing.

In this embodiment, room air is drawn into the condenser, 26, at point 1, where it is heated. The heated room air exits the condenser, 26, enters the drum 10 at point 2, and extracts moisture from the fabric. The air then exits the drum 10 cooler and wetter, and enters the evaporator, 18, at point 3, which extracts heat from the air. The wet air leaves the evaporator, 18, at point 4, passes through the blower 12, to external vent means at point 5, where it is preferably vented to the outdoors.

In this embodiment, the condenser, 26, performs the function of the heater in a conventional dryer, with substantially less power consumption, taking advantage of the heat pump COP. The evaporator, 18, does not condense all of the moisture in the drum exhaust. It removes sufficient heat for heating incoming room air at the condenser, 26. Moisture not condensed out is vented outdoors with the exhaust air. Subcooler, 44, and wet air heatsink, 14, are not required, as heat substantially equal to the compressor, 16, power consumption is vented from the system with the exhaust air.

In an alternate embodiment, the evaporator, 18, capacity may be sufficient to condense substantially all the moisture from the exhaust air, permitting the exhaust air to be vented into the room, and not requiring outdoor venting means. In this embodiment, subcooler, 44, may be used to removed heat substantially equivalent to the compressor, 16, power consumption. Exhaust air may be used to cool the subcooler, 44, eliminating the need for a separate subcooler, 44, fan or blower.

In a variation of a fully condensing embodiment, wet air heatsink, 14, may be used, alone, or with subcooler, 44, to remove heat substantially equivalent to the compressor, 16, power consumption. In this embodiment, the evaporator, 18, capacity may be reduced, such that the combined heat transfer capacity of the heatsink, 14, and the evaporator, 18, is sufficient to remove sensible heat and condense substantially all the moisture in the exhaust air.

An air to air economizer or heat pipe economizer may be employed, with hot section at the system exhaust, point 5, and cold section at the system intake, point 1, for improved efficiency.

Refrigerant economizer, 50, may be applied to any of the above embodiments to improve heat pump performance.

This embodiment draws room air, and like conventional dryers, it is unable to reduce the partial pressure of water vapor in the drying air, as discussed in Appendix A: Theoretical Considerations. It presents the following advantages and tradeoffs:

- Advantages
- Substantially Reduced Manufacturing Cost
- No Heat Pipe
- Subcooler Not Required
- Smaller Heat Pump
- Tradeoffs
- Drying Air Discharge
- Outdoor Vent Required for Most Venues
- Chemical Vapors In Exhaust
  - Dryer Sheets
  - Wash Additives
- Slower, Drying Time Commensurate With Conventional Dryers Additional Process Enhancements Warmup Heat Storage Warmup time and warmup energy consumption may be reduced by storing waste heat generated during operation. While the preferred media is a blend of paraffins and/or other waxes, this may be accomplished with any heat storage media of sufficient capacity, that is suitable for the operating temperature range.

Figure 15:
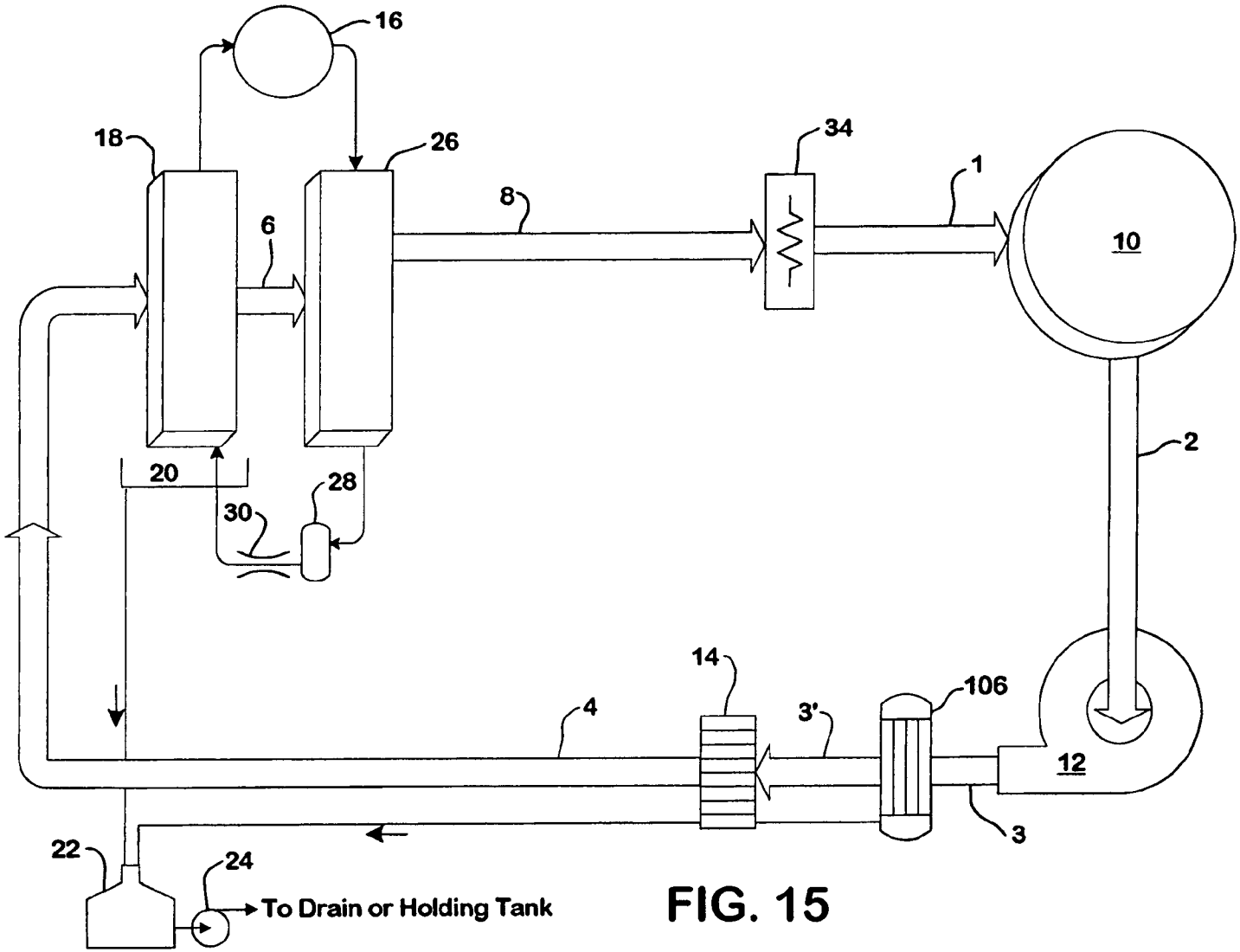
FIG. 15 is a schematic diagram of a dryer with a phase change heat storage.
Figure 16:
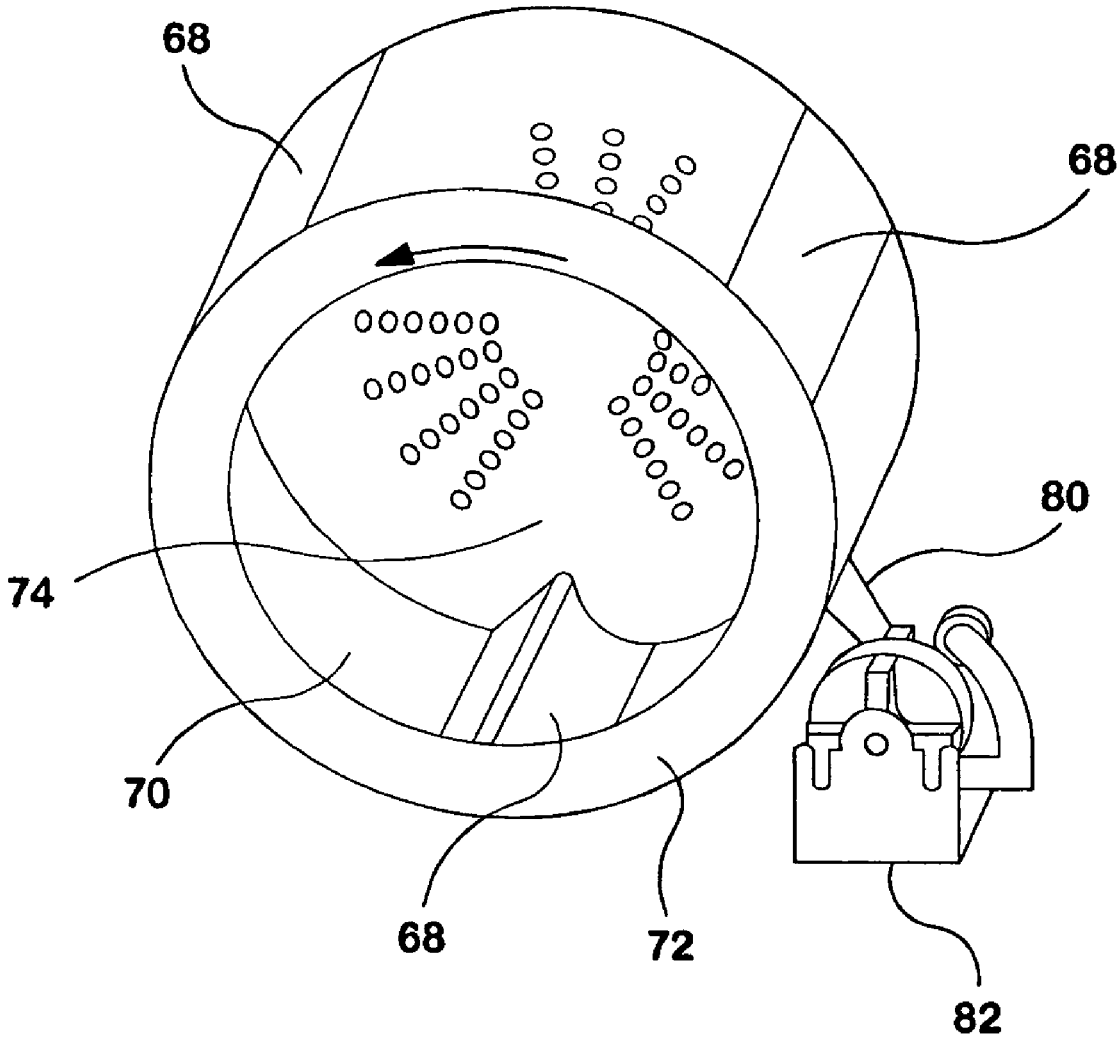
FIG. 16 illustrates a stationary drum with internal rotating vane assemblies.
Figure 17:
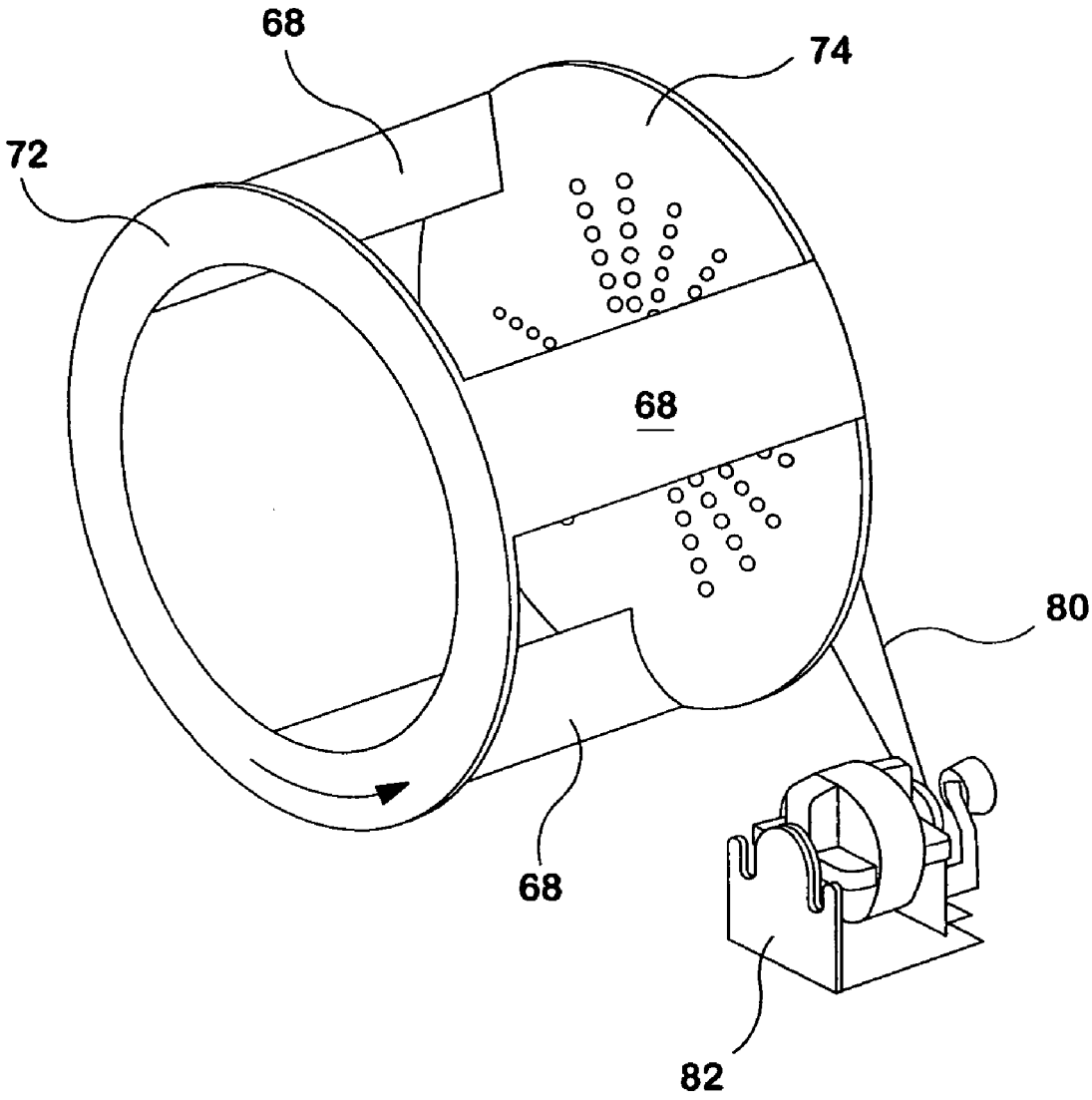
FIG. 17 is a perspective view of an internal rotating vane assembly for use in a drum.
Figure 18:
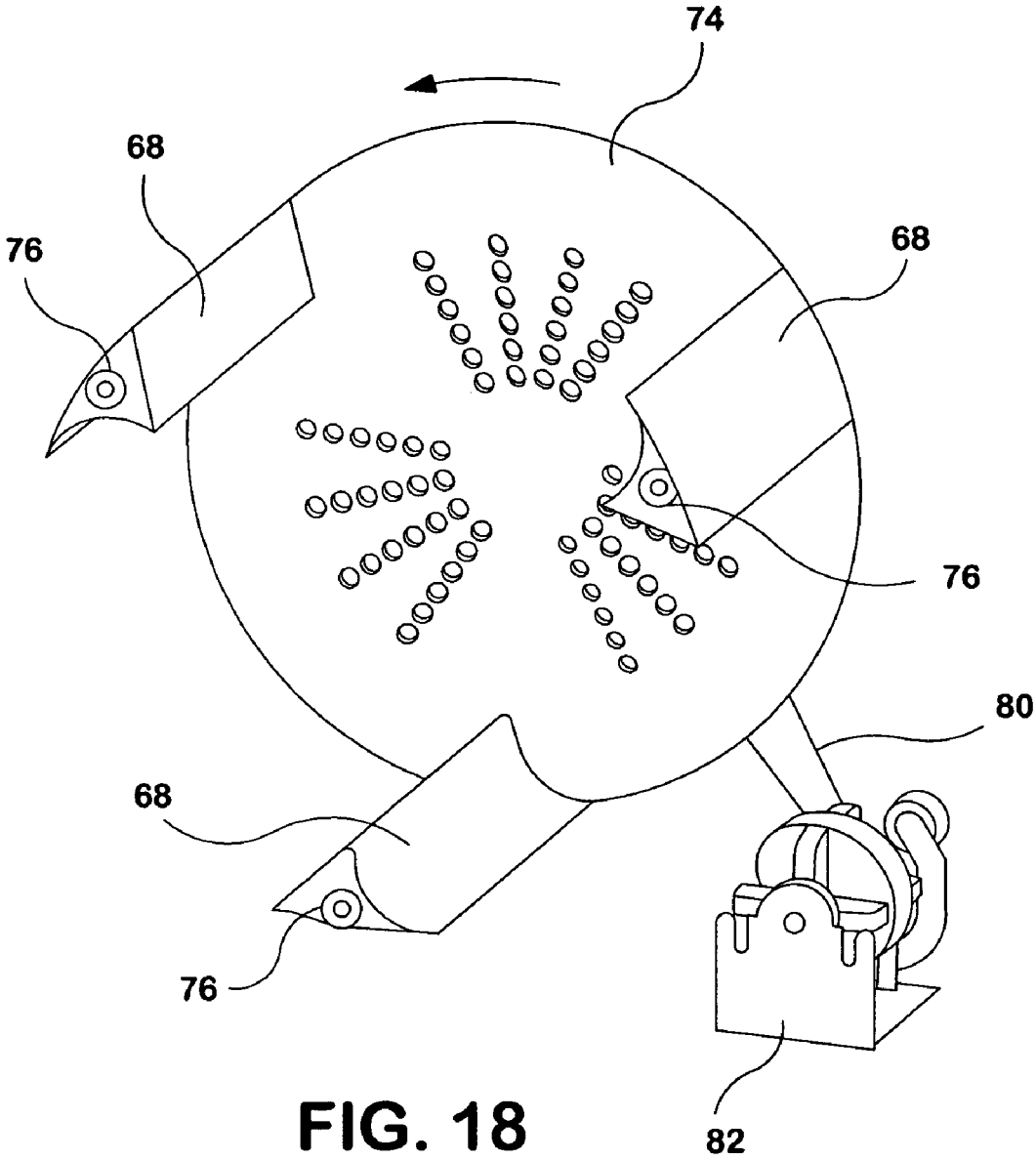
FIG. 18 is a cutaway view of an internal rotating vane assembly.

One embodiment is shown in FIG. 15, in which a phase change heat exchanger, 106, contains phase change media and suitable support structure, interposed in the wet air discharge from the drum, 10. Said support structure is configured to present sufficient surface area exposure of the media to the drum exhaust air, as well as maintain the form factor of the media while in the liquid state.

While the dryer is at steady state operating temperature, the phase change media absorbs heat from the drum exhaust air, effectively performing the function of the wet air heatsink, 14. Air exiting the phase change heat exchanger, 106, is sufficiently cooled to limit the effectiveness of the heatsink, 14. This continues until the phase change media is substantially melted, and cannot absorb any more heat. At this point, the heatsink, 14 performs its usual function of removing heat from the dryer for the remainder of the cycle. Heatsink, 14, may be shut down, preferably by control, 32, as discussed in previous sections of this document, until heat storage media becomes saturated.

When the dryer is started for a subsequent drying cycle, if it is cold, or if it is not fully warmed up, the phase change heat exchanger, 106, will heat the drum exhaust air, contributing warmup heat to the dryer. When the media is fully frozen, and cannot supply any more heat, or if the dryer reaches proper temperature before this occurs, the media ceases to contribute heat, and the cycle continues normally. During the steady state period, the media is reheated.

This approach shortens warmup time with no added energy consumption, effectively reducing drying time and energy consumption per load.

An alternate embodiment employs heat storage media in the refrigerant circuit (not shown). In the preferred refrigerant circuit embodiment, the heat storage media is located between the condenser, 26, and subcooler, 44, at point 2'. In an alternative refrigerant circuit embodiment, the heat storage media may be integrated with the subcooler, 44, or may be located between subcooler, 44, and refrigerant economizer, 52, at point 3'.

In this latter embodiment, the subcooler, 44, may be shut down, preferably by the system controls, until the heat storage media is saturated. The temperature of saturated heat storage media will lower than that of the preferred refrigerant circuit embodiment, concurrent with heat removed by the subcooler, 44, during steady state.

In the preferred refrigerant circuit embodiment, phase change media absorbs heat from the refrigerant exiting the condenser, 26, cooling the refrigerant, and serving the function of subcooler, 44. While the media is absorbing heat, it cools the refrigerant sufficiently to limit the effectiveness of the subcooler, 44. When the phase change media becomes saturated, i.e. when it is fully melted, and can no longer absorb heat, the subcooler, 44, performs its usual function of removing heat from the dryer for the remainder of the cycle. Subcooler, 44, may be shut down, preferably by control, 32, as discussed in previous sections of this document, until heat storage media becomes saturated.

When the dryer is started for a subsequent drying cycle, if it is cold, or if it is not fully warmed up, the phase change media will heat the refrigerant entering the economizer, 50, contributing warmup heat to the dryer. The economizer, 50, conducts this heat directly to the compressor suction, increasing suction gas density, and refrigerant mass flow. This compounds the effect of the phase change media; the heat pump operates at useful effectiveness before reaching operating temperature, further reducing warmup time.

When the media is fully frozen, and cannot supply any more heat, or if the dryer reaches proper temperature before this occurs, the media ceases to contribute heat, and the cycle continues normally. This approach substantially shortens warmup time without added energy consumption, effectively reducing drying time and energy consumption per load.

Active Expander

Figure 11:
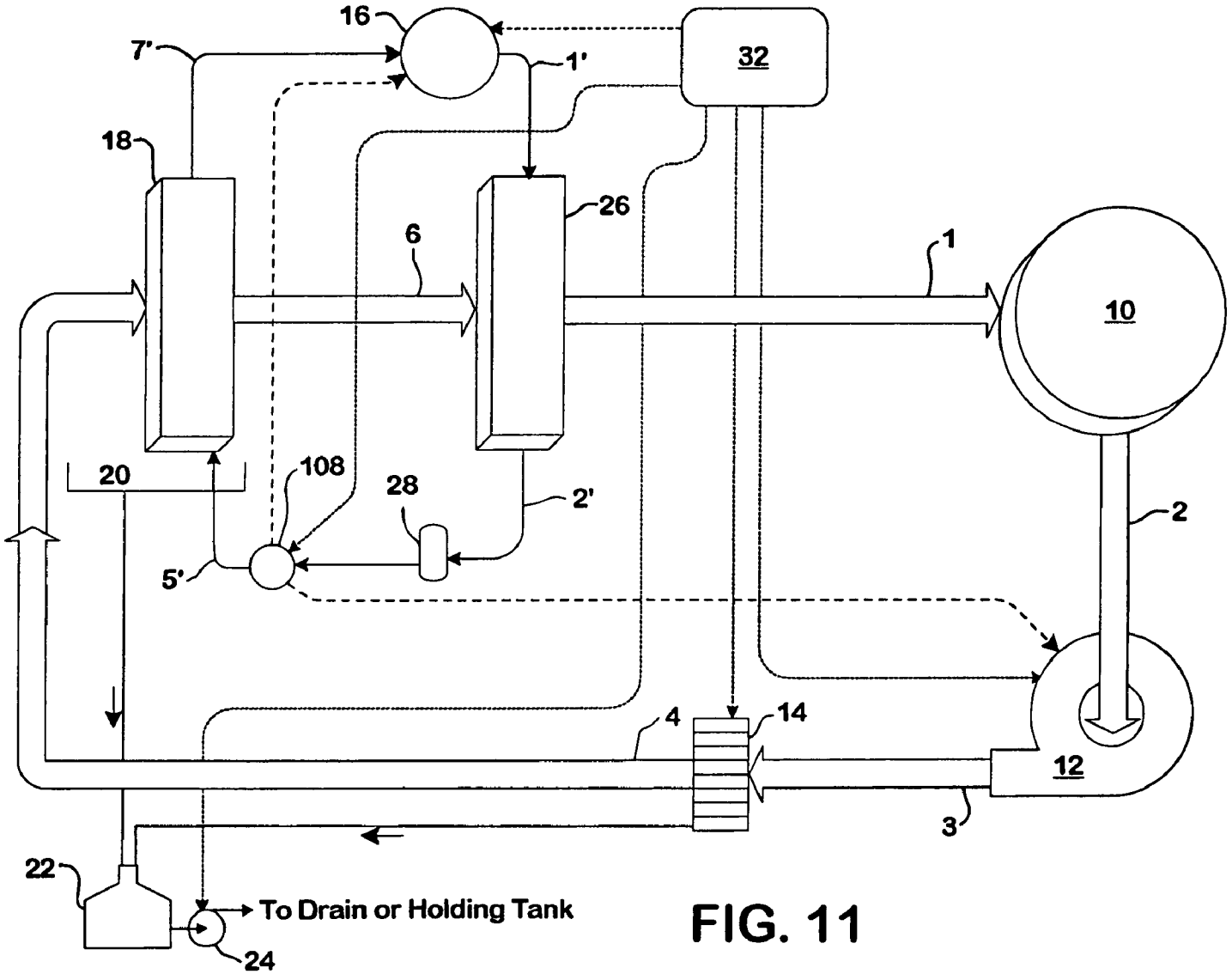
FIG. 11 is a schematic diagram of a dryer with an active refrigerant expander.

To improve heat pump efficiency and further reduce drying energy consumption, as shown in FIG. 11, this embodiment employs an active expander, 108, in place of the TEV. The expander, 108, serves the same function as the TEV, but instead of using irreversible friction as the source of pressure drop, reversibly extracts energy from the refrigerant. The preferred embodiment employs a small scroll type refrigerant compressor, operating in reverse as an expander, and generating useful electricity. A scroll type expander will advantageously tolerate internal vaporization of the refrigerant during expansion.

This arrangement preserves the hermetic nature of the heat pump refrigerant circuit, and its concurrent design life and reliability. The electrical output from the expander may sent to electronic controls that provide steady controlled electrical supply, over a range of expander rotation speeds. The resultant clean electrical supply may be used to operate ancillary items, such as fan and/or drum motors, or may supply a portion of the compressor power, as desired.

Advanced Refrigerant and Equipment for Using Same

In the interest of entirely eliminating Hydrocarbons, Fluorines, and Chlorines from the heat pump, it is advantageous to use water as the refrigerant. A heat pump system intended for water based working fluid presents novel equipment design considerations, which offer manufacturing advantages, as well as zero ODP, and zero Global Warming.

A heat pump system using water as the refrigerant will operate at substantially lower pressures and higher volume flow than with conventional refrigerants. Heat pump equipment designed for water based refrigerant will have commensurately different requirements.

Typical system pressures in a heat pump, operating in the preferred temperature range of a heat pump dryer, are less than ~1 PSIA on the low side, and ~10 PSIA on the high side. Refrigerant volume flow rates are substantially higher than with conventional systems. The compressor for the preferred embodiment is a hybrid design, resembling a high pressure blower as much as a conventional heat pump compressor.

One embodiment of a suitable compressor is a rotary vane type, optimized to handle deep vacuum on the low side, and high differential pressure, as compared with typical rotary vane devices. An alternate embodiment comprises regenerative blower stages. Conventional regenerative blowers are not capable of sufficient differential pressure for use in a heat pump, and a modified design is necessary. One embodiment comprises a plurality of cascaded regenerative blower stages.

The low pressure side of this system operates at a substantial vacuum with respect to ambient atmospheric pressure. To accommodate this, suitable means to prevent air from infiltrating the system through shaft seals, or the like, are needed. For this purpose, and for motor cooling, the compressor block is preferably encased in a hermetic shell, similar to conventional heat pump compressors.

In conventional systems, refrigerant soluble lubricant is used in the compressor. A small amount invariably escapes the compressor through piston rings, scroll seals, or the like. The escaped lubricant is permitted to circulate throughout the refrigerant circuit, and eventually returns to the compressor at the suction side.

One compressor embodiment, for use with water refrigerant, is an oilless type, requiring no lubricant. An alternate embodiment, which presents improved sealing and reduced blow by qualities, incorporates a water soluble lubricant that is permitted to circulate throughout the refrigerant circuit. The preferred lubricant will not materially compromise the thermodynamic properties of the water refrigerant.

Water refrigerant introduces the possibility of corrosion. In the preferred embodiment, the piping is nonmetallic, and piping corrosion is not an issue. Corrosion in the compressor may be addressed with a plurality of methods. One embodiment employs corrosion inhibitors in the soluble lubricant. An alternate method, which may be used with or without corrosion inhibitors, is the use of corrosion resistant materials or platings for the compressor wetted components.

A third embodiment comprises oxygen getter means installed in the system piping. Such means remove entrained oxygen from the refrigerant during the first minutes or hours of run time, mitigating or eliminating corrosion in the compressor, piping, and in all system components that contact the refrigerant. The getter media may react with available oxygen, converting it to an inert compound that remains captivated in the media, may catalytically absorb it, or may use other suitable means for removing available oxygen from the system.

In a preferred hermetic embodiment, the getter means may be an ablative single use type, that is substantially consumed in the oxygen removal process. The getter media may be packaged in a sealed canister that is installed during system manufacture, removes available oxygen upon first use, and becomes a permanent passive component, much like the filter/dryer used in conventional systems.

The heat exchangers in this system will also depart from conventional heat pump HX design. In light of the low operating pressures, and high volumetric flowrates, classical small bore Fin and U Tube configurations will not perform properly. A preferred HX embodiment comprises comparatively large diameter inlet and exhaust ports manifolded to a substantial plurality of parallel flow tubes or channels. The low operating pressures will permit very inexpensive HX designs.

The piping design will also be a departure from conventional systems. It will preferably be of larger diameter, and may be of lighter materials, such as aluminum, PVC, or other suitable polymer. In the preferred embodiment, PVC piping is used with solvent welded joints, offering substantially reduced manufacturing cost over conventional systems.

Water refrigerant exhibits practical saturation pressures at temperatures typical of air conditioning systems, and heat pump equipment using water refrigerant may be used in air conditioning applications, as well as in the heat pump dryer.

Supplemental Features

Stationary Drum for Drying Nontumble Items Such as Sneakers

Conventional dryers often provide a removable stationary rack for drying sneakers and the like. This rack attaches to the rear drum bulkhead, which typically does not rotate, and to the front door frame. It's only purpose is to provide a stationary platform for items that cannot be tumbled.

The heat pump dryer has a separate drum or vane drive that may be stopped for drying items such as sneakers. If desired, a multilevel rack may be provided for drying large quantities of nontumble items. This rack may simply rest inside the drum without need for complex attachment means.

An alternate embodiment comprises a single or multilevel rack that captivates items to be dried, so the drum or vanes may rotate without causing these wet items to tumble or fall. In this embodiment, drum or vane rotation speed may be reduced to minimize the effects of unbalance while providing enhanced exposure of wet items to drying air. In a stationary drum embodiment, this type of rack may attach to the vanes, and rotate with them as an integral unit.

Modular Heat Pump

The heat pump system may be constructed as unitary module, permitting simplified removal for repair or replacement. A unitary module may also be advantageously connected to an existing conventional tumble dryer, thus converting it to a heat pump dryer. In the latter case, the module may be configured as a pedestal which the connected dryer sits upon.

Heat Pump Dryer Sheets

Dryer sheets, currently available from a number of vendors, contain a form of fabric softener that outgases during drying, and infiltrates the fabric. These sheets are designed for conventional dryers, and produce sufficient active vapor to maintain desired concentration, as the drum air is continually replaced with room air.

The heat pump dryer does not dilute the air loop with room air, and dryer sheets need not produce the quantity of active vapor necessary for use with conventional dryers. A reduced vapor rate dryer sheet for use with heat pump dryers will exhibit performance commensurate with conventional dryer sheets used in conventional dryers, at substantially less cost.

In an alternate embodiment, a suitable easily accessible holder may be provided in the heat pump dryer air loop, in which a longer life product may be placed. This product, preferably heat or moisture activated, may outgas active vapor at a slow rate, only during drying. It may be fabricated as a sponge, molded cake, or the like, and may be designed to last for any desirable number of drying cycles before being replaced. The holder may be located in the door, as part of the lint filter assembly, or any suitable location in the air loop.

Heat Pump Hot Water Source

The heat pump hot water source will generate hot water from cold, or preheat a water heater feed stream. It may heat or preheat process water for any suitable process. It accomplishes this by recovering and storing heat, that would otherwise be wasted, from hot drain water, such as from a washer or washers. Heat storage is preferably accomplished with suitable phase change media, such as paraffin or eutectic salt, allowing sequential heat recovery and subsequent use; the heat source and the heated process need not operate simultaneously.

The heat pump preferably uses the stored heat to raise incoming wash water, such as cold tap water, to the proper wash temperature. The heat pump means may comprise a large central system that collects and stores heat from a plurality of washer drains, and heats wash water for a plurality of washers. In the preferred embodiment, the system is integrated in a single washer, or configured as a pedestal that is placed under an existing washer. Commercial washers are significantly shorter than their counterpart dryers, and the pedestal may raise the washer to a more convenient loading height.

Figure 28:
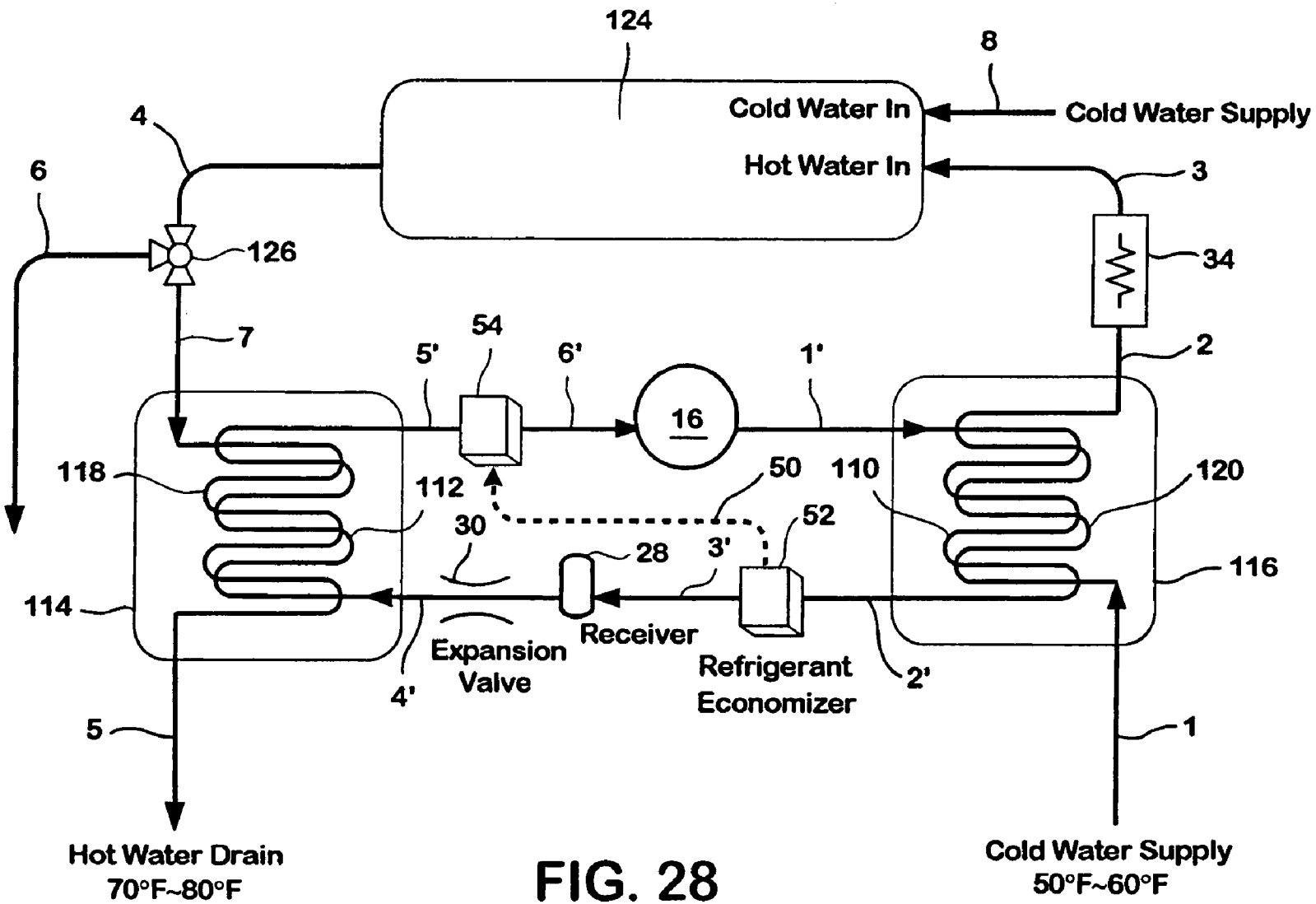
FIG. 28 is a schematic diagram of a washer having a heat pump hot water source.

An example of the preferred embodiment is illustrated in FIG. 28. In this embodiment, a heat pump, comprising compressor 16, condenser 110, economizer 50, receiver 28, TEV 30, and evaporator 112, is interposed between heat storage means, 114 and 116. Heat storage means 114 and 116 may comprise any suitable heat storage media; the preferred heat storage embodiment comprises containers of suitable phase change media, such as a paraffin or eutectic salt, or suitable blend thereof. In the preferred embodiment, heat exchangers, 118 and 112, are integrated within the drain side heat storage media 114, and heat exchangers, 110 and 120, are integrated within the supply side heat storage media 116.

When the washer, 124, calls for hot wash water, tap water enters the supply side heat storage means 116, at point 1, and passes through heat exchanger means 120, integrated within the heat storage media, which heats the tap water to desired wash temperature, as described below. Heated wash water exits the heat storage means 116, and enters the warmup heater, 34, at point 2. The wash water passes through warmup heater 34, and enters the washer 124, hot water inlet, at point 3. If there is insufficient heat stored for heating incoming cold wash water, such as during the first run of a cold start, the warmup heater 34, may be energized to heat the wash water.

At the completion of the first or any subsequent wash cycles, the drain water leaving the washer 124, retains substantial heat. This drain water exits the washer 124, at point 4, and enters drain diverter valve 126. If drain water is sufficiently warm, it passes through the diverter valve 126, and enters drain side heat storage means 114, at point 7. The drain water then passes through heat exchanger means 118, integrated within the heat storage media. Heat exchanger means, 118 transfers heat from the drain water to heat storage media, and the cooled drain water exits to an external drain provision, at point 5.

The heat storage media in heat storage means 114, retains the heat transferred from the drain water. In the preferred embodiment, this media is of the phase change type, such as a paraffin or eutectic salt, or suitable blend thereof. The heat storage media preferably has sufficient capacity to store the heat of one or more complete wash cycles.

The heat pump transports the heat stored in the drain side heat storage means 114, via heat exchanger means 112, the refrigerant evaporator, to the supply side heat storage means 116, via heat exchanger means 120, the refrigerant condenser. The supply side heat storage media stores the pumped heat. The supply side heat storage media is preferably a phase change media, similar to the drain side media, with a melting point commensurate with wash temperature.

When sufficient heat is stored in the supply side media for heating wash water, the warmup heater, 34 is no longer needed and may be shut off. Incoming cold tap water passes through heat exchanger means, 110, which transfers heat from the heat storage means, 116, to the incoming tap water. The tap water, thus heated to proper wash temperature, exits the supply side heat storage means, 116, at point 2, then passes through warmup heater, 34, unchanged if already at desired wash temperature, and enters the washer 124, hot water inlet, at point 3.

The drain side water heat exchanger, 112 and storage means, 114, is preferably of sufficient heat transfer capacity to recover and store drain water heat in real time. Likewise, the supply side water heat exchanger, 120, and heat storage means, 116, is preferably of sufficient heat transfer capacity to heat incoming tap water to wash temperature in real time.

The heat storage means are preferably insulated sufficiently to store heat for a period of time exceeding the maximum idle time of the washer, 124, for example, overnight.

In the preferred embodiment, heat is stored on both the drain side and the supply side. This takes advantage of the fill and drain duty cycle, which is relatively low; each generally requiring approximately 5 minutes, and typically occurring at intervals of 15 to 20 minutes.

The heat pump is preferably of lower capacity than the heat storage means, and operates for a period exceeding the drain and fill times and less than the interval between fill cycles, as needed, to pump stored heat from the drain side to the supply side heat storage means. This advantageously permits the use of a smaller, less expensive heat pump, with no compromise in performance.

Alternatively, heat storage media may be implemented only at the drain or fill side. In this embodiment, the heat pump is of sufficient capacity to pump heat either from the drain water or to the wash water in real time. This embodiment permits the use of heat storage means at either the drain or supply side and not at both, but requires a substantially larger and more expensive heat pump.

In practice, it is common for the wash water to be hot, and the rinse water be warm or cold. It is disadvantageous for cold drain water to pass through the drain side heat storage means, 114. In the preferred embodiment, when the drain water temperature falls below a preset threshold, diverter valve, 126, is activated, causing drain water to bypass the heat storage means, 114, entirely, at point 4, and pass directly to an external drain provision, at point 6.

As cold drain water generally follows a cold fill cycle, it is not necessary to heat the incoming tap water for same. In the aggregate, over a sufficient plurality of wash cycles, stored heat will generally be commensurate with needed heat.

The washer, 124, tub or drum is preferably insulated, to minimize heat loss during the wash dwell time. Typical energy and operational cost reduction, when this system is used with a washer or a plurality of washers, is commensurate with that of the heat pump dryer.

Appendix A: Theoretical Considerations

Three States of Drying

In convective drying, there are three discernable states in the transition from wet to dry fabric: Warmup or Rising Rate, Steady State, and Falling Rate.

Warmup is the first state of convective drying. In this state, the fabrics are at their highest moisture content, and the drying air is relatively dry. At this stage, the surface temperature of the fabric to be dried is lower than the wet bulb temperature of the drying air. This is the driving mechanism during warmup. The wet bulb temperature of the drying air must be reduced, and the surface temperature of the clothes must be increased. The drying air therefore transfers heat to the clothes, and the clothes transfer moisture to the air. This mechanism will stop when the equilibrium condition is met, i.e., when the surface temperature of the clothes equals the wet bulb temperature.

During Steady State drying, the surface temperature of the clothes remains constant, as does the wet bulb temperature of the air. There is a stable transfer rate of moisture from the fabric to the air and the drum is effectively adiabatic during this time. The mechanism for drying in Steady State is the difference in partial pressures between water in the air/fabric boundary layer, and water in the bulk air (Discussed below in Low Temperature Drying Mechanism). Steady State continues while the core of the wet fabric has sufficient moisture to feed the surface at the same rate as the surface releases moisture to the air. However, at some point there will no longer be enough moisture in the core of the fabric to sustain this, and mass transfer will begin to slow the process down. This threshold is referred to as the Critical Moisture Content. The Critical Moisture Content varies with the size and shape of the laundry item, as well as the fabric itself.

Falling Rate is the last and least efficient state of drying. In this state, there is insufficient moisture near the surface of the fabric to keep the partial pressure of water in the air/fabric boundary layer constant. As this partial pressure decreases, the driving force behind drying is reduced. Mass transfer is therefore the bottleneck during this state, as the drying air can remove only the moisture on the surface. Mass transfer is the movement of moisture through the fabric from the core to the surface, and is governed by two variables; the fabric itself, and its internal energy. The fabric cannot be changed, so the only variable that can be used to increase the driving force for drying is the internal energy of the clothes. It is relatively difficult to transfer heat via convection during this state, and the drying rate therefore falls continuously until it becomes asymptotic. This is the practical limit for convection drying.

Low Temperature Drying Mechanism

"Equilibrium Moisture Content

In drying of solids, it is important to distinguish between hygroscopic and non-hygroscopic materials. If a hygroscopic material is maintained in contact with air at constant temperature and humidity until equilibrium is reached, the material will attain a definite moisture content. This moisture is termed the equilibrium moisture content for the specified conditions. Equilibrium moisture may be absorbed as a surface film or condensed in the fine capillaries of the solid at reduced pressure, and its concentration will vary with the temperature and humidity of the surrounding air. However, at low temperatures, e.g., 60° F. to 120° F., a plot of equilibrium moisture content vs percent relative humidity is essentially independent of temperature. At zero humidity the equilibrium moisture content of all materials is zero." (Perry & Chilton, Chemical Engineers' Handbook, Fifth Edition: 20-12. McGraw-Hill, 1973)

The above excerpt illustrates the theory behind drying clothes at relatively low temperatures. The mechanism for this drying is not the boiling of water, but rather the tendency of two bodies, with differing moisture content, to reach equilibrium. This is the same mechanism that dries the skin in cold weather. It is driven by the difference between the partial pressures of water vapor in the drying medium (in this case, air) and on the surface of the moist fabric.

The surface of the clothes during steady state drying is always at the wet bulb temperature of the surrounding air (the core of the fabric will be measurably colder than the surface). At the boundary layer between the clothes and the air, the temperature of both the clothes and the surrounding film of air will therefore be the wet bulb temperature. Since the clothes are wet, the surrounding film of air will be saturated (100%

RH). There is a specific and known partial pressure of water vapor in this film of air which corresponds to 100% RH at the temperature of the boundary layer. The relative humidity of the bulk drying air is not 100%, it is in fact much lower. This corresponds to a lower partial pressure of water vapor in the bulk air.

This difference in partial pressures causes the water vapor in the boundary layer to migrate into the bulk air. This loss of water vapor is immediately replenished by the surface of the clothes, drying the clothes and remoistening the boundary layer air. This mechanism relates to a drying rate in the following equation:

$$\text{Drying Rate}=h_t \cdot A \times \Delta_P$$

In this equation, ht is the total heat transfer coefficient between the moist fabric and the convective drying medium (in this case, air). A is the total aggregate surface area of the moist fabric exposed to the drying medium. A is dependent on the size of the load, the size of the drying drum, and the speed at which the drum spins. $\Delta_P$ is the partial pressure difference discussed earlier.

This equation shows that for a given load of laundry in a drum of a given size, the only variable that directly controls drying rate is the difference in partial pressures ($\Delta_P$). There are two ways of increasing $\Delta_P$, and therefore the drying rate; increasing the saturated partial pressure of water vapor at the boundary layer, or decreasing the partial pressure of water vapor in the bulk air.

A conventional dryer is incapable of decreasing the partial pressure of water vapor in the bulk air, because it draws room air, and the partial pressure of water vapor in air does not measurably change with the dry bulb temperature. Instead, a conventional dryer uses heat to increase the surface temperature of the clothes, which in turn increases the partial pressure of water vapor at the boundary layer.

The heat pump dryer partially uses heat in the same manner, however it also uses the evaporator coil to reduce the overall moisture content of the bulk air that enters the drum. This combined capability of reducing the partial pressure of water in the bulk air and increasing the partial pressure of the water in the boundary layer allows the heat pump dryer to dry faster at lower drum inlet temperatures.

Standby Moisture Handling

During long down times, the moisture in the drying air loop may become stale, and may support bacterial growth. This may be treated in a variety of ways as outlined below. The treatment ways may be used individually or in combination with each other.

1: Drying Out the Dryer

A: Active System, using one or two very small fans, perhaps 20 watts each. These may be configured to purge the drying air loop between runs. One fan and a vent or one suction fan and one discharge fan may be used. They may be very low airflow, as there is no need to purge quickly. They may cycle briefly after each run, or may be programmed to cycle after a predetermined period of idle time.

Figure 39:
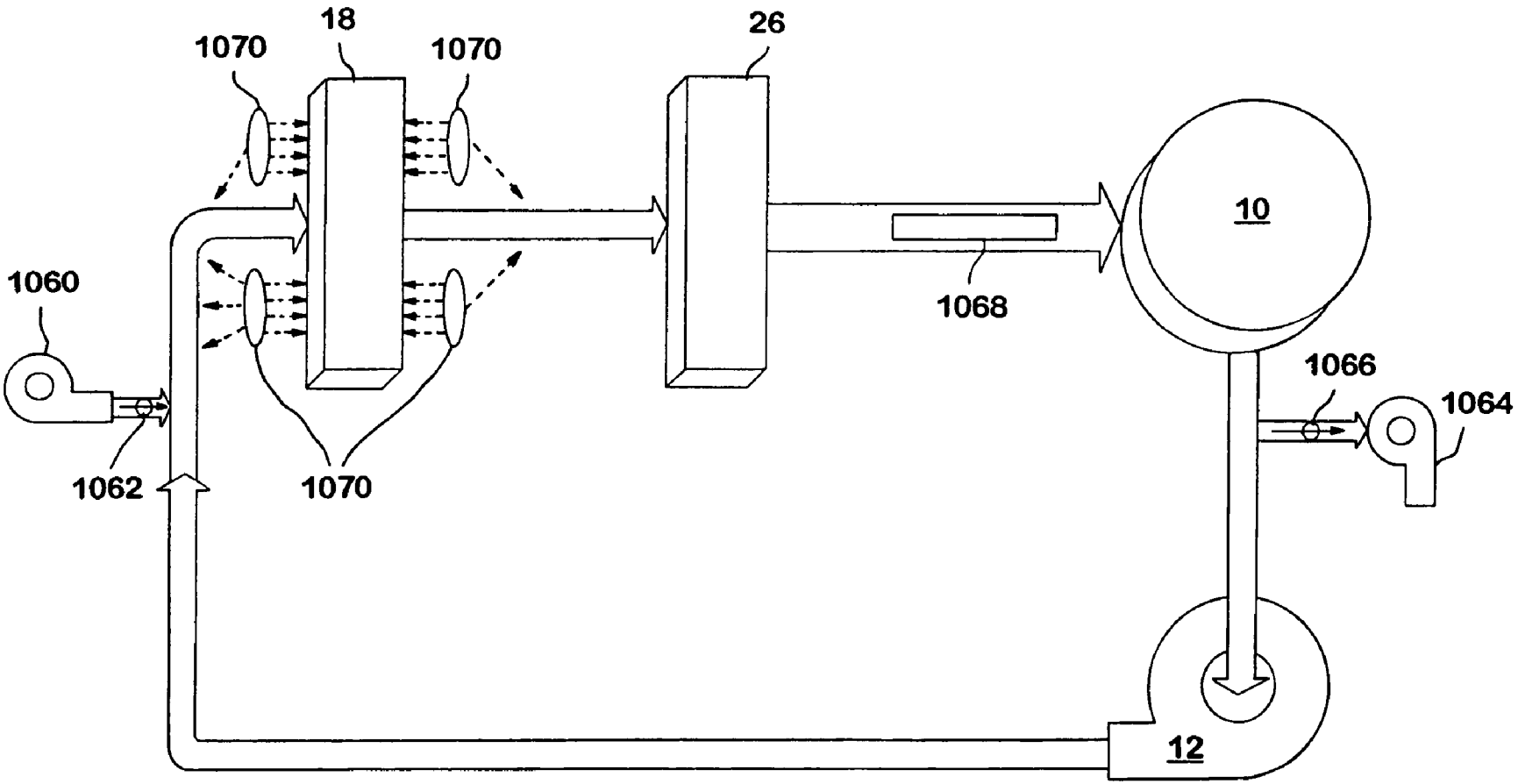
FIG. 39 is a schematic diagram of a heat pump dryer in accordance with the present invention having standby moisture handling.

FIG. 39 illustrates such an active system. As shown therein, an input purge fan 1060 may be used to provide air to the drying air loop. The output of the fan 1060 may be connected to the drying air loop via a check valve or damper 1062. The system may also include an exhaust purge fan 1064 that is connected to the drying air loop via a check valve or damper 1066.

The discharge vent for this approach may be active, either solenoid or motor operated. It may also be a simple one way shutter, similar in construction to venetion blinds. If placed at the main blower suction, and biased to close when the main blower is running, it will close during normal dryer operation. When he purge fan is running, it will open to allow purge air to exit. The entire configuration may be reversed, with the damper on the main blower discharge, allowing air to enter only, and the purge fan exhausting air.

B: Passive System. Humidity sensitive semiporous membrane material, such as those made by Mitsubishi, and used in refrigerator crisper drawers, may be used in the drying air loop. If desired, two ports may be created to permit cross flow through the drying air loop. The ports may be located at a point of relatively low pressure relative to the room ambient to mitigate stress on the membrane.

Referring now to FIG. 39, in a preferred embodiment, a membrane 1068 may be placed at a dry section of the drying air loop, such as the drum inlet. The membrane 1068 will then close in response to the humidity. When the dryer is idle, and the humidity in the loop equalizes, the membrane 1068 will open, permitting slow migration of moisture out of the loop. Alternatively, one membrane 1068, and one small purge fan 1064 may be used.

2: Antibacterial

A: Ultraviolet Lamps in the evaporator section will greatly mitigate bacterial growth in the loop, and will help freshen the clothes. Small diameter fluorescent UV lamps placed across the evaporator so the light penetrates the space between the fins will be very effective. FIG. 39 illustrates a plurality of ultraviolet light sources 1070 placed adjacent a self cleaning lint trapping evaporator 18.

B: Ozone Generator means may also be used to retard bacterial growth and render the clothing smelling very fresh. This may run during idle time and/or during drying time. It may be desirable to have a two power setting, so the ozinator runs at low power during idle, and higher power during drying.

C: Dryer Sheets: The closed loop system requires less treatment vapor, and less than ¼ of a standard sheet seems to provide very good results, and leaves the dryer smelling nice for at least a day or two.

D: Integrated Lint Filter & Dryer Sheet

A lint filter fabricated of very small pore open cell foam, or corrugated paper based media may be treated with fabric softener chemistry similar to that used in disposable dryer sheets. The filter may be mounted in a suitable disposable or reusable frame, that fits specific models of dryer and replaces the existing lint filter. The filter may be of sufficient surface area (eg via corrugations) so as to permit running a plurality of loads before discarding it.

In a heat pump dryer, because much less lint is generated, and the closed loop configuration of the heat pump dryer consumes less softener chemistry, facilitating the use of the filter/softener embodiment for numerous loads. This type of filter in a heat pump dryer may have a design life 10 or more loads, permitting nominal weekly replacement.

Integrated Self Cleaning Lint Removal

Figure 36:
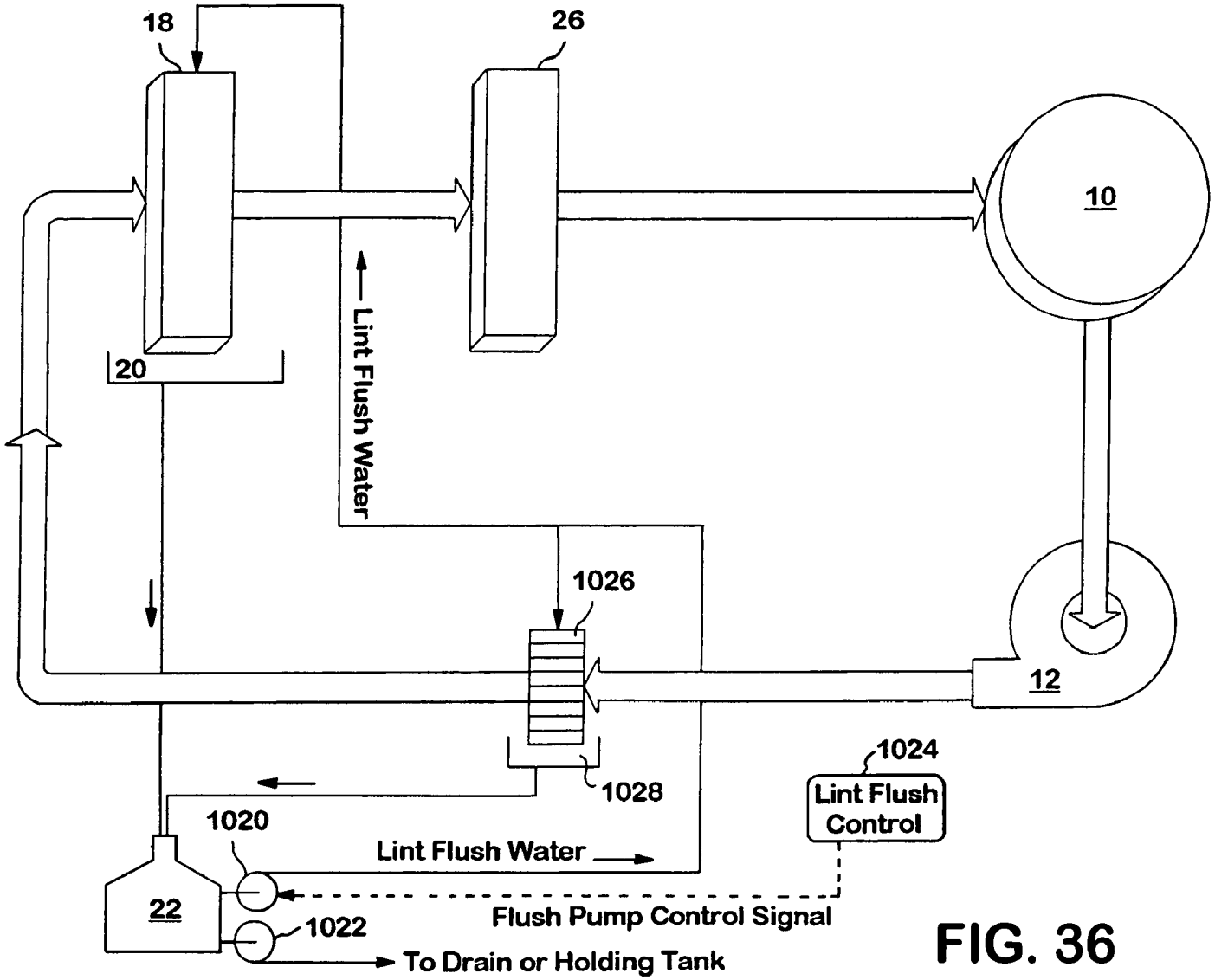
FIG. 36 is a schematic diagram of a heat pump dryer in accordance with the present invention having a self cleaning lint filter.

Dryer design to date has sought to prevent lint from reaching the evaporator. Lint will tend to stick to the wet evaporator surfaces and ultimately occlude it. However, as a relatively small amount of lint is produced by this dryer, the evaporator might be designed to attract lint, eliminating the need for a lint filter entirely. FIG. 36 illustrates such an embodiment.

The evaporator 18 may have a plurality of fins (not shown) spaced sufficiently to allow modest lint buildup on the fins without compromising airflow. Convoluted fins will tend to attract more lint than flat fins. Some portion of the lint will wash down with the condensate that drips into the collection tray 20.

The evaporator 18 may be self cleaning. As shown in FIG. 36, a spray or wash of condensate water from the sump 22 may be pumped by a lint flush pump 1020 over the evaporator fins, washing all remaining lint into the condensate tray 20. Lint may then be pumped out of the dryer by drain pump 1022 with the condensate drain discharge. This washdown may be done at the conclusion of each drying cycle, or at programmed intervals during drying. For example, a lint flush control 1024 may be provided. It may be advantages to circulate washdown water continuously during drying; the impact of this on condensing performance must be evaluated.

Further, a self cleaning lint trap 1026 may be provided in the air pathway. The trap 1026 may positioned between the blower 12 and the evaporator 18, which evaporator may be self-cleaning if desired. Water from the sump 22 may be provided to the lint trap 1026 by the pump 1020. Water containing lint may be collected by the tray 1028 and drained to the sump 22.

Moderate water pressure may be used to facilitate lint removal from the fins, however a high volume flush will likely yield better results. Proper manifold design with at least one discharge nozzle between each pair of fins, combined with fin design, will thoroughly flush the interfin gaps. A larger sump that holds sufficient water for washdown may be desired.

The manifold may be a single pass across the top of the evaporator, or may employ a plurality of passes across the evaporator at several heights. It may be constructed of an additional tubing circuit, similar to the refrigerant circuits, perforated between the fins. If numerous small perforations are used, such that a plurality occurs in each gap between fins, it will not be necessary to precisely align the perforations between the fins. This will permit integrating the washdown circuit into the evaporator during its manufacture.

The addition of an additional tubing circuit for washdown will render the overall evaporator 18 slightly larger. This will provide slightly increase fin surface and proper effectiveness with moderate lint loading.

This function may be achieved with a condensate diverter valve that selects either the condensate drain hose, or the washdown nozzles. However, it is simpler, more reliable, and likely of similar cost to simply use two pumps in the sump, one for drain discharge, and the other for evaporator washdown. This also permits optimization of each pump for its specific purpose.

The heat pipe assembly may also tend to get wet, and/or attract lint, and may need to be washed down as well.

J Fins

Figure 37:
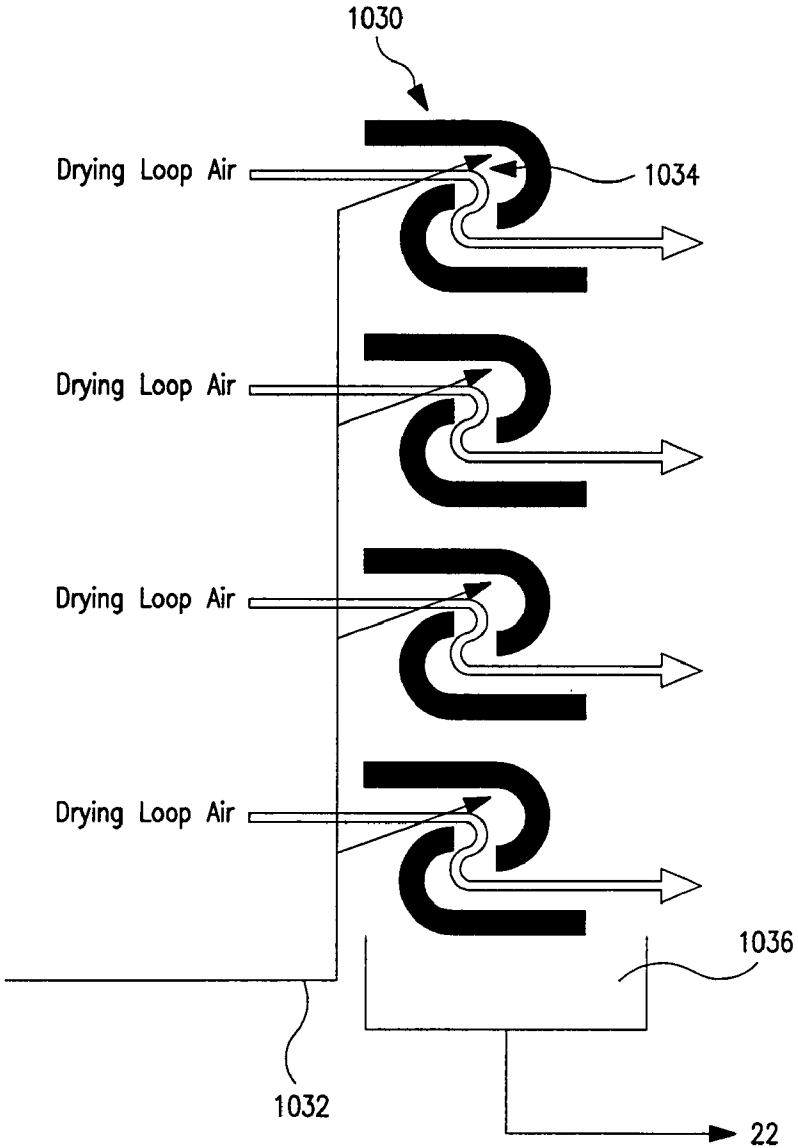
FIG. 37 is a schematic diagram of a self cleaning lint filter with a J fin configuration.

As shown in FIG. 37, interdigitated J fins 1030 may be used in a dedicated prefilter design. Each pair of adjacent J fins 1030 has a flush water spray nozzle 1034 which is provided with lint filter flush water via line 1032. Drying loop air 1034 passes between adjacent ones of the J fins 1030. Water is collected in the tray 1036 and drained to the sump 22. This design takes advantage of the velocity inertia of the lint particles, which will not negotiate the J turns and will tend to impinge on the fins. This might be done in an evaporator design, but as higher fin density is needed for proper evaporator capacity than is needed for lint trapping, a J fin evaporator may impose an undesirable air pressure drop.

Porous Fins

Hollow porous fins, fabricated of sintered microporous material or microperforated sheet may offer an effective wet down approach. Washdown water is fed to the hollow plenum formed by each fin, at moderate pressure, and oozes through the pores, maintaining a wet external surface, and good drainage downflow. This offers the advantage of completely wetted trap surfaces, and even wetting. This will help prevent lint from sticking to unwetted fin surface, and resisting removal. It will also likely require less washdown volume flow.

Although it is a bit complex, porous fins might also be applied directly to an evaporator.

Spray or Fog

This method will tend to humidify the drum exhaust air. This air is already quite wet, and the humidification effect of spray or fog may not be significant.

Spray, and to a greater extent fog, will trap lint in the air stream, but provision must be made to drive the lint ladent spray/fog to drain properly, and not carry lint in the airstream to the evaporator.

A spray or fog in combination with J fins, immediately downstream of the spray/fog source, may work well. It may be desirable to chill the J fins. This can be done with the refrigerant circuit, and will simply precool the air, without adding additional heat pump work.

It is apparent that there has been provided in accordance with the present invention a heat pump clothes dryer which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is apparatus is:

1. A drying apparatus comprising:

a housing;

a drying chamber mounted in the housing for containing articles to be dried, said drying chamber including an air inlet where drying air is delivered to said drying chamber and an air outlet where drying air leaves said drying chamber;

an air flow path connecting said air inlet to said air outlet to form a substantially closed drying loop;

a blower arranged to circulate air in said drying loop and through said drying chamber;

a heat pump comprising:

a refrigerant loop;

a compressor arranged to circulate refrigerant in said refrigerant loop under pressure, said compressor having a power consumption;

a first heat exchanger connected to said refrigerant loop and arranged in said drying loop so that heat from drying air leaving said drying chamber is transferred to said refrigerant, reducing the temperature of said drying air to below dew point so that moisture extracted from articles in said drying chamber condenses out of said drying air;

a valve in said refrigerant loop, said valve controlling the flow of refrigerant into said first heat exchanger;

a second heat exchanger connected to said refrigerant loop and arranged in said drying loop between said first heat exchanger and said drying chamber so that heat from said refrigerant is transferred to said drying air entering said drying chamber; and a refrigerant subcooler in said refrigerant loop and connected between a discharge of said second heat exchanger and said valve, said refrigerant subcooler comprising a third heat exchanger configured to extract a quantity of heat from refrigerant leaving said second heat exchanger, the quantity of heat extracted being modulated to be substantially equal to the power consumption of said compressor, said quantity of heat being removed from said refrigerant after said refrigerant has warmed said drying air, wherein said quantity of heat is removed from said drying apparatus, wherein said third heat exchanger is a refrigerant to liquid heat exchanger constructed to transfer heat from said refrigerant to a liquid coolant and said drying apparatus includes a coolant flow oath for delivering liquid coolant to said third heat exchanger from a source outside said drying apparatus and returning said liquid coolant to a location outside said drying apparatus.

2. The drying apparatus of claim 1, comprising a heat transfer device including a heat absorbing component arranged in said drying loop to extract heat from said drying air entering said first heat exchanger, a heat emitting component arranged in said drying loop to return at least a portion of said heat to said drying air leaving said first heat exchanger and a heat transfer path from said heat absorbing component to said heat emitting component.

3. The drying apparatus of claim 2, wherein said heat transfer device is a heat pipe.

4. The drying apparatus of claim 1, wherein said compressor is arranged to pressurize refrigerant leaving said first heat exchanger and deliver said pressurized refrigerant to said second heat exchanger, said drying apparatus comprising a refrigerant to refrigerant heat exchanger arranged to transfer heat from refrigerant leaving said second heat exchanger to refrigerant leaving said first heat exchanger before said refrigerant is pressurized by said compressor.

5. The drying apparatus of claim 1, wherein said drying chamber is mounted for rotation about an axis within said cabinet and said chamber includes vanes or baffles for tumbling articles placed in the chamber, said air inlet communicating with said drying chamber at a position below said axis, whereby said drying air enters said drying chamber in an upward direction.

6. The drying apparatus of claim 1, wherein said valve is a thermal expansion valve configured to maintain the refrigerant leaving said first heat exchanger at constant or near constant superheat.

7. The drying apparatus of claim 6, wherein said thermal expansion valve is electronically controlled.

8. The drying apparatus of claim 1, wherein said drying chamber includes an inside surface, at least a portion of which is heated.

9. The drying apparatus of claim 8, wherein said inside surface is heated by a refrigerant heat exchanger connected to said refrigerant loop, whereby heat from said refrigerant is transferred to said inside surface.

10. The drying apparatus of claim 9, wherein said refrigerant heat exchanger is integral to said drying chamber.

11. The drying apparatus of claim 9, wherein said refrigerant heat exchanger comprises tubing forming a portion of said refrigerant loop bonded to a surface of said drying chamber.

12. The drying apparatus of claim 9, wherein said refrigerant heat exchanger is connected to said refrigerant loop between said compressor and said second heat exchanger.

13. The drying apparatus of claim 1, wherein the drying chamber comprises a cylindrical drum fixedly mounted within said housing and having an inside surface, said drying apparatus comprising a plurality of vanes arranged to rotate within said drum in contact with or in close proximity to said inside surface.

14. The drying apparatus of claim 1, wherein said heat pump includes an active expander.

15. The drying apparatus of claim 1, wherein said active expander comprises a scroll type refrigerant compressor.

16. The drying apparatus of claim 1, comprising sensors arranged to detect a moisture content of said articles and a controller arranged to control said drying apparatus as a function of the detected moisture content.

17. The drying apparatus of claim 16, wherein said sensors include at least one of a humidity sensor at said air inlet, a temperature sensor at said air inlet, a humidity sensor at said air outlet and a temperature sensor at said air outlet.

18. A drying apparatus comprising:

a housing;

a drying chamber mounted in the housing for containing articles to be dried, said drying chamber including an air inlet where drying air is delivered to said drying chamber and an air outlet where drying air leaves said drying chamber;

an air flow path connecting said air inlet to said air outlet to form a substantially closed drying loop;

a blower arranged to circulate air in said drying loop and through said drying chamber;

a heat pump comprising:

a refrigerant loop;

a compressor arranged to circulate refrigerant in said refrigerant loop under pressure, said compressor having a power consumption;

a first heat exchanger connected to said refrigerant loop and arranged in said drying loop so that heat from drying air leaving said drying chamber is transferred to said refrigerant, reducing the temperature of said drying air to below dew point so that moisture extracted from articles in said drying chamber condenses out of said drying air;

a valve in said refrigerant loop, said valve controlling the flow of refrigerant into said first heat exchanger;

a second heat exchanger connected to said refrigerant loop and arranged in said drying loop between said first heat exchanger and said drying chamber so that heat from said refrigerant is transferred to said drying air entering said drying chamber; and a refrigerant subcooler in said refrigerant loop and connected between a discharge of said second heat exchanger and said valve, said refrigerant subcooler comprising a third heat exchanger configured to extract a quantity of heat from refrigerant leaving said second heat exchanger, the quantity of heat extracted being modulated to be substantially equal to the power consumption of said compressor, said guantity of heat being removed from said refrigerant after said refrigerant has warmed said drying air, wherein said quantity of heat is removed from said drying apparatus, wherein said first heat exchanger is an evaporator which receives refrigerant from said thermal expansion valve and said second heat exchanger is a condenser which receives refrigerant from said compressor.

19. The drying apparatus of claim 18, wherein said third heat exchanger is a refrigerant to air heat exchanger or a refrigerant to liquid heat exchanger.

20. A drying apparatus comprising:

a housing;

a drying chamber mounted in the housing for containing articles to be dried, said drying chamber including an air inlet where drying air is delivered to said drying chamber and an air outlet where drying air leaves said drying chamber;

an air flow path connecting said air inlet to said air outlet to form a substantially closed drying loop;

a blower arranged to circulate air in said drying loop and through said drying chamber;

a heat pump comprising:

a refrigerant loop;

a compressor arranged to circulate refrigerant in said refrigerant loop under pressure, said compressor having a power consumption;

a first heat exchanger connected to said refrigerant loop and arranged in said drying loop so that heat from drying air leaving said drying chamber is transferred to said refrigerant, reducing the temperature of said drying air to below dew point so that moisture extracted from articles in said drying chamber condenses out of said drying air;

a valve in said refrigerant loop, said valve controlling the flow of refrigerant into said first heat exchanger;

a second heat exchanger connected to said refrigerant loop and arranged in said drying loop between said first heat exchanger and said drying chamber so that heat from said refrigerant is transferred to said drying air entering said drying chamber; and a refrigerant subcooler in said refrigerant loop and connected between a discharge of said second heat exchanger and said valve, said refrigerant subcooler comprising a third heat exchanger configured to extract a quantity of heat from refrigerant leaving said second heat exchanger, the quantity of heat extracted being modulated to be substantially equal to the power consumption of said compressor, said quantity of heat being removed from said refrigerant after said refrigerant has warmed said drying air, wherein said quantity of heat is removed from said drying apparatus, wherein the quantity of energy extracted at said refrigerant subcooler is modulated according to a measured system parameter which varies with the power consumption of the compressor.

* * * * *